US008534752B2

(12) United States Patent
Martin et al.

(10) Patent No.: US 8,534,752 B2
(45) Date of Patent: Sep. 17, 2013

(54) RECONFIGURABLE TABLE ASSEMBLIES

(75) Inventors: Kirt Martin, Alto, MI (US); David C Eberlein, Hudsonville, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 13/092,721

(22) Filed: Apr. 22, 2011

(65) Prior Publication Data

US 2012/0037049 A1 Feb. 16, 2012

Related U.S. Application Data

(60) Provisional application No. 61/350,713, filed on Jun. 2, 2010.

(51) Int. Cl.
*A47C 7/62* (2006.01)

(52) U.S. Cl.
USPC ..... 297/184.15; 108/50.11

(58) Field of Classification Search
USPC ..... 297/135, 163, 184.1, 184.11, 184.14, 297/184.15; 108/50.11, 50.12, 11, 33, 180, 108/153.1; 135/96
See application file for complete search history.

(56) References Cited

U.S. PATENT DOCUMENTS

| | | | | |
|---|---|---|---|---|
| 571,652 | A | 11/1896 | Dodd | |
| 1,201,305 | A * | 10/1916 | Jones | 297/184.15 |
| 1,963,393 | A | 6/1934 | Woodall | |
| D95,588 | S | 5/1935 | Holsman | |
| 2,362,567 | A * | 11/1944 | La Rue | 297/158.5 |
| D150,242 | S | 7/1948 | McDonald | |
| 2,479,416 | A | 8/1949 | Schnurer | |
| 2,605,203 | A | 7/1952 | Silver | |
| D177,215 | S * | 3/1956 | Collins | 297/163 |
| 3,438,687 | A | 4/1969 | Brosk | |
| 3,575,465 | A | 4/1971 | Dolby et al. | |
| 3,713,474 | A | 1/1973 | Orlando | |
| D231,880 | S | 6/1974 | Weinstock | |
| 3,845,985 | A * | 11/1974 | Behrend et al. | 297/184.14 |
| D234,988 | S | 4/1975 | Lopez-Benitez | |
| D239,424 | S | 4/1976 | Offredi | |
| D245,950 | S | 10/1977 | Mathur | |
| RE29,522 | E | 1/1978 | Barecki | |

(Continued)

FOREIGN PATENT DOCUMENTS

| | | | |
|---|---|---|---|
| CN | 101301147 | A | 11/2008 |
| DE | 8623882 | U1 | 11/1986 |

(Continued)

OTHER PUBLICATIONS

PCT International Search Report and Written Opinion, PCT/US2011/038904, Nov. 23, 2011.

(Continued)

*Primary Examiner* — Jose V Chen
(74) *Attorney, Agent, or Firm* — Quarles & Brady LLP

(57) ABSTRACT

A hood assembly for use with furniture, the hood assembly comprising a frame structure including at least first and second rigid elongated frame members that are spaced apart by at least a first brace member and a fabric sock cover member that forms a passage that is open on at least one end, wherein the frame structure is slid into the passage to stretch the sock cover member over the frame structure and form an architectural structure including portions of the fabric sock cover member on either side of the frame member.

26 Claims, 86 Drawing Sheets

(56) References Cited

U.S. PATENT DOCUMENTS

D247,595 S 3/1978 Corson et al.
4,090,335 A 5/1978 Curatolo
4,121,645 A 10/1978 Behr
D250,922 S 1/1979 Adkinson
4,149,352 A 4/1979 Allen
D252,487 S 7/1979 Petersville
D256,829 S 9/1980 Qui et al.
D257,603 S 12/1980 Cyplik
D260,826 S 9/1981 Steinberger
D263,770 S 4/1982 Melchior
D269,237 S 6/1983 Burdick
4,516,619 A 5/1985 Hasbrouck
4,516,620 A 5/1985 Mulhern
D283,855 S 5/1986 Kujawski
4,621,865 A * 11/1986 Herrera ..... 297/184.15
D288,748 S 3/1987 Klein
D295,810 S 5/1988 Saporiti
4,821,477 A 4/1989 Rydqvist
D303,327 S 9/1989 Masarotti
4,966,181 A 10/1990 Liberman et al.
D318,966 S 8/1991 Schroff et al.
D321,435 S 11/1991 Scalisi et al.
D329,875 S 9/1992 Stern et al.
5,168,889 A * 12/1992 Diestel ..... 297/184.15
D336,185 S 6/1993 Deinen et al.
D337,219 S 7/1993 Dokoupil et al.
D337,450 S 7/1993 Dettinger
D337,911 S 8/1993 Gibson
D342,837 S 1/1994 Forcolini
5,287,909 A 2/1994 King et al.
D347,622 S 6/1994 Flasz
D348,432 S 7/1994 Dubruco
5,339,576 A 8/1994 Fussler
5,402,988 A 4/1995 Eisele
D359,161 S 6/1995 Byrne
D359,631 S 6/1995 Bubb
5,423,151 A 6/1995 Caro et al.
D360,310 S 7/1995 Stamberg et al.
D366,978 S 2/1996 Mariol
D367,364 S 2/1996 Lewis
D368,177 S 3/1996 Mourgue
D368,314 S 3/1996 Lin
D371,703 S 7/1996 Muller-Deisig et al.
5,553,551 A * 9/1996 Crombie ..... 297/184.15
D375,845 S 11/1996 Mourgue
D378,028 S 2/1997 Schefcik
D379,987 S 6/1997 Scheid et al.
D380,095 S 6/1997 Diaz-Azcuy
D381,216 S 7/1997 Paus
D382,123 S 8/1997 Pimental et al.
D382,736 S 8/1997 Kopish
D387,583 S 12/1997 Shear
D392,470 S 3/1998 Smith
D392,775 S 3/1998 McMahon
D399,661 S 10/1998 Smith
D405,976 S 2/1999 Beall
D405,979 S 2/1999 Kramer et al.
D410,800 S 6/1999 Gomez
D413,306 S 8/1999 Scherer et al.
5,934,679 A 8/1999 Strain et al.
D415,901 S 11/1999 Arko et al.
D418,611 S 1/2000 Montague, III
6,050,646 A 4/2000 Stenzel et al.
D423,808 S 5/2000 Natuzzi et al.
D427,783 S 7/2000 Luedke
D429,081 S 8/2000 Gomez
D430,543 S 9/2000 Rohder
6,120,097 A 9/2000 Perry et al.
D432,807 S 10/2000 Gollinucci
6,132,666 A 10/2000 Foley et al.
D438,402 S 3/2001 Walsh
D439,624 S 3/2001 Webb
D440,448 S 4/2001 Horsten
D443,157 S 6/2001 Linder
D446,039 S 8/2001 Gomez
6,276,382 B1 * 8/2001 Bindschatel et al. ..... 108/50.12
D448,946 S 10/2001 Goetz
6,296,002 B1 * 10/2001 Tashchyan ..... 297/184.1
6,302,053 B1 * 10/2001 Tomczak et al. ..... 297/184.14
D450,959 S 11/2001 Birsel et al.
6,341,822 B2 1/2002 Apissomian
D455,302 S 4/2002 Minami
D456,293 S 4/2002 Tsumura et al.
D457,017 S 5/2002 Muller
D457,359 S 5/2002 Chan
D457,736 S 5/2002 Simons, Jr. et al.
D457,737 S 5/2002 Citterio
D458,040 S 6/2002 Stannis et al.
D458,041 S 6/2002 Couture et al.
D458,463 S 6/2002 Citterio
6,402,233 B1 * 6/2002 Tseng ..... 297/184.1
6,447,067 B1 9/2002 Williams et al.
D465,201 S 11/2002 Gershfeld
D467,092 S 12/2002 Vu
6,494,335 B1 12/2002 Kellogg et al.
6,497,268 B1 12/2002 Peppett
D468,837 S 1/2003 Shilling et al.
6,516,571 B1 2/2003 Overthun et al.
D473,723 S 4/2003 Pesso
D473,850 S 4/2003 Rouleau et al.
D474,287 S 5/2003 Gresham et al.
6,571,519 B1 6/2003 Diffrient et al.
6,622,771 B2 9/2003 Plockmeyer
D480,883 S 10/2003 Williams et al.
D482,535 S 11/2003 Williams et al.
6,659,546 B2 * 12/2003 Schmeing et al. ..... 297/184.15
D484,709 S 1/2004 Cronk et al.
D485,086 S 1/2004 Gomez
6,726,277 B1 * 4/2004 Samaha ..... 297/184.11
6,749,001 B2 6/2004 Peppett
6,754,998 B2 6/2004 Diffrient et al.
D495,514 S 9/2004 Ricci
D495,518 S 9/2004 Ricci
D498,074 S 11/2004 Gomez
D501,330 S 2/2005 Gomez
D505,456 S 5/2005 Green
6,908,148 B2 * 6/2005 Wang et al. ..... 297/184.13
D508,455 S 8/2005 Oakley et al.
D516,101 S 2/2006 Vardon
D516,227 S 2/2006 Price
7,025,424 B2 4/2006 Harley
D520,263 S 5/2006 Nobles et al.
D530,929 S 10/2006 Resterhouse et al.
D531,225 S 10/2006 Kent et al.
D533,365 S 12/2006 Martin
D537,532 S 2/2007 Takeuchi et al.
D538,054 S 3/2007 Lissoni
D539,047 S 3/2007 Auberger
D543,404 S 5/2007 Watkins et al.
D544,062 S 6/2007 Baker
D549,470 S 8/2007 Hutton
D554,387 S 11/2007 Nicoletti
D564,764 S 3/2008 Springer et al.
D565,849 S 4/2008 Newhouse
D568,344 S 5/2008 Baacke et al.
D569,105 S 5/2008 Van Hoorn
D569,142 S 5/2008 Burak
D573,820 S 7/2008 Burak
D584,524 S 1/2009 Ricci
D584,900 S 1/2009 Hackethal et al.
D585,218 S 1/2009 Hamilton et al.
D595,865 S 7/2009 Magnusson
D596,876 S 7/2009 Oshinomi et al.
D596,878 S 7/2009 Oshinomi
D597,345 S 8/2009 Oshinomi et al.
D599,122 S 9/2009 Feldpausch et al.
D602,706 S 10/2009 Cramer et al.
D603,065 S 10/2009 Hamilton et al.
D603,617 S 11/2009 Weiss
D608,407 S 1/2010 Medlock
D614,844 S 5/2010 Trunfio
D615,308 S 5/2010 Serra Sola et al.
D616,663 S 6/2010 Natuzzi
D617,112 S 6/2010 Tsai

| | | | | |
|---|---|---|---|---|
| 7,740,048 | B2 | 6/2010 | Wilson | |
| 7,740,310 | B1 * | 6/2010 | Forster | 297/184.15 |
| 7,753,063 | B1 * | 7/2010 | Laws | 297/184.15 |
| D624,084 | S | 9/2010 | Scheper et al. | |
| D628,403 | S | 12/2010 | Starck | |
| D651,416 | S | 1/2012 | Martin et al. | |
| 8,225,723 | B2 | 7/2012 | Nakamura et al. | |
| 2002/0062933 | A1 | 5/2002 | Insalaco et al. | |
| 2002/0069794 | A1 | 6/2002 | Dame et al. | |
| 2002/0189170 | A1 | 12/2002 | Reuschel et al. | |
| 2003/0005863 | A1 | 1/2003 | Chen | |
| 2003/0056817 | A1 | 3/2003 | Miller et al. | |
| 2003/0070595 | A1 | 4/2003 | Crinion | |
| 2003/0140985 | A1 | 7/2003 | Wang | |
| 2003/0213415 | A1 | 11/2003 | Ross et al. | |
| 2004/0060485 | A1 | 4/2004 | Chang | |
| 2004/0194669 | A1 | 10/2004 | Forslund, III et al. | |
| 2004/0231570 | A1 | 11/2004 | Landa | |
| 2004/0250480 | A1 | 12/2004 | Matthai | |
| 2004/0250739 | A1 | 12/2004 | Yang | |
| 2005/0028272 | A1 | 2/2005 | Kanthasamy | |
| 2005/0045073 | A1 | 3/2005 | Wasley | |
| 2005/0056308 | A1 | 3/2005 | Birchenough | |
| 2005/0126447 | A1 | 6/2005 | Smith et al. | |
| 2005/0263041 | A1 | 12/2005 | Mueller et al. | |
| 2005/0268823 | A1 | 12/2005 | Bakker et al. | |
| 2005/0284341 | A1 | 12/2005 | Klassy et al. | |
| 2006/0042520 | A1 | 3/2006 | Stevens et al. | |
| 2006/0080817 | A1 | 4/2006 | Klinker | |
| 2006/0096506 | A1 | 5/2006 | Brauning et al. | |
| 2006/0108299 | A1 | 5/2006 | Menard | |
| 2006/0162065 | A1 | 7/2006 | Glattstein et al. | |
| 2006/0162626 | A1 | 7/2006 | Brauning et al. | |
| 2006/0266900 | A1 | 11/2006 | May et al. | |
| 2006/0278777 | A1 | 12/2006 | Atkinson et al. | |
| 2007/0017888 | A1 | 1/2007 | Falvey et al. | |
| 2007/0018486 | A1 * | 1/2007 | Ayers et al. | 297/184.15 |
| 2007/0039150 | A1 | 2/2007 | Thomas et al. | |
| 2007/0057000 | A1 | 3/2007 | Webster | |
| 2007/0062992 | A1 | 3/2007 | Hepworth et al. | |
| 2007/0095374 | A1 | 5/2007 | Gendriesch et al. | |
| 2007/0114350 | A1 | 5/2007 | Sorci | |
| 2007/0221795 | A1 | 9/2007 | Cutty | |
| 2007/0251428 | A1 | 11/2007 | Mead et al. | |
| 2007/0277710 | A1 | 12/2007 | Gray et al. | |
| 2007/0277711 | A1 | 12/2007 | Grant | |
| 2007/0283631 | A1 | 12/2007 | Grandin et al. | |
| 2008/0010935 | A1 | 1/2008 | Nagel et al. | |
| 2008/0035031 | A1 | 2/2008 | Yamanishi et al. | |
| 2008/0041281 | A1 | 2/2008 | Griepentrog | |
| 2008/0050173 | A1 | 2/2008 | Bruder et al. | |
| 2008/0053931 | A1 | 3/2008 | Newbould et al. | |
| 2008/0074014 | A1 | 3/2008 | Ho | |
| 2008/0290768 | A1 | 11/2008 | Haberman | |
| 2008/0295745 | A1 | 12/2008 | Hamilton et al. | |
| 2008/0296245 | A1 | 12/2008 | Punzel et al. | |
| 2008/0296457 | A1 | 12/2008 | Hager et al. | |
| 2009/0001859 | A1 | 1/2009 | Compton et al. | |
| 2009/0013908 | A1 | 1/2009 | Grove et al. | |
| 2009/0014401 | A1 | 1/2009 | Tallman | |
| 2009/0039685 | A1 * | 2/2009 | Zernov | 297/184.14 |
| 2009/0042428 | A1 | 2/2009 | Henriott et al. | |
| 2009/0051254 | A1 | 2/2009 | Grove | |
| 2009/0133609 | A1 | 5/2009 | Nethken et al. | |
| 2009/0165680 | A1 | 7/2009 | Bakker et al. | |
| 2009/0260547 | A1 | 10/2009 | Epstein et al. | |
| 2009/0273260 | A1 | 11/2009 | Kemp | |
| 2009/0282663 | A1 | 11/2009 | Martin et al. | |
| 2009/0284111 | A1 | 11/2009 | Hazzard et al. | |
| 2009/0293391 | A1 | 12/2009 | DeVore | |
| 2009/0293402 | A1 | 12/2009 | Hamilton et al. | |
| 2009/0309464 | A1 | 12/2009 | Schwartz | |
| 2009/0314913 | A1 | 12/2009 | Gillis | |
| 2010/0000449 | A1 | 1/2010 | Botkin | |
| 2010/0045081 | A1 * | 2/2010 | Efthimiou | 297/184.11 |
| 2010/0073919 | A1 | 3/2010 | Sharpe | |
| 2010/0096349 | A1 | 4/2010 | Schulman | |
| 2010/0126394 | A1 | 5/2010 | Burak et al. | |
| 2010/0212139 | A1 | 8/2010 | Oddsen, Jr. et al. | |
| 2010/0270246 | A1 | 10/2010 | Rodriguez | |
| 2010/0326930 | A1 | 12/2010 | Chiang | |
| 2010/0327134 | A1 | 12/2010 | Lundrigan et al. | |

FOREIGN PATENT DOCUMENTS

| | | | |
|---|---|---|---|
| DE | 3625137 | C1 | 10/1987 |
| DE | 19733435 | A1 | 2/1999 |
| DE | 19848392 | C1 | 12/1999 |
| EP | 0096272 | A2 | 12/1983 |
| EP | 0145410 | A2 | 6/1985 |
| EP | 0147902 | A2 | 7/1985 |
| EP | 0164041 | A2 | 12/1985 |
| EP | 0447961 | A2 | 9/1991 |
| EP | 0462920 | A1 | 12/1991 |
| EP | 0594939 | A1 | 5/1994 |
| EP | 0791311 | A1 | 8/1997 |
| EP | 0815775 | A2 | 1/1998 |
| EP | 0903139 | A1 | 3/1999 |
| EP | 0949394 | A1 | 10/1999 |
| EP | 1647205 | A1 | 4/2006 |
| FR | 2636511 | A1 | 3/1990 |
| FR | 2865486 | A1 | 7/2005 |
| GB | 2048351 | A | 12/1980 |
| GB | 2100121 | A | 12/1982 |
| GB | 2246801 | A | 2/1992 |
| GB | 2323781 | A | 10/1998 |
| JP | 2002100889 | A | 4/2002 |
| JP | 2004237398 | A | 8/2004 |
| JP | 2004275314 | A | 10/2004 |
| JP | 2004313251 | A | 11/2004 |
| JP | 2005087625 | A | 4/2005 |
| JP | 2008023195 | A | 2/2008 |
| JP | 2008142337 | A | 6/2008 |
| JP | 2008289634 | A | 12/2008 |
| JP | 2009082528 | A | 4/2009 |
| WO | 9609782 | A1 | 4/1996 |
| WO | 9713431 | A1 | 4/1997 |
| WO | 9719617 | A2 | 6/1997 |
| WO | 9801056 | A1 | 1/1998 |
| WO | 9960889 | A2 | 12/1999 |
| WO | 03047400 | A2 | 6/2003 |
| WO | 2004021830 | A1 | 3/2004 |
| WO | 2005098159 | A2 | 10/2005 |
| WO | 2006029895 | A1 | 3/2006 |
| WO | 2009052656 | A1 | 4/2009 |
| WO | 2009154983 | A2 | 12/2009 |

OTHER PUBLICATIONS

PCT International Search Report and Written Opinion, PCT/US2011/038899, Nov. 23, 2011.

PCT International Search Report and Written Opinion, PCT/US2011/038892, Nov. 24, 2011.

Unifor Misura St Catalog, 1986.

Unifor Luca Meda Catalog.

Unifor Pannelli PL Catalog.

Unifor Progetto 25.90 Catalog.

* cited by examiner

RECONFIGURABLE TABLE ASSEMBLIES

CROSS-REFERENCE TO RELATED APPLICATIONS

This application claims priority to U.S. provisional patent application Ser. No. 61/350,713 which was filed on Jun. 2, 2010 and which is titled "Reconfigurable Table Assemblies".

STATEMENT REGARDING FEDERALLY SPONSORED RESEARCH OR DEVELOPMENT

Not applicable.

BACKGROUND OF THE INVENTION

The field of the invention is desks or tables and more specifically desk or table assemblies that include leg members, work surfaces, storage components and wire management components that can be configured and assembled to form one or a plurality of different workstation arrangements using a small number or no tools.

The office furniture industry is always evolving to meet the needs of customers. Benching systems have been developed that can be used in large open spaces to provide either temporary or permanent workstations for one or more employees. To this end, known benching systems typically include a leg structure that supports one or more desk or table top surfaces for use by one or more employees. In many cases, additional top members and leg structures can be added to an initial configuration to add additional employee workstations. Known designs often include some type of wire management system mounted to the undersurfaces of the top members for hiding power and/or data cables needed to support users at the workstations. Power receptacles are typically provided below or at the top surfaces for powering devices (e.g., computers, chargers, lighting, etc.). Storage requirements are often met by providing case goods that either mount to the undersurfaces of the top members or in some fashion to the leg structures. Other accessories such as computer shelves, screens, lighting devices, paper holders and the like are known and often are mechanically mounted to undersurfaces or edges of the top members or to the support leg structure.

While benching systems have proven particularly useful in certain applications, known benching systems have several shortcomings. First, some benching systems have been designed to have a minimal number of component parts and are supposed to be easy to assemble without the use of tools or with minimal tool use. Unfortunately, in these cases, the resulting benching assemblies are often wobbly and do not have a quality look and feel after assembly and during used.

Second, some benching systems have been developed that include a large number of components and mechanical linkages between components in order to provide a relatively high quality look and feel. Here, however, quality look and feel and accessory support typically increase expense appreciably and, because of their relative complexity, these systems typically require multi-step assembly of a large number of components and use of many specialized tools which make it difficult at best for an untrained person to assembly a configuration. Moreover, when optimal configuration requirements change (i.e., five workstations are required instead of eight), system complexity discourages reconfiguration resulting in non-optimal use of space.

Third, with the exception of adding on additional workstations to an existing configuration, known benching systems are not particularly reconfigurable for purposes other than workstation use. Thus, for instance, where a benching assembly currently includes eight workstations in a four facing four configuration and only five workstations are required, it may be advantageous to be able to reconfigure the configuration so that two of the stations could be used as general seating in the area and a third of the stations could be eliminated. Known benching systems cannot be reconfigured in this manner.

Fourth, no known benching system allows the components of a single workstation assembly to be used in their entirely in a face to face two person workstation assembly which is a particularly useful capability as it enables the useful face to face arrangement while still allowing odd numbers of workstations to be configured together for optimally supporting any number of users.

BRIEF SUMMARY OF THE INVENTION

It has been recognized that a reconfigurable benching system can be provided that includes a simplified core frame structure and an additional small number of components that can be assembled in many different ways to suit optimal configuration requirements and that can be disassembled just as easily to reconfigure when desired. Assembly components have been designed specifically so that assembly thereof is intuitive, easy, and requires few (e.g., one), if any, tools. The core frame structure is assembled first and thereafter other components are added one at a time until an entire desired configuration is completed. As additional components are added to the core frame structure, the additional components and core frame structure cooperate to increase rigidity of the overall assembly until an extremely sturdy assembly results. The components together act as a web to increase rigidity.

The core frame structure includes first and second leg members and a rigid channel or rail member that extends between and mounts to the first and second leg members. Each leg member includes a horizontal support surface or rail lip that has a length dimension. The channel or rail member can be mounted to each leg member at more than one location along the rail lip. For instance, the channel/rail member can be mounted centrally along each rail lip to divide a frame space between facing surfaces of the leg members into front and rear spaces and different furniture assemblies can be mounted at least partially within the front and rear spaces or the channel/rail member can be mounted at rear ends of the lip members so that the frame space between the leg members resides to a front side of the rail lips and a single furniture assembly can be mounted within the frame space. The channel/rail members is mounted to the legs for sliding movement along the length dimension of the legs so that channel position can be modified quickly.

The components in addition to the leg members and the channel/rail member include support or bracket members, trough members and table top members that can all be mounted within the frame space or generally within a space defined by facing surfaces of the leg members. In some embodiments different table top sizes are optional and a seating or lounge subassembly may also optionally be positioned within a frame space.

For shipping, the assembly components can be disassembled and shipped in relatively small and flat boxes to save costs. To this end, at their base level, most of the assembly components break down into elongated members that can easily stack up into compact spaces.

In at least some embodiments each of the leg members includes oppositely facing lateral surfaces where each of the lateral surfaces forms at least one mounting slot and/or lip members for mounting table top members, trough members, a channel member, etc. Here, a single leg member can be used to support tables, troughs, etc., on either side so that several workstations can be configured in a side-by-side fashion if desired.

Some embodiments include a furniture kit including first and second spaced apart leg members including front and rear end portions and a frame space between facing surfaces, a first furniture assembly including a first rigid furniture component having first and second ends and having front and rear portions, wherein (i) a first furniture configuration is configurable that includes the first furniture assembly supported between the leg members and generally within the frame space with the front and rear portions of the first furniture assembly adjacent the front and rear end portions of the leg members, respectively, and (ii) a second furniture configuration is configurable that includes the first furniture assembly supported between the leg members and generally within the frame space with the front and rear portions of the first furniture assembly adjacent the rear and front end portions of the leg members, respectively.

In some embodiments a third furniture configuration is configurable that includes the rear portion of the first furniture assembly supported adjacent the front portions of the leg members and the front portion of the first furniture assembly extending out from the frame space and wherein a fourth furniture configuration is configurable that includes the rear portion of the first furniture assembly supported adjacent the rear portions of the leg members with the front portion of the first furniture assembly extending out from the frame space.

In some embodiments the first furniture assembly includes at least a first wire management channel having first and second ends and a table top member wherein the first furniture configuration includes the wire management channel mounted at opposite ends to the first and second leg members along a rear edge of the frame space with the table top member located to a front side of the wire management channel within the frame space, the second furniture configuration includes the wire management channel mounted at opposite ends to the first and second leg members along a front edge of the frame space with the table top member located to a rear side of the wire management channel within the frame space, the third furniture configuration includes the wire management channel mounted at opposite ends to the first and second leg members along an intermediate portion of the frame space with the table top member located to a front side of the wire management channel and the fourth furniture configuration includes the wire management channel mounted at opposite ends to the first and second leg members along an intermediate portion of the frame space with the table top member located to a rear side of the wire management channel.

Some cases further include a second furniture assembly including a second rigid furniture component having first and second ends wherein a fifth furniture configuration is configurable by mounting the second furniture assembly between the first and second leg members to a rear side of the wire management channel in the third furniture configuration and wherein a sixth furniture configuration is configurable by mounting the second furniture assembly between the first and second leg members to a front side of the wire management channel in the fourth furniture configuration.

Some cases further include a third leg member and a second furniture assembly, the third leg member including front and rear end portions where the second and third leg members form a second frame space therebetween, wherein (i) the first furniture configuration further includes the second furniture assembly supported between the second and third leg members and generally within the second frame space with the front and rear portions of the second furniture assembly adjacent the front and rear end portions of the second and third leg members, respectively, (ii) the second furniture configuration further includes the second furniture assembly supported between the second and third leg members and generally within the second frame space with the front and rear portions of the second furniture assembly adjacent the rear and front end portions of the second and third leg members, respectively, (iii) a third furniture configuration is configurable with the first furniture assembly supported between the first and second leg members and generally within the frame space with the front and rear portions of the first furniture assembly adjacent the front and rear end portions of the first and second leg members, respectively, and with the second furniture assembly supported between the second and third leg members and generally within the second frame space with the front and rear portions of the second furniture assembly adjacent the rear and front end portions of the second and third leg members, respectively and (iv) a fourth furniture configuration is configurable with the first furniture assembly supported between the first and second leg members and generally within the frame space with the front and rear portions of the first furniture assembly adjacent the rear and front end portions of the first and second leg members, respectively, and with the second furniture assembly supported between the second and third leg members and generally within the second frame space with the front and rear portions of the second furniture assembly adjacent the rear and front end portions of the second and third leg members, respectively.

Some cases further include a second furniture assembly including a second rigid furniture component having first and second ends wherein a third furniture configuration is configurable that includes the first furniture assembly supported between the leg members and generally adjacent the front end portions of the leg members and the second furniture assembly supported between the leg members and generally adjacent the rear end portions of the leg members.

Some cases further include a second furniture assembly including a second rigid furniture component having first and second ends and front and rear portions wherein (i) a third furniture configuration is configurable that includes the second furniture assembly supported between the leg members and generally within the frame space with the front and rear portions of the second furniture assembly adjacent the front and rear end portions of the leg members, respectively and (ii) a fourth furniture configuration is configurable that includes the second furniture assembly supported between the leg members and generally within the frame space with the front and rear portions of the second furniture assembly adjacent the rear and front end portions of the leg members, respectively. In some cases a fifth furniture configuration is configurable that includes the first furniture assembly supported between the leg members and generally adjacent the front end portions of the leg members and the second furniture assembly supported between the leg members and generally adjacent the rear end portions of the leg members. In some cases the first rigid furniture component includes a table top and the second furniture assembly includes a seating assembly. In some cases each of the first and second rigid furniture components includes a table top.

In some cases the first furniture assembly further includes an elongated rigid rail member wherein the first furniture configuration includes the rail member located adjacent to and supported by the rear portions of the leg members and the second furniture configuration includes the rail member located between adjacent to and supported by the front portions of the leg members.

In some cases the first furniture assembly further includes a table top member and a first storage trough wherein the first storage trough is supportable by the leg members between the first table top and the rail member. In some cases the rail member forms a wire management channel along a length dimension. In some cases the channel member forms an upward opening along rear edges of adjacent furniture assemblies.

In some cases each leg member includes first and second spaced apart and substantially parallel horizontal beam members, the rail member includes an expansion jaw assembly at each of the first and second ends and wherein each expansion jaw is received between and mounts the channel to the beam members that comprise one of the leg members. In some cases the rail member is mounted to the leg members for sliding movement between the front and rear portions of the leg members. In some cases each of the first and second leg members forms at least one substantially horizontal slot and wherein the first furniture assembly includes a support member extending from each of the first and second ends that is releasably receivable within one of the slots for securing the furniture assembly to an adjacent leg member.

Other embodiments include a method for reconfiguring a single person workstation wherein the single person workstation includes first and second spaced apart leg members that form a first frame space therebetween and a table top assembly where the table top assembly is mountable between the leg members in either of at least a first position with the table top assembly located substantially within the frame space and a second position wherein at least a portion of the table top assembly extends out of the frame space, the method comprising the steps of, with the table top assembly initially in the first of the two positions, moving the table top assembly from the first of the two positions to the second of the two positions and securing the table top assembly in the second of the two positions with at least a portion of the table top assembly extending out of the frame space.

In some cases the work station further includes a rail member that includes first and second ends and that mounts between the first and second leg members, the rail member moveable with the table top assembly between the first and second positions and supporting an edge of the table top assembly. In some cases the rail member includes couplers at first and second ends for securely engaging the leg members and wherein the method further includes the steps of, with the couplers initially in an engaged position, disengaging the couplers from the leg members and wherein the step of securing the table top assembly in the second position includes, after the rail and the table top assembly are in the second position, re-engaging the couplers to the leg members. In some cases the rail and table top assembly are mounted to the leg members for sliding movement between the first and second positions and wherein the step of moving the rail and table top assembly includes sliding the rail and top member from the first position to the second position.

In some cases the rail member includes a channel member that forms a wire management channel along a length dimension that extends between first and second ends where the first and second ends are mounted to the first and second leg members, respectively. Some cases are also for reconfiguring the single person work station to construct a two person workstation, the method further comprising the steps of, after securing the first table top assembly in the second position, providing a second table top assembly and mounting the second table top assembly between the first and second leg members adjacent the first table top assembly with at least a portion of the second table top assembly extending out of the frame space in a direction opposite the direction in which the first table top assembly extends.

In some cases the work station also includes a rail member that includes first and second ends and that mounts between the first and second leg members, the rail member moveable with the table top assembly between the first and second positions and supporting an edge of each of the table top assemblies when the second table top assembly is mounted between the leg members. Some embodiments are also for configuring a third station and further comprise the steps of spacing a third leg member from the second leg member and on a side of the second leg member opposite the first leg member to form a second frame space between the second and third leg members, mounting a second rail member between the second and third leg members and mounting a third table top assembly generally within the second frame space.

Some cases are also for configuring a third station and a fourth station and further comprise the steps of spacing a third leg member from the second leg member and on a side of the second leg member opposite the first leg member to form a second frame space between the second and third leg members, mounting a second rail member centrally between the second and third leg members and mounting third and fourth table top assemblies between the second and third leg members and on opposite sides of the second rail member.

Other embodiments include a table assembly kit comprising first and second leg members, each leg member having front and rear ends, a first elongated channel member forming a wire management channel along its length, the channel member mountable at opposite ends to the first and second leg members for substantially horizontal sliding movement with respect to the leg members between at least an intermediate position in which the channel member is intermediately positioned with respect to the front and rear ends of the leg members and a rear position wherein the channel member is positioned adjacent the rear ends of the leg members and a first table top assembly, wherein a first single workspace configuration can be configured by positioning the channel member in the rear position and mounting the first table top assembly between the first and second leg members substantially within the frame space and to a forward side of the channel member and a second single workspace configuration can be configured by positioning the channel member in the intermediate position and mounting the first table top assembly between the first and second leg members to a front side of the channel member.

In some cases a third single workspace configuration can be configured by positioning the channel member in a forward position wherein the channel member is positioned adjacent the forward ends of the leg members and mounting the first table top assembly between the first and second leg members to a rearward side of the channel member and substantially within the frame space. In some cases a third single workspace configuration can be configured by positioning the channel member in the intermediate position and mounting the first table top assembly between the first and second leg members to a rear side of the channel member.

Some cases further include a second table top assembly wherein a two person workspace can be configured by positioning the channel member in the intermediate position, mounting the first table top assembly between the first and second leg members to the front side of the channel member and mounting the second table top assembly between the first and second leg members to a rear side of the channel member. In some cases each of the first and second table top assemblies includes a table top member and a trough member. In some cases the table top assembly includes a table top member and a trough member. In some cases the channel member supports at least one edge of the trough member and wherein the trough member supports at least one edge of the table top member.

Some cases further include a third leg member having front and rear ends and a second elongated channel wherein a two person workspace can also be configured by positioning the first channel member between the first and second leg members, positioning the second channel member between the second and third leg members and mounting the first and second table top assemblies between the first and second leg members and the second and third leg members on one of the front and rear sides of the first and second channel members, respectively.

Some embodiments include a furniture kit including first and second spaced apart leg members including front and rear end portions and a frame space between facing surfaces, a first furniture assembly including a first rigid furniture component having first and second ends, a second furniture assembly including a second rigid furniture component having first and second ends, wherein (i) a first furniture configuration is configurable that includes the first furniture assembly supported between the leg members and generally within the frame space and (ii) a second furniture configuration is configurable that includes the first furniture assembly supported between the leg members and generally adjacent the front end portions of the leg members and the second furniture assembly supported between the leg members and generally adjacent the rear end portions of the leg members.

Other embodiments include a method for configuring workstations comprising the steps of spacing first and second leg members so that facing surfaces form a frame space where the leg members each includes front and rear portions and an intermediate portion between the front and rear portions, when a single person workstation is to be configured (i) mounting a first rail member between facing surfaces of the leg members, (ii) mounting a first table top assembly between the leg members and to one side of the rail member where the rail member supports a rear edge of the first table top assembly, when a two person workstation is to be configured, (i) mounting a first rail member between the intermediate portions of the leg members, (ii) mounting a first table top assembly between the leg members and to a first side of the rail member where the rail member supports a rear edge of the first table top assembly and (iii) mounting a second table top assembly between the leg members and to a second side of the rail member where the rail member supports a rear edge of the second table top assembly.

In some cases the step of mounting the rail member between first and second facing surfaces of the leg members includes mounting the rail member to one of rear portions of the leg members and front portions of the leg members. In some cases the step of mounting the rail member between first and second facing surfaces of the leg members includes mounting the rail member to intermediate portions of the leg members.

Some cases further include spacing a third leg member from the second leg member on a side opposite the side on which the first leg member resides where the third leg member includes front and rear portions and, when a three person workstation is to be configured (i) mounting a first rail member between the intermediate portions of the first and second leg members, (ii) mounting a first table top assembly between the first and second leg members and to a first side of the first rail member where the first rail member supports a rear edge of the first table top assembly, (iii) mounting a second table top assembly between the first and second leg members and to a second side of the first rail member where the first rail member supports a rear edge of the second table top assembly, (iv) mounting a second rail member between facing surfaces of the second and third leg members and (v) mounting a third table top assembly between the second and third leg members and to one side of the second rail member where the second rail member supports a rear edge of the third table top assembly.

Some cases further include the steps of, when a three person workstation is to be configured (i) mounting a first rail member between the intermediate portions of the first and second leg members, (ii) mounting a first table top assembly between the first and second leg members and to a first side of the first rail member where the first rail member supports a rear edge of the first table top assembly, (iii) mounting a second table top assembly between the first and second leg members and to a second side of the first rail member where the first rail member supports a rear edge of the second table top assembly, (iv) mounting a second rail member between facing surfaces of the second and third leg members, (v) mounting a third table top assembly between the second and third leg members and to one side of the second rail member where the second rail member supports a rear edge of the third table top assembly and (vi) mounting a fourth table top assembly between the second and third leg members and to a second side of the second rail member where the second rail member supports a rear edge of the second table top assembly.

Other embodiments include a hood assembly for use with furniture, the hood assembly comprising a frame structure including at least first and second rigid elongated frame members that are spaced apart by at least a first brace member and a fabric sock cover member that forms a passage that is open on at least one end, wherein the frame structure is slid into the passage to stretch the sock cover member over the frame structure and form an architectural structure including portions of the fabric sock cover member on either side of the frame member.

In some cases the first and second frame members are each bent to form an arch where each arch includes first and second substantially vertical and parallel members and a single substantially horizontal member extending between top ends of the first and second vertical members, the fabric sock cover extending along the first vertical members, the horizontal members and the second vertical members. In some embodiments the at least one open end of the sock cover member includes a closure structure for closing the at least one open end after the sock cover member is slid on to the frame structure.

In some cases the sock cover member includes a second open end opposite the first open end and wherein the second open end includes a closure structure for closing the second end. In some cases the closure structure includes hook and loop strips. In some cases the first and second frame members each has first and second ends, the first brace member is mounted between the first ends of the first and second frame members and the assembly further includes a second brace member mounted between the second ends of the first and second frame members.

In some embodiments each of the first and second brace members forms at least one mounting hole for mounting the brace member to a support structure. In some cases each of the first and send frame members includes a first bend between the first vertical member and the horizontal member and a second bend between the second vertical member and the horizontal member, the assembly further including a third brace member mounted between the first bends of the first and second frame members and a fourth brace member mounted between the second bends of the first and second frame members. In still other cases each of the first and second bends includes an outer surface forming an outer radius and wherein the third and fourth brace members each forms a radius along its length that is substantially similar to the outer radii.

Some embodiments include a furniture assembly comprising a lounge assembly including a user support member forming a first coupler, a hood assembly including a second coupler and a bracket including third and fourth couplers where the third coupler is mountable to the first coupler and the second coupler is mountable to the fourth coupler so that the bracket can be used to mount the hood assembly to the lounge assembly. In some cases the user support member includes an arm member of the lounge assembly and wherein the first coupler includes a slot formed in the arm member.

Other embodiments include a reconfigurable furniture kit comprising a hood assembly including first and second spaced apart lower mounting members that define a hood width, a table assembly including a table top member having first and second side edges that define a table top width which is substantially similar to the hood width and a lounge assembly including first and second lounge arm members having top surfaces, the lounge arm members defining a lounge width which is substantially similar to the hood width, wherein the hood assembly may be supported by one of (1) the table top with the first and second spaced apart lower mounting members supported by portions of the table top adjacent the first and second side edges and (2) the top surfaces of the lounge arm members.

Some cases further include a table mounting bracket for mounting the hood assembly to the table top and a lounge mounting bracket for mounting the hood assembly to the lounge arms wherein each of the table mounting bracket and the lounge mounting bracket interface with the first and second spaced apart lower mounting members in the same fashion.

Other embodiments include a method for forming a private space above a piece of furniture, the method comprising the steps of providing a hood shaped frame structure including first and second lower brace members that form couplers for mounting the frame structure to the piece of furniture, providing a sock cover that forms a passage between open first and second ends, sliding the sock cover over the frame structure so that the first and second lower brace members are adjacent and exposed at the first and second open ends, mounting the first and second lower brace members to the piece of furniture and closing the open first and second ends of the sock cover adjacent undersurfaces of the first and second lower brace members.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF THE INVENTION

One or more specific embodiments of the present invention will be described below. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
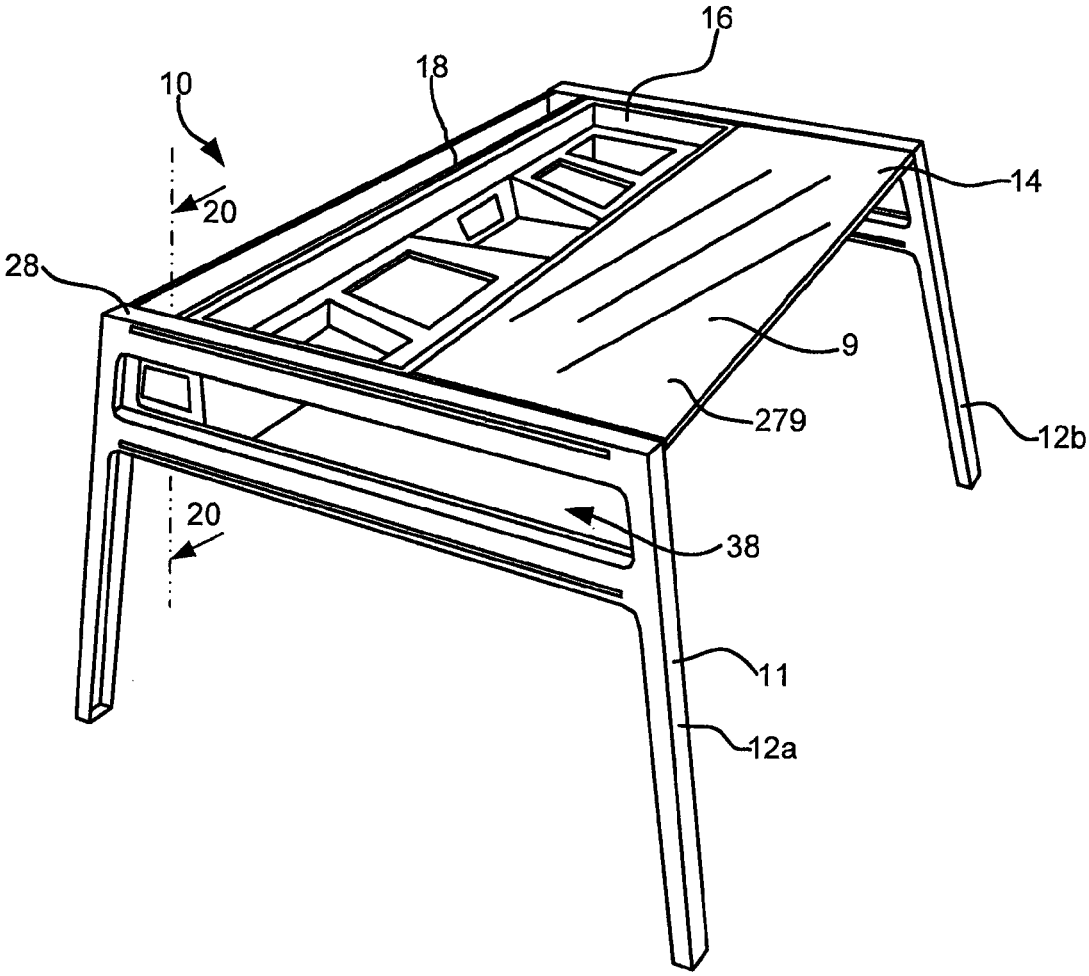
FIG. 1 is a perspective view of the a table/desk assembly that is consistent with at least some aspects of the present invention.
Figure 2:
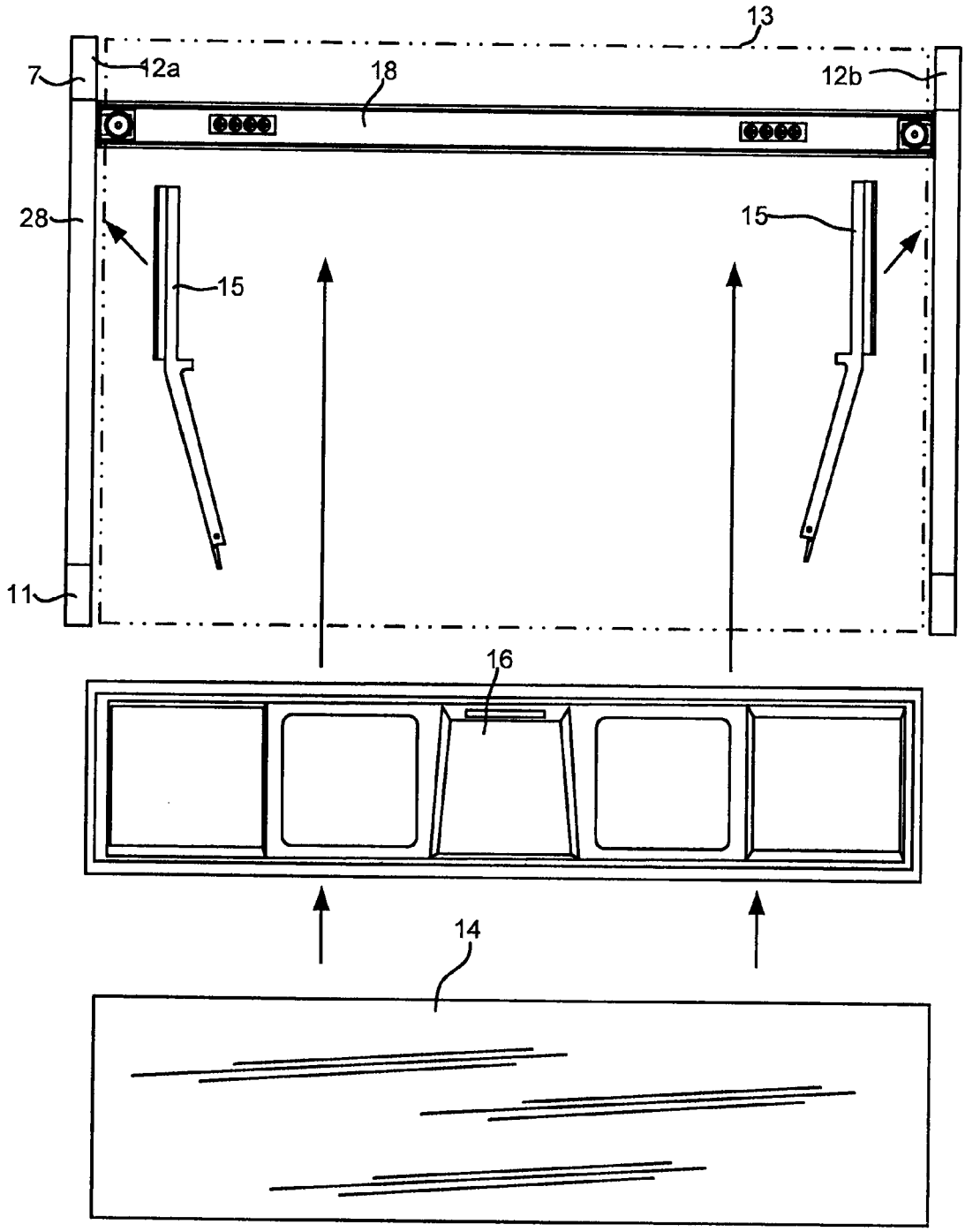
FIG. 2 is a partially exploded top plan view of the assembly shown in FIG. 1.

Referring now to the drawings wherein like reference numerals correspond to similar elements throughout the several views and, more specifically, referring to FIG. 1, the present invention will initially be described in the context of an exemplary single workstation desk/table configuration 10 that includes a small number of basic components. Referring also to FIG. 2, configuration 10 includes first and second leg assemblies 12*a* and 12*b* (also referred to as leg members hereafter), a table top assembly 14, a trough member 16, a wire management channel assembly or member 18 and first and second arm support members 15. In general, the leg assemblies 12*a* and 12*b* are spaced apart such that a frame space 13 (see phantom in FIG. 2) is formed there between. Channel assembly 18 is mounted at opposite ends between the leg assemblies 12*a* and 12*b* and near back or rear portions thereof to form a rigid frame construction. Arm members 15 are mounted to facing surfaces of leg assemblies 12*a* and 12*b* with distal ends thereof extending generally in a direction away from channel assembly 18 (i.e., members 15 extend in a forward direction). Trough member 16 is mounted between leg members 12*a* and 12*b* within frame space 13 and is supported by an adjacent front edge of channel assembly 18 as well as top support surfaces of arm support members 15. Table top member 14 is supported along a rear edge by an adjacent support surface formed by trough member 16 as well as by the distal ends of arm members 15 within frame space 13. Thus, in general all of the configuration 10 components in addition to leg assemblies 12*a* and 12*b* are located within frame space 13 between facing surfaces of assemblies 12*a* and 12*b* after assembly.

Figure 3:
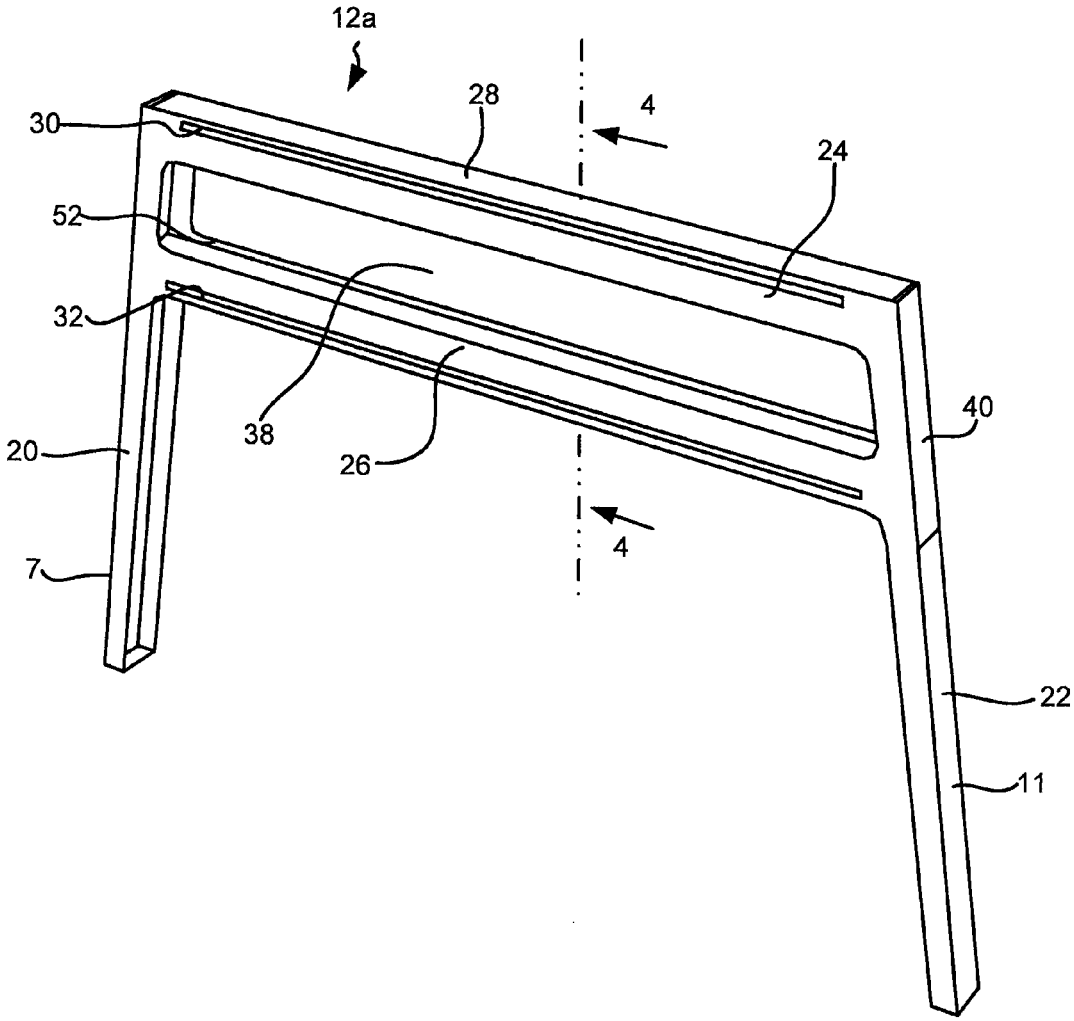
FIG. 3 is a perspective view of one of the leg assemblies shown in FIG. 1.
Figure 4:
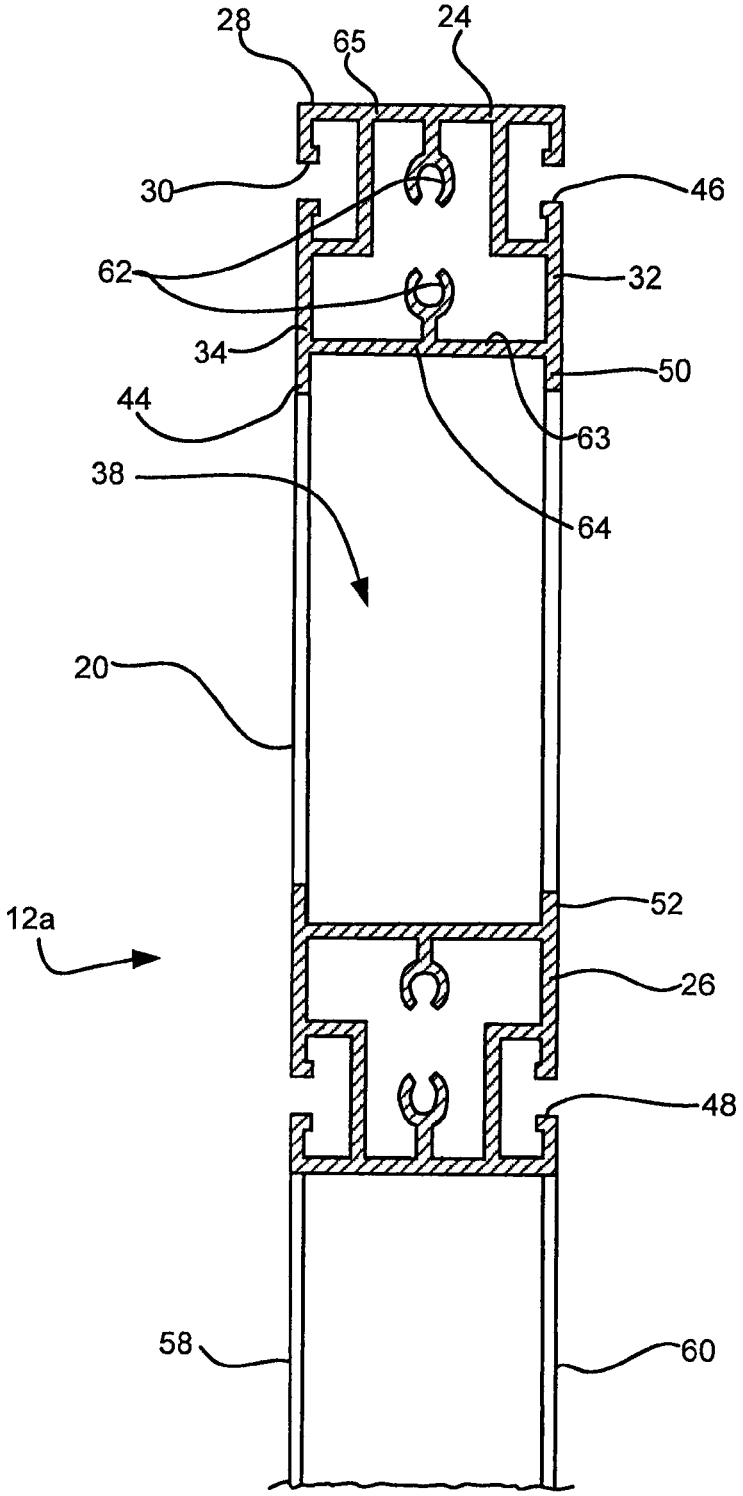
FIG. 4 is a cross-sectional view taken along the line 4-4 in FIG. 3.

Referring again to FIG. 1, each of leg assemblies 12 a and 12*b* is similarly constructed and operates in a similar fashion and therefore, in the interest of simplifying this explanation, only leg assembly 12*a* will be described here in detail. Referring also to FIGS. 3 and 4, exemplary leg assembly 12*a* includes four elongated members as well as two cover assemblies 40 (only one shown in FIG. 3). The elongated members include first and second generally vertical members 20 and 22, respectively, an upper horizontal rail member 24 and a lower horizontal rail member 26.

Each of the vertical members 20 and 22 is similarly constructed and operates in a similar fashion and therefore, only member 20 is described here in detail. Member 20 has a lower end and an upper end and, referring also to FIG. 5, forms an upper rail mounting plate 70 near the upper end and a lower rail mounting plate 72. The plates 70 and 72 have cross-sections that are similar in shape to the cross-sections of rail members 24 and 26, respectively, and include features that facilitate alignment and connection of the rails to the plates. To this end, plate 70 includes four alignment ribs 74 that extend from the face of the plate 70 and that are received within a slot 63 formed by rail 24 as shown in FIG. 4. Similarly, four ribs 74 are formed on the surface of plate 72 for alignment with a slot (not labeled) formed by rail 26 (see again FIG. 4). A pair of apertures are formed through each of the plates 70 and 72 that align with screw channels (see 62 in FIG. 4) formed by rails 24 and 26, respectively, when the rails 24 and 26 are mounted to the plates 70 and 72.

Figure 5:
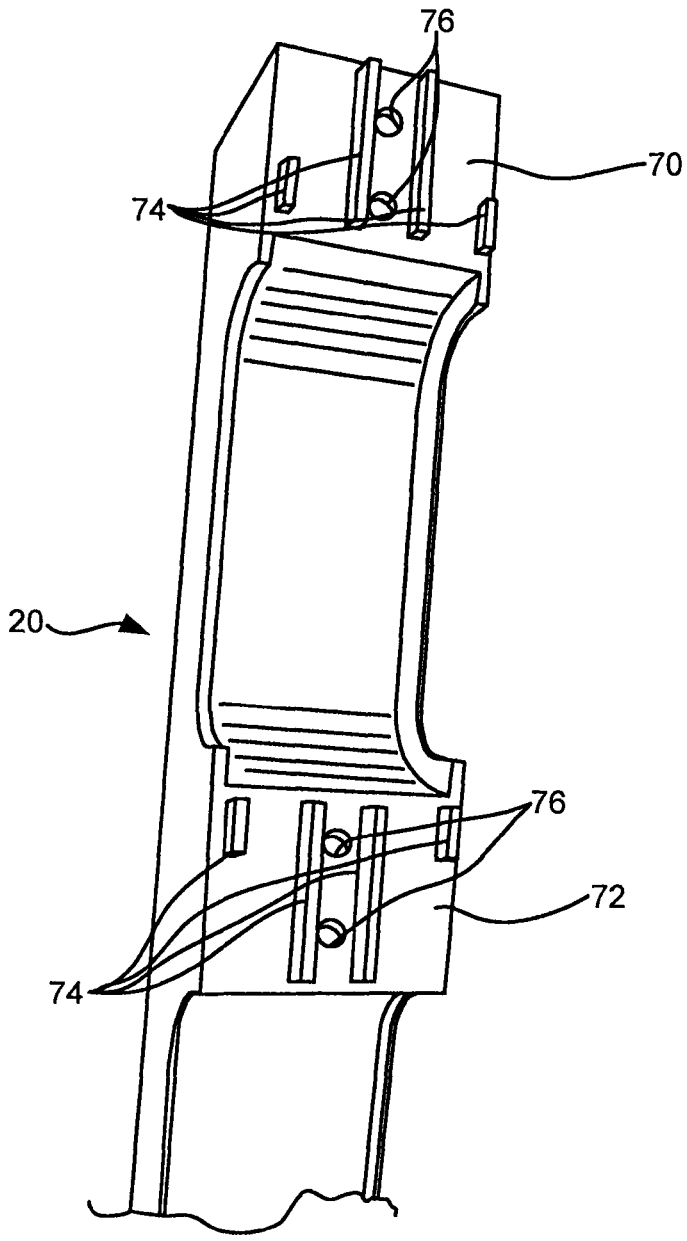
FIG. 5 is a partial perspective view of a top end of one of the vertical members that forms part of the leg assembly shown in FIG. 3.
Figure 6:
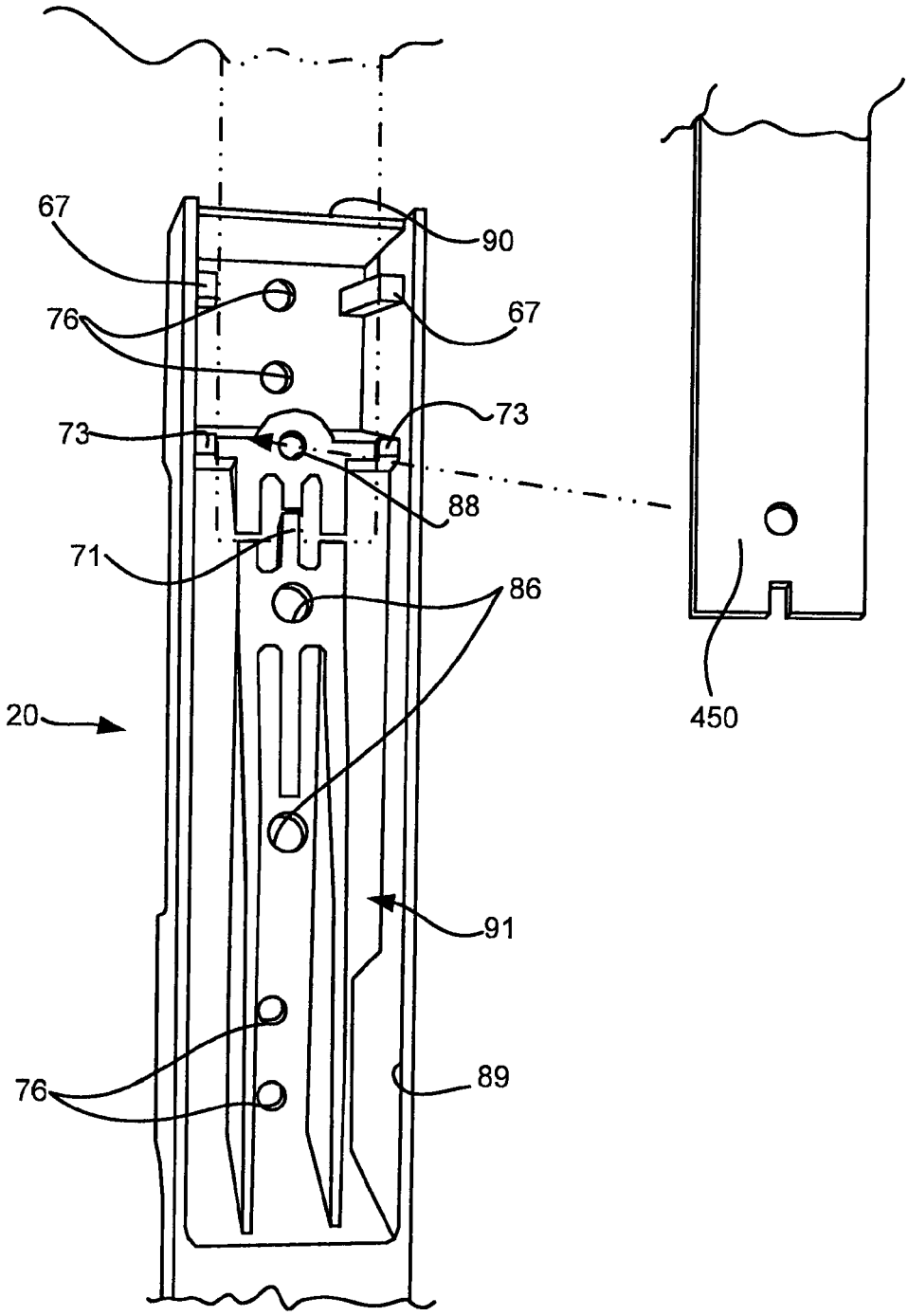
FIG. 6 is a view similar to FIG. 5, albeit showing an opposite side view of the top of the vertical member in FIG. 5.

Referring still to FIGS. 3 through 5 and also to FIG. 6, on a side of member 20 opposite plates 70 and 72, member 20 forms an opening 89 into a recessed space 91 where bolt heads associated with bolts that extend through openings 76 can be recessed. Opening 89 wraps around a top surface of member 20 to form an upper surface open slot 90 useful for attaching additional components (e.g., an arch) above leg assembly 12*a* (see FIGS. 49 and 50 described below). The structure within the recess also forms two additional openings 86 for securing one of the covers 40 (see again FIG. 3) via screws (see FIG. 7) to member 20 to close off the recessed space 91 and provide a finished look to member 20.

Figure 7:
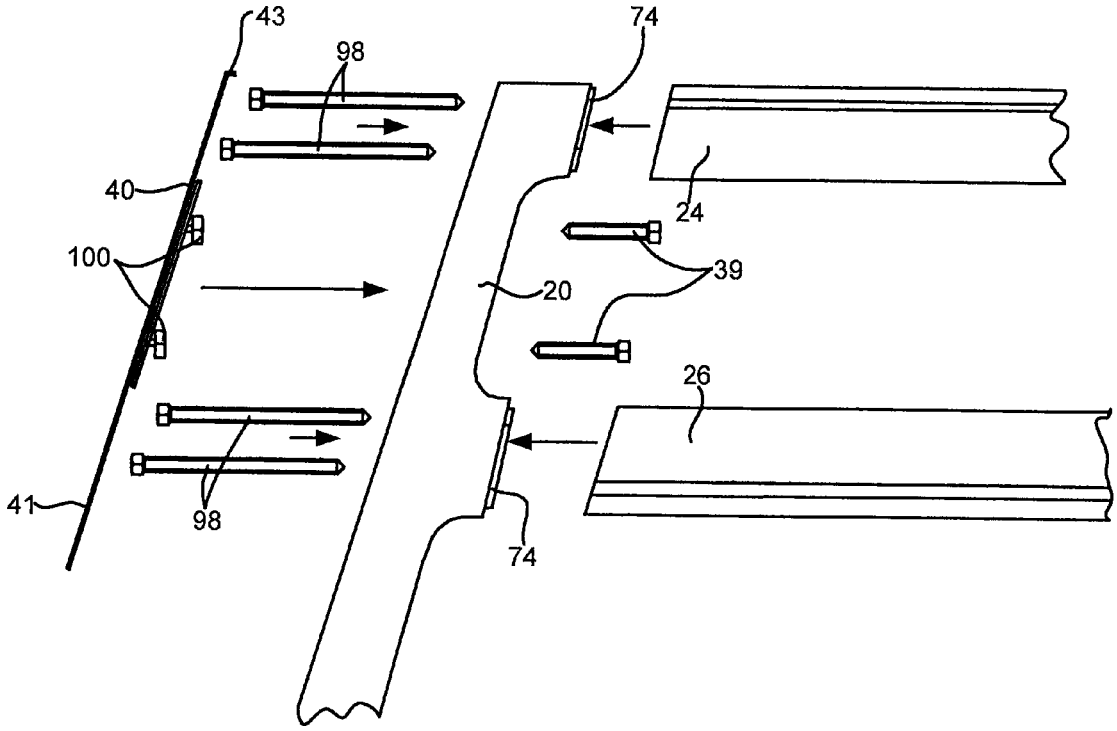
FIG. 7 is a partially exploded view showing various components that form part of the leg assembly shown in FIG. 3.

Referring to FIG. 7, cover assembly 40 includes a generally flat metal cover plate 41 with a lip 43 at a top end as well as two metal posts 100 that form threaded apertures at distal ends where the posts 100 extend from an internal surface of plate 41. Cover 40 is installed by aligning the post 100 apertures with openings 86 and using two screws 39 to secure cover 40 via holes 86. Once installed cover plate 41 is flush with an external surface of vertical member 20.

Referring to FIG. 4, rails 24 and 26 are shown in cross-section. Each of rails 24 and 26 comprises an extruded aluminum member and, as shown in FIG. 4, the rails 24 and 26 have identical cross-sections. When leg assembly 12*a* is assembled, if rail 24 is considered to be upright, rail 26 is inverted with respect to rail 24. Because the rails 24 and 26 have similar cross-sections, only rail 24 will be described here in detail in order to simplify this explanation.

Referring still to FIG. 4, rail 24 is generally square in cross-section and includes a top wall member 65, a bottom wall member 64, and first and second lateral or side wall members 34 and 32, respectively. Rail 24 has a number of interesting characteristics. First, a top surface 28 of top wall member 65 is substantially flat. Second, rail 24 forms T-slots 30 and 46 in opposite side wall members 34 and 32, respectively. Third, rail 24 forms an inverted internal "T" shaped slot 63 that cooperates with ribs 74 (see again FIG. 5) that extend from plate 70 for aligning rail 24 with plate 70 during assembly. Fourth, rail 24 forms two screw channels 62 within internal slot 63 that align with the screw holes 76 formed by member 20 when ribs 74 are received in slot 63. Fifth, side wall members 34 and 32 extend downward past an external surface of lower wall member 64 and thereby form rail lip members or coupling members or fingers 44 and 50, respectively. In FIG. 4, one of the side wall slots 48 and one of the rail lips 52 formed by lower rail member 26 are labeled so those features can be distinguished hereafter.

Referring now to FIGS. 3 and 7, to assemble the rail members 24 and 26 and leg members 20 and 22 to form the leg assembly 12*a*, rails 24 and 26 are aligned with plates 70 and 72 and are moved toward the plates until ribs 74 are received within slots 63 (see also FIGS. 4 and 5) formed by rail members 24 and 26. When ribs 74 are aligned with slots 63, the holes 76 formed by members 20 and 22 are aligned with screw channels 62 formed by rail members 24 and 26. Bolts 98 are slid through holes 76 and are threadably received within channels 62 to secure rail members 24 and 26 to vertical members 20 and 22. Referring again to FIG. 6, upon installation of bolts 98, the bolt heads are received within recesses space 91 adjacent holes 76 and therefore are located within the top ends of members 20 and 22.

Next, covers 40 are aligned with openings 89 at the top ends of members 20 and 22 and are attached by pressing sphere members 100 into openings 86 so that sphere members 100 are frictionally received therein. Referring again to FIGS. 2 through 4, leg assembly 12*a* forms a top surface 28, a front surface 11, a rear surface 7, leg opening 38 and first and second side surfaces 58 and 60 after assembly.

Once rails 24 and 26 are secured to the vertical members 20 and 22, the lips 50 and 52 formed by the bottom walls of the rail members extend toward each other. For example, as shown in FIG. 4, lip member 50 formed by rail 24 is aligned with and extends toward lip member 52 formed by rail member 26. A frame or leg opening 38 is formed between rails 24 and 26.

Referring now to FIGS. 8 through 11, channel assembly 18 includes an elongated rigid housing member 110, a plurality of receptacles 112 and 113 and first and second clamping coupler assemblies or expansion jaw assemblies 114 and 116. Housing member 110 is generally formed of bent sheet metal and extends between first and second opposite ends 121 and 123, respectively. The housing member 110 forms an upper channel or cavity 126 and a lower channel or cavity 132. To form the channels, housing member 110 includes first and second side walls 118 and 120 on front and rear sides, respectively, a bottom wall 122 and an intermediate dividing or floor member 127. A top end of the housing 110 is open at 125 along a channel length dimension. The side walls 118 and 120 are generally vertical and angle away from each other generally from top to bottom to a small degree (e.g., a 10° angle with respect to vertical).

Each of the side wall members 118 and 120 forms openings (see 150 in FIG. 8) for passing power or data wires into and out of the upper channel 126. In addition, each of the wall members 118 and 120 forms other openings for receiving power outlet receptacles 112 that can be arranged to face the exterior of assembly 18 so that the outlets are accessible from outside assembly 18. In the illustrated embodiment shown in FIG. 8, each of the wall members 118 and 120 forms a single access opening 150 as well as a single central power receptacle opening for mounting a receptacle 112 while the openings 150 and receptacle openings may be preformed, in some embodiments knockout panels may be formed within the openings where the panels initially close the openings and can be removed by a user if desired by applying force to the panels. An exemplary knockout panel 800 is shown in phantom in FIG. 8.

Figure 10:
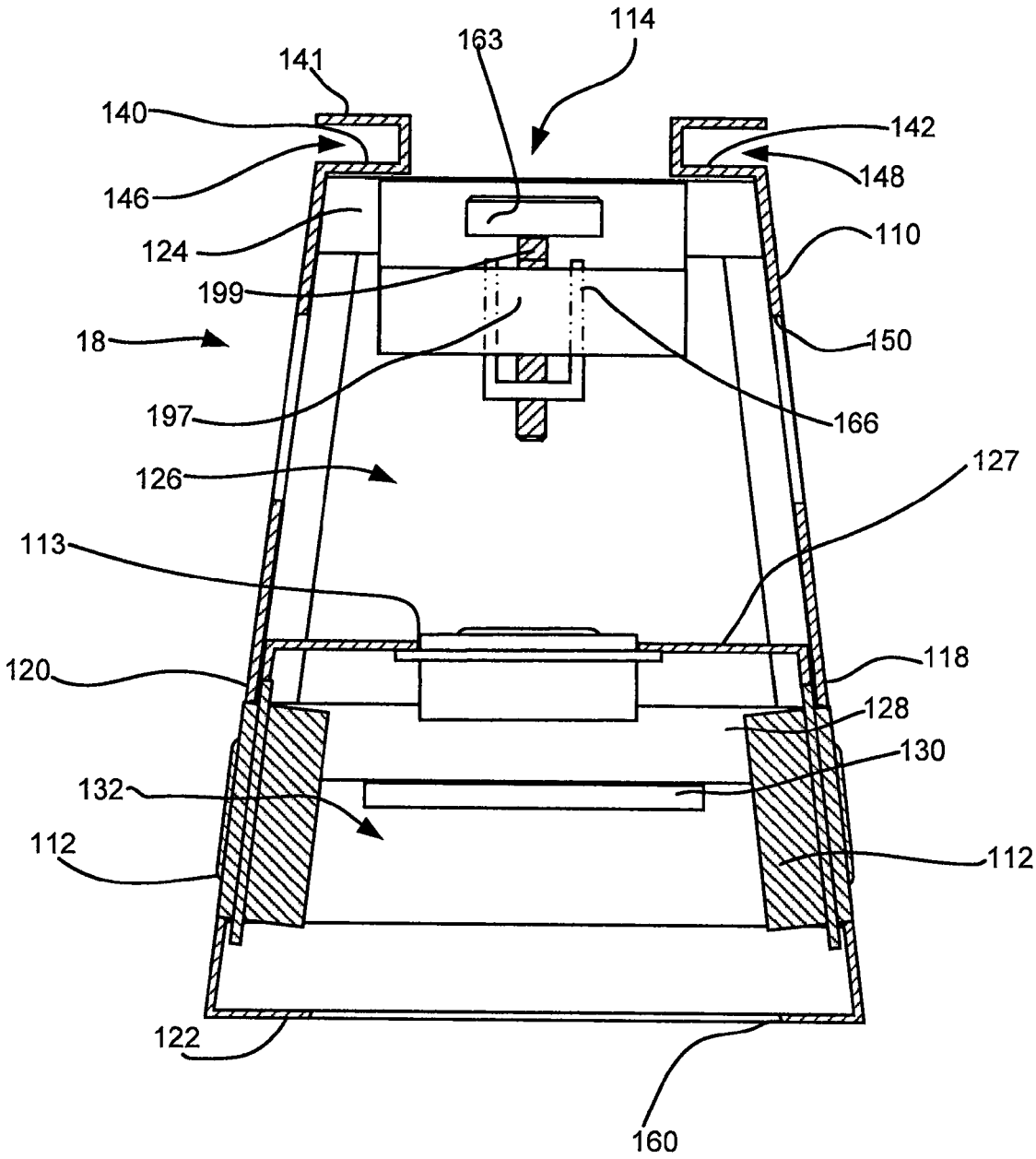
FIG. 10 is a cross-sectional view taken along the line 10-10 in FIG. 9.

Referring now to FIG. 10, at a top end wall member 118 is bent toward wall member 120, then upward and again outward thereby forming an elongated channel 148 and a channel support surface 142 along a length dimension of the housing 110 that extends between the first and second ends 121 and 123, respectively. Similarly, along a top edge, wall member 120 also forms an channel 146 and a support surface 140 along its length dimension where channel 146 opens in a direction opposite the direction in which channel 148 opens channel housing 110 forms a top surface 141 (see FIG. 10).

Referring still to FIGS. 8 through 11, bottom wall member 122 generally closes off the space between lower edges of side wall members 118 and 120 and extends between the first and second ends 121 and 123, respectively. Bottom wall member 122 forms relatively large openings 160 (see FIG. 10) along its length for allowing power or data cables to be strung into an out of the lower channel 132 and to allow access to components mounted within housing 110 for installation, adjustment, etc.

Figure 9:
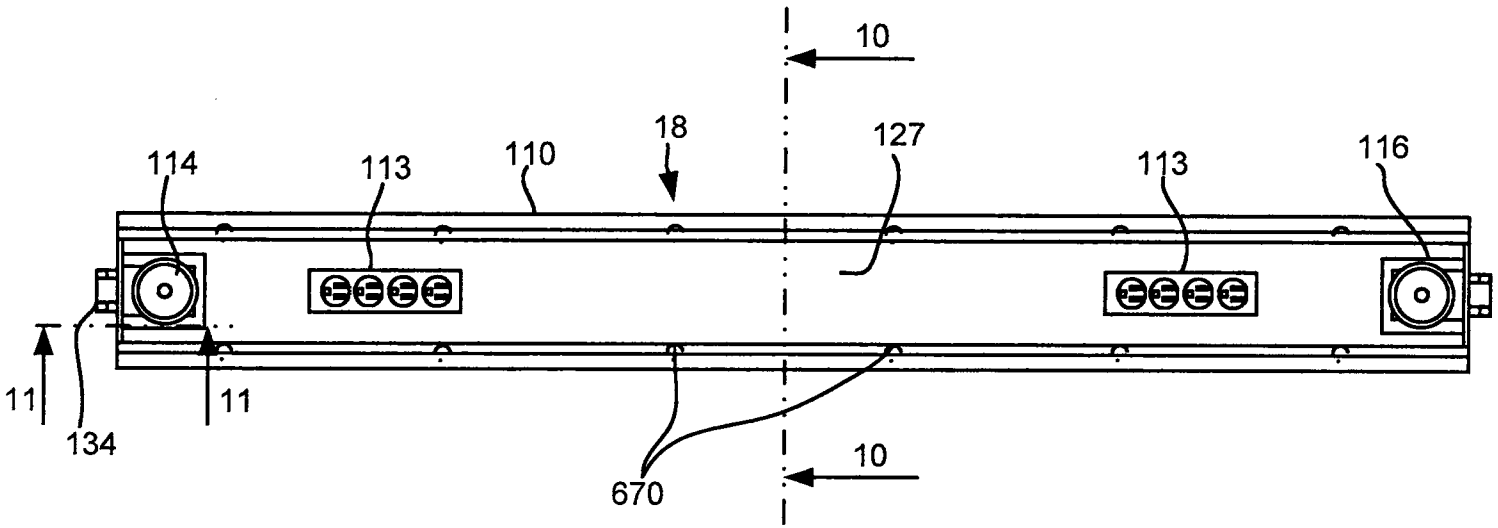
FIG. 9 is a top plan view of the channel assembly shown in FIG. 8.

Referring specifically to FIGS. 9 and 10, intermediate wall member 127 is mounted between internal surfaces of side wall members 118 and 120 and divides the space between wall member 118 and 120 essentially into the upper and lower channels 126 and 132. Intermediate member 127 forms openings in which additional power or data outlet receptacles 113 are mounted (see FIGS. 9 and 10). Lower channel 132 is used for running power/data wires. Upper channel 126 is used for plugging in cords from lights, computers, etc., and for storing excess power/data connecting cables.

Figure 8:
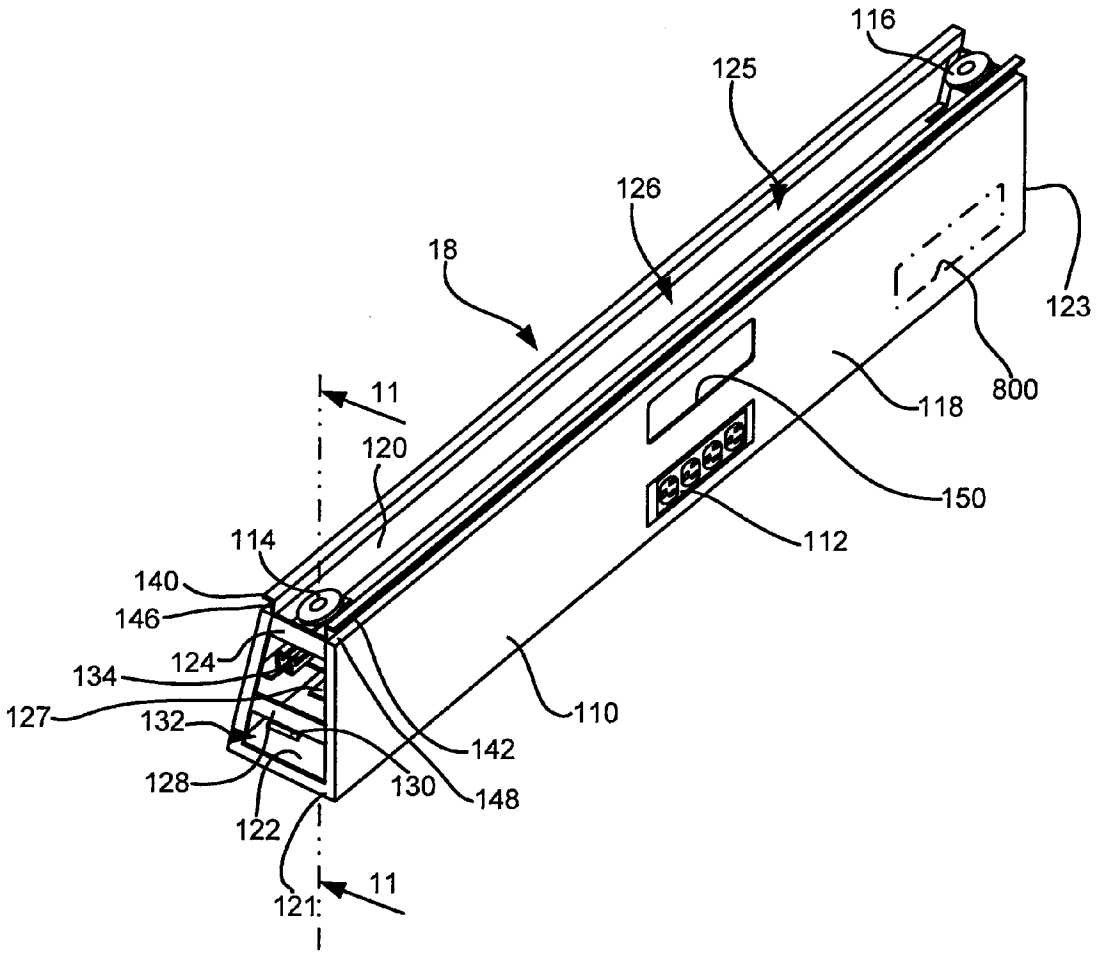
FIG. 8 is a perspective view of the channel assembly shown in FIG. 2.
Figure 11:
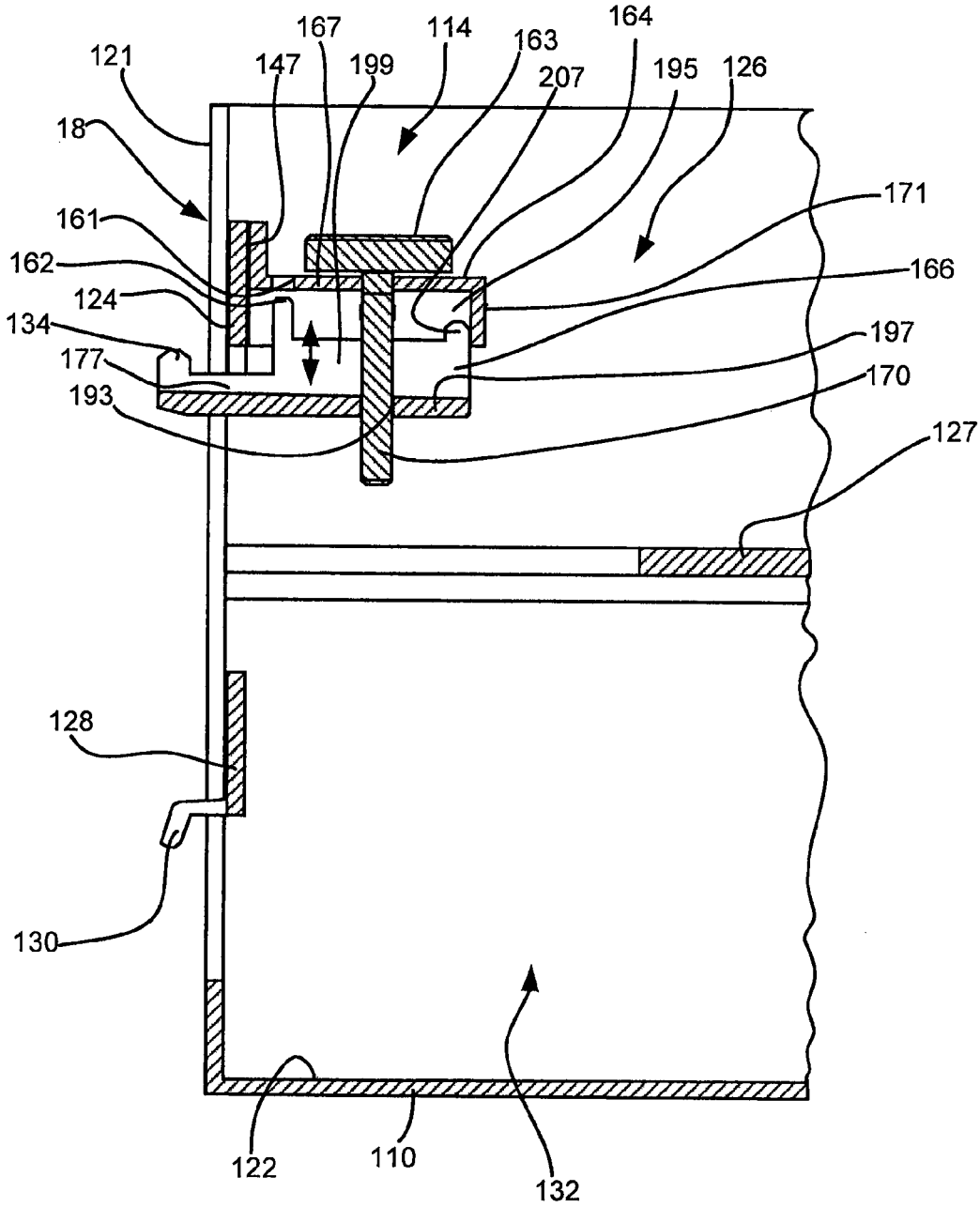
FIG. 11 is a partial cross-sectional view taken along the line 11-11 in FIG. 8.

Referring to FIGS. 8, 10 and 11, at each of the distal ends 121 and 123, assembly 18 includes a rigid metal top cross member 124 and a rigid metal intermediate cross member 128. The top cross member 124 is welded or otherwise attached between top ends of side wall members 118 and 120 and includes an internal surface 147 (see FIG. 11) to which one of the coupling assemblies 114 or 116 is welded or otherwise attached. Intermediate cross member 128 is also a rigid metal member that is welded or otherwise secured between wall members 118 and 120 and includes a lip member or stationary finger or coupler 130 along a lower edge that extends outward and downward from a distal end.

Referring once again to FIGS. 8, 10 and 11, coupling assemblies 114 and 116 are similarly constructed and operate in a similar fashion and therefore, in the interest of simplifying this explanation, only coupling assembly 114 is described in detail. Coupling assembly 114 includes a support bracket 164, a clamping bolt 163 and a coupler block or moveable jaw member 166. Bracket 164 includes an integrally formed flat support plate 167 and a plurality of wall members that extend downward from edges of the support plate 167. One of the downward extending wall members is a guide wall 166 that extends along an edge opposite the edge of plate 167 that is secured to surface 147 (see FIG. 11). Plate 167 forms an opening for passing a threaded shaft 170 of bolt 163 and also forms guide slots 162 (only one shown in FIG. 11) near the edge of plate 167 that mounts to surface 147.

Jaw member 166 is generally U-shaped in cross-section (see FIG. 10) including a flat bottom wall member 197 and first and second parallel wall members 199 that extend along opposite edges of bottom wall member 197. Bottom wall member 197 forms a threaded opening 193 for receiving shaft 170. As best seen in FIG. 11, top edges of side wall members 199 undulate to form a lip or moveable finger member 134 at one end, an intermediate guide finger extension 162 and an end finger extension 207 at a second end opposite lip 134 where lip 134 and extensions 162 and 207 all extend away from bottom wall member 197 in the same direction. The dimensions of, and spacing between, members 134, 162 and 207 are such that when an edge of member 207 contacts an internal surface of wall member 171 (see FIG. 11) with shaft 170 passing through plate 167 and threadably received in opening 193. Finger extensions 162 are aligned with openings 161 in plate 167 and lips 134 extend past an adjacent edge of plate 167.

To install assembly 114, bracket 164 is welded or otherwise secured to cross member 124. Jaw member 166 is placed with intermediate finger members 162 aligned with openings 161 and with finger members 207 adjacent the internal surface of wall member 166 and with the opening in plate 162 aligned with threaded opening 193. Shaft 170 is fed through plate 167 and into opening 193. At this point jaw member 134 extends out an end opening formed by housing 110 as shown in FIG. 11.

Referring again to FIG. 11, as bolt 163 is rotated, jaw member 166 and finger member 134 move up and down. Jaw member 166 is restricted from rotating by intermediate finger members 162 and openings 161 as well as by finger members 207 that ride along the internal surface of wall member 171. Lip 130 and lip 134 form a coupler pair and a similar coupler pair is located at the second end 123 of assembly 18. As illustrated, the bolt 163 and bracket 164 are entirely located inside channel 126.

Figure 12:
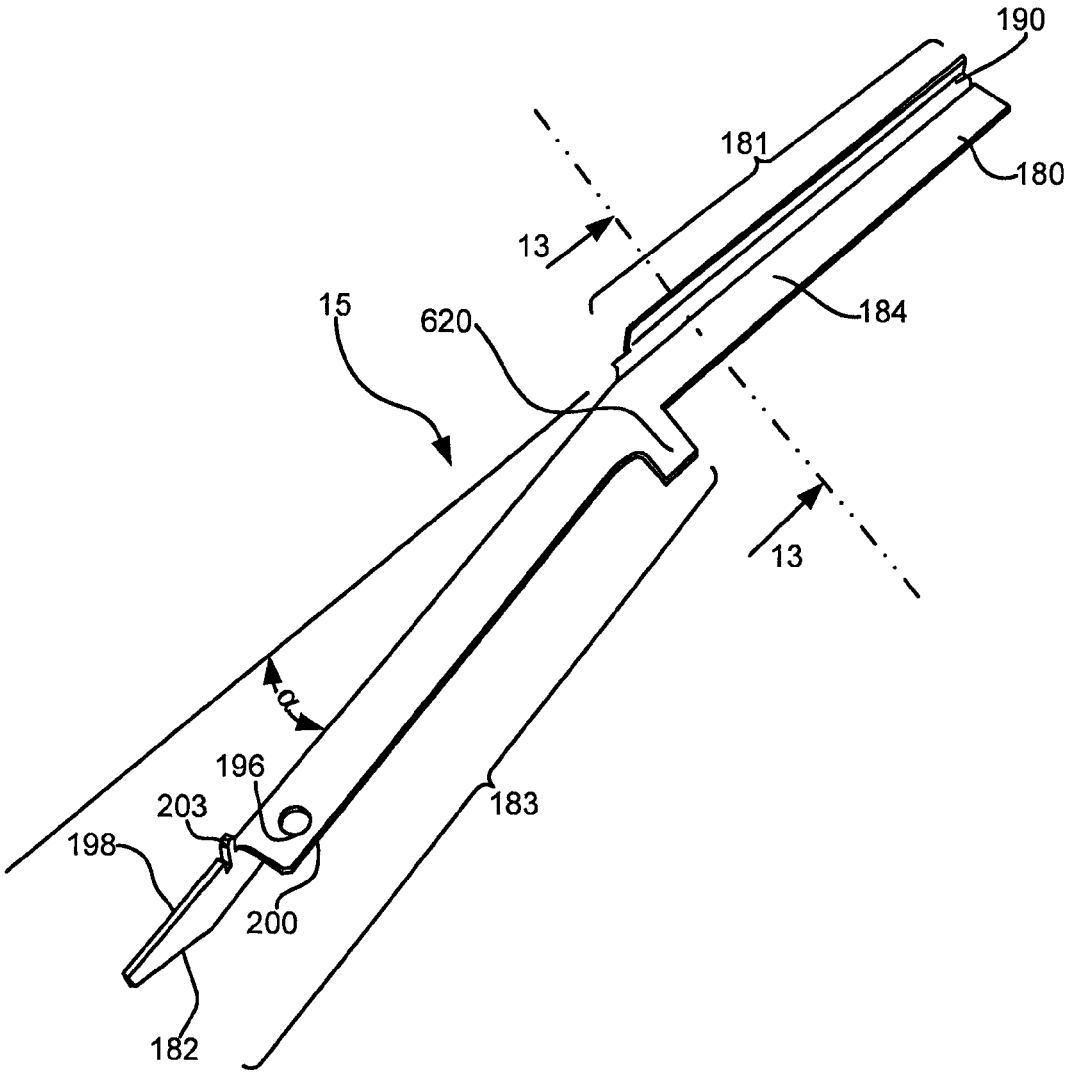
FIG. 12 is a perspective view of one of the support arm members shown in FIG. 2.
Figure 13:
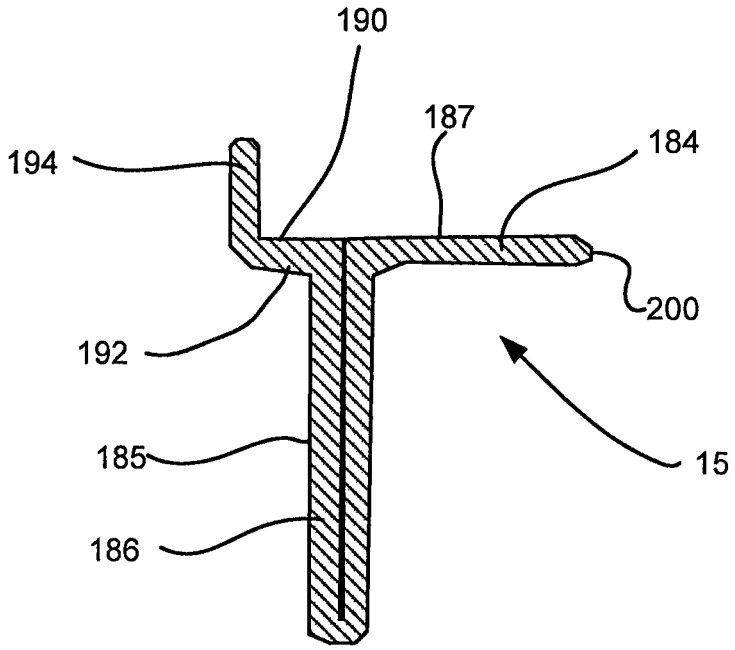
FIG. 13 is a cross-sectional view taken along the line 13-13 in FIG. 12.

Referring again to FIG. 2, each of the arm support or bracket support members 15 is similarly constructed and operates in a similar fashion and again, in the interest of simplifying this explanation, only one of the support members 15 will be described here in detail. Referring also to FIGS. 12 and 13, exemplary support member 15 is a rigid elongated metal member having a proximal or connecting end 180 and a distal end 182 where proximal and distal portions 181 and 183 are located at the proximal and distal ends 180 and 182, respectively. The proximal portion 181 has a generally uniform cross section along its length as shown in FIG. 13 that includes a vertical member 186 and a horizontal shelf member 184 that extends at a right angle from a top edge of vertical member 186. Shelf member 184 has a distal edge 200 along its length. Vertical member 186 forms a bearing surface 185 on a side opposite the side from which shelf member 184 extends.

Figure 26:
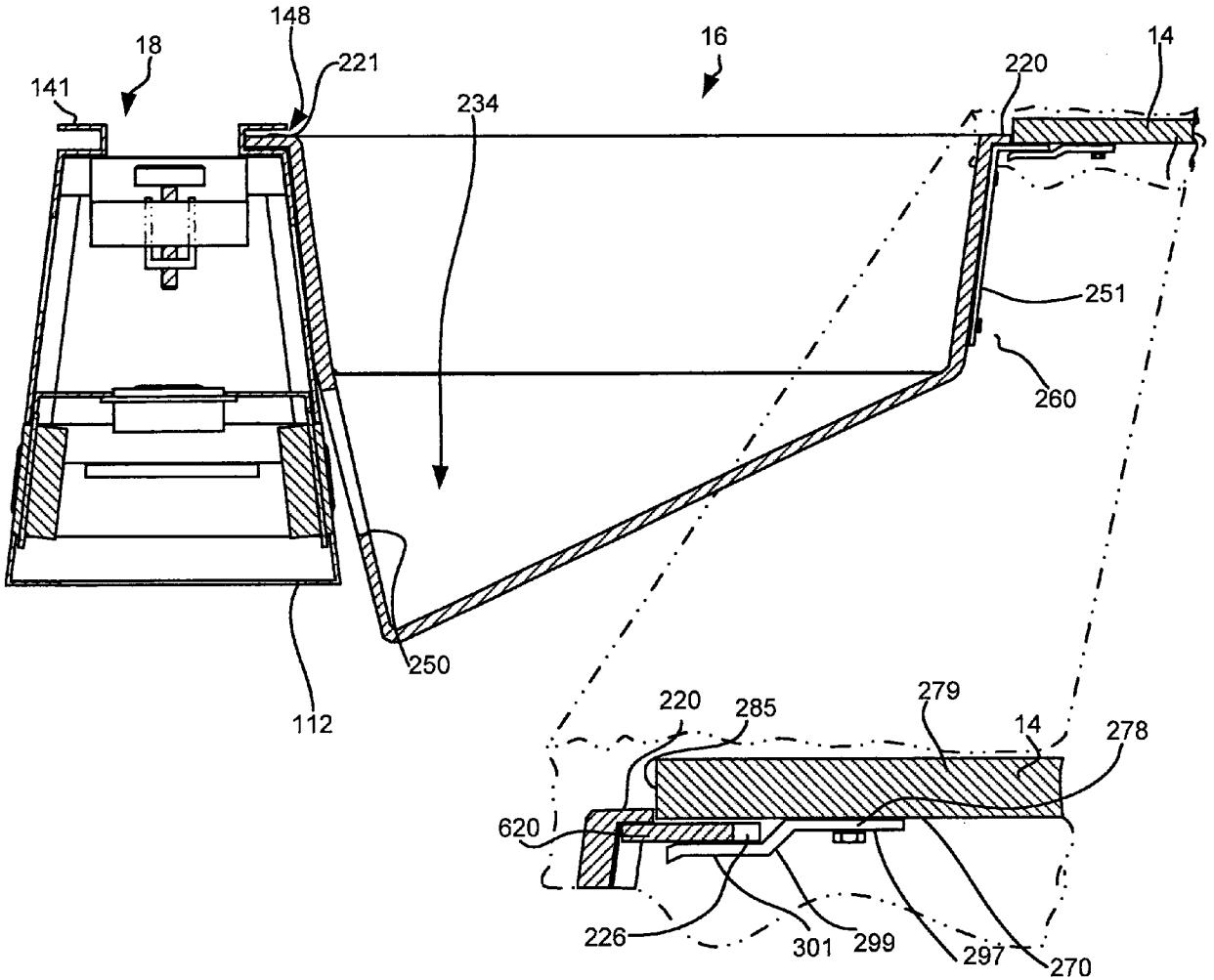
FIG. 26 is a partial cross-sectional view similar to the view of FIG. 10, albeit where a trough member 16 is mounted to a channel assembly and a table top assembly 14 is mounted to the trough member.

Shelf member 184 forms a substantially horizontal upper support surface 187. In addition to vertical member 186 and shelf member 184, proximal portion 181 also includes a lip member 190 that extends from the top end of vertical member 186 along a direction which is generally opposite the direction in which shelf member 184 extends. Lip member 190 includes an arm member 192 and a distal lip or finger member 194 that extends vertically upward from a distal end of member 192. Referring also to FIG. 26, lip member 190 is shaped and dimensioned so as to be receivable within one of the slots (e.g., 46 in FIG. 26) formed by rail member 24 such that vertical member 186 extends vertically downward therefrom and bearing surface 185 rests against the outer surface of the wall member 32 that forms the slot 46 when lip member 90 is received in the slot.

Referring to FIG. 12, the distal portion 183 has a cross section along most of its length that is similar to the cross section in FIG. 13, albeit not including lip member 190. Distal portion 183 extends at an angle $\alpha$ with respect to proximal portion 181. In at least some embodiments angle $\alpha$ is between zero and 60 degrees and in some cases angle $\alpha$ is between ten and twenty-five degrees.

At the distal end 182 member 15 only includes the vertical member 186 and does not include shelf member 184. Shelf member 184 forms an opening 196 near distal end 182 and forms a key member 203 that extends perpendicular to member 184. The distal end of member 186 is referred to hereafter as a finger member 198. Referring again to FIG. 12, a shoulder member 620 extends from an edge of and co-planar with shelf member 184 in a direction opposite lip member 190.

Referring now to FIGS. 14 through 19, exemplary trough member 16 is an elongated rigid body member that extends between first and second opposite ends 216 and 218, respectively. In at least some cases, trough member 16 is formed of rigid plastic via a vacuum forming process that is particularly suited for forming a feature rich trough member that includes a bottom wall member 225 including undulations that can define different trough depths and other interesting features useful for dividing a trough space 228 into several different trough sub-compartments particularly suitable for specific purposes. In other embodiments the trough member may be formed of bent metal.

Figure 15:
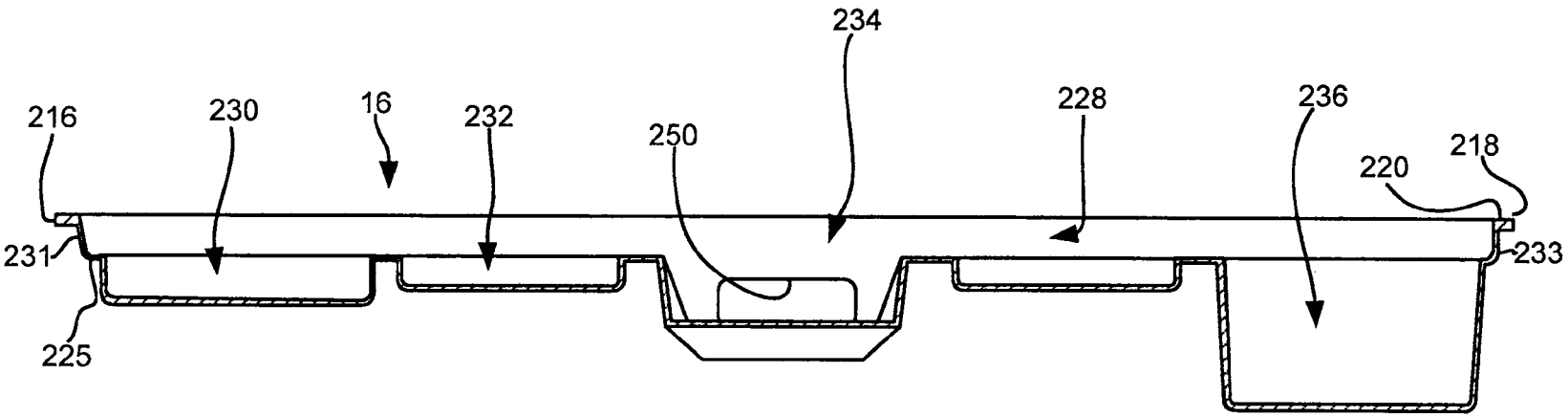
FIG. 15 is a cross-sectional view taken along the line 15-15 in FIG. 14.
Figure 16:
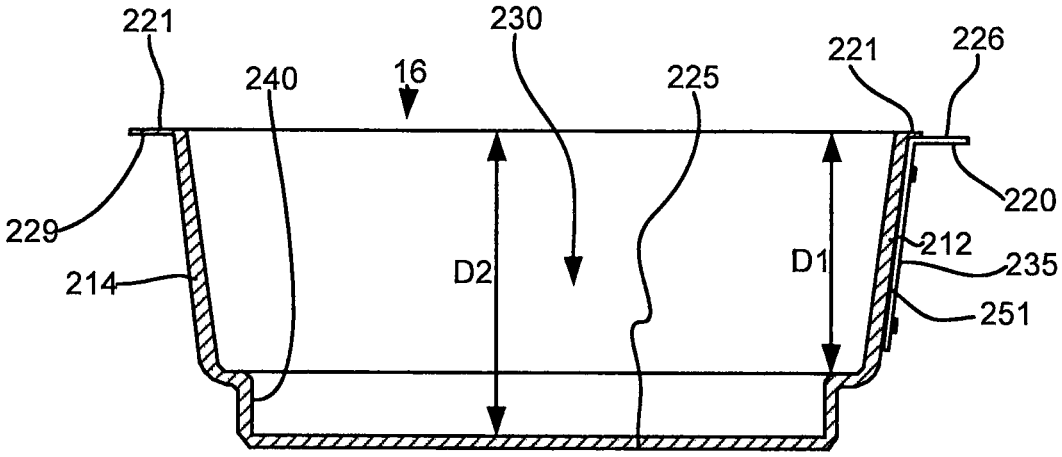
FIG. 16 is a cross-sectional view taken along the line 16-16 in FIG. 14.
Figure 17:
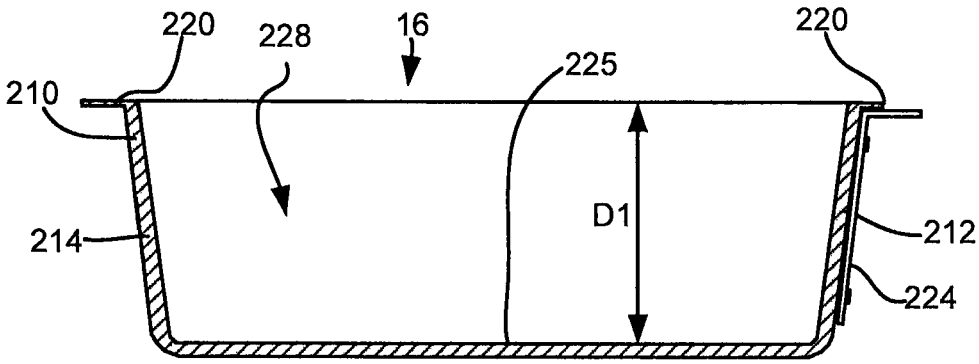
FIG. 17 is a cross-sectional view taken along the line 17-17 in FIG. 14.

Referring specifically to FIGS. 15 and 16, generally, trough member 16 includes a front wall member 212, a rear wall member 214, a first side wall member 231, a second side wall member 233 and a floor or bottom wall member 225. The front and rear wall members 212 and 214 and side wall members 231 and 233 are spaced apart to generally define a rectilinear trough space 228 and bottom wall member 225 generally closes off the bottom end of space 228 while the top end is left open to facilitate access into the trough space. At upper ends of the front and rear wall members 212 and 214 and the side wall members 231 and 233, an outwardly extending lip member 220 is formed. Lip member 220 forms an upper surface 221 as well as a lower surface 229. A trough width dimension generally between the front and rear wall members 212 and 214 is generally between three and twenty-two inches and, in some embodiments is around 18 inches.

Figure 14:
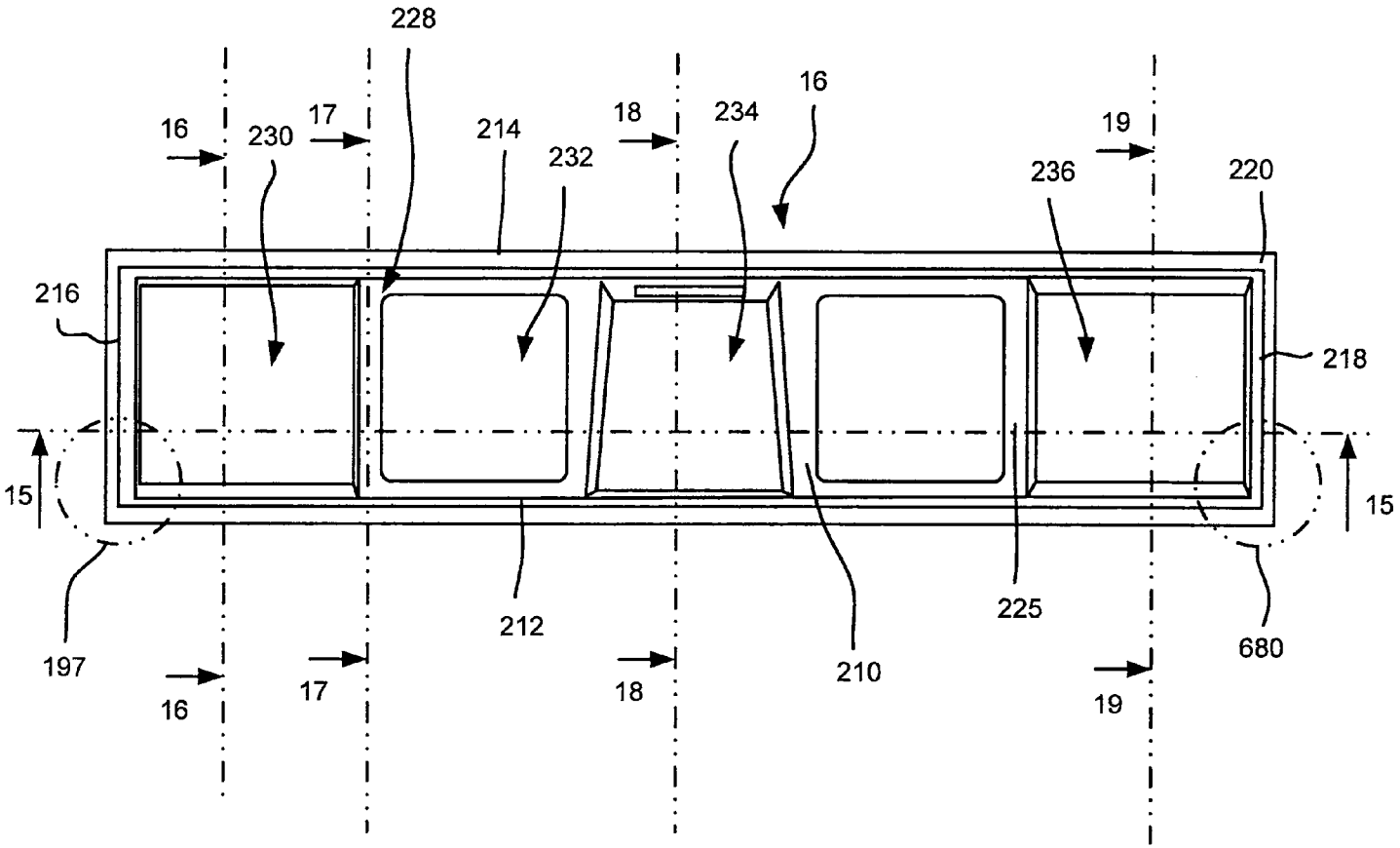
FIG. 14 is a top plan view of the trough member that forms part of the assembly shown in FIG. 1.
Figure 18:
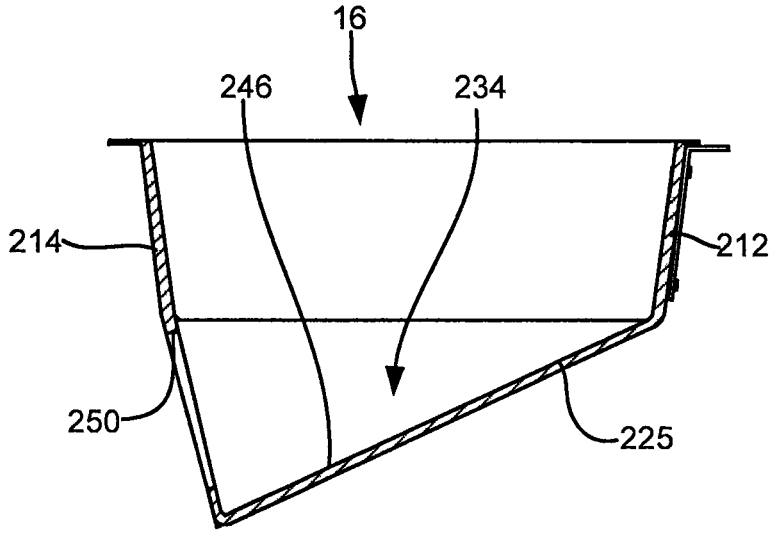
FIG. 18 is a cross-sectional view taken along the line 18-18 in FIG. 14.
Figure 19:
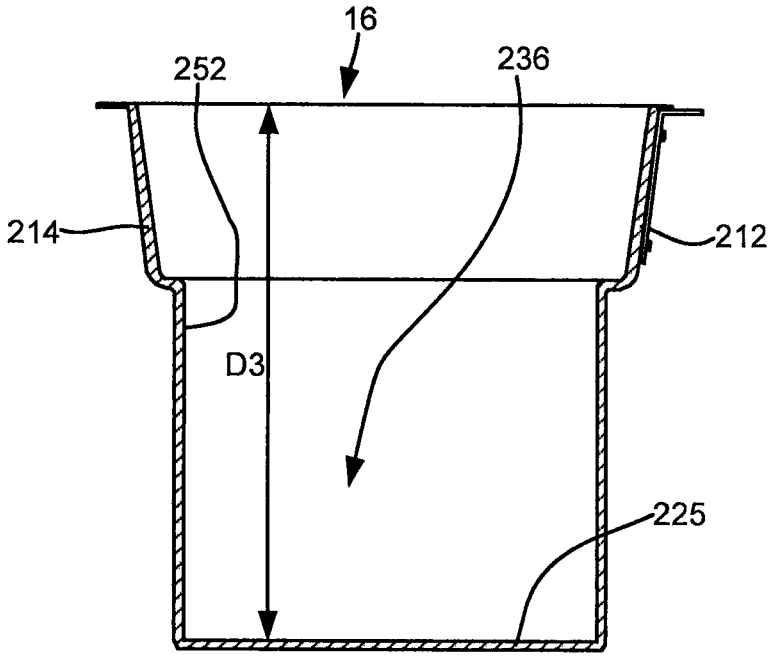
FIG. 19 is a cross-sectional view taken along the line 19-19 in FIG. 14.
Figure 20:
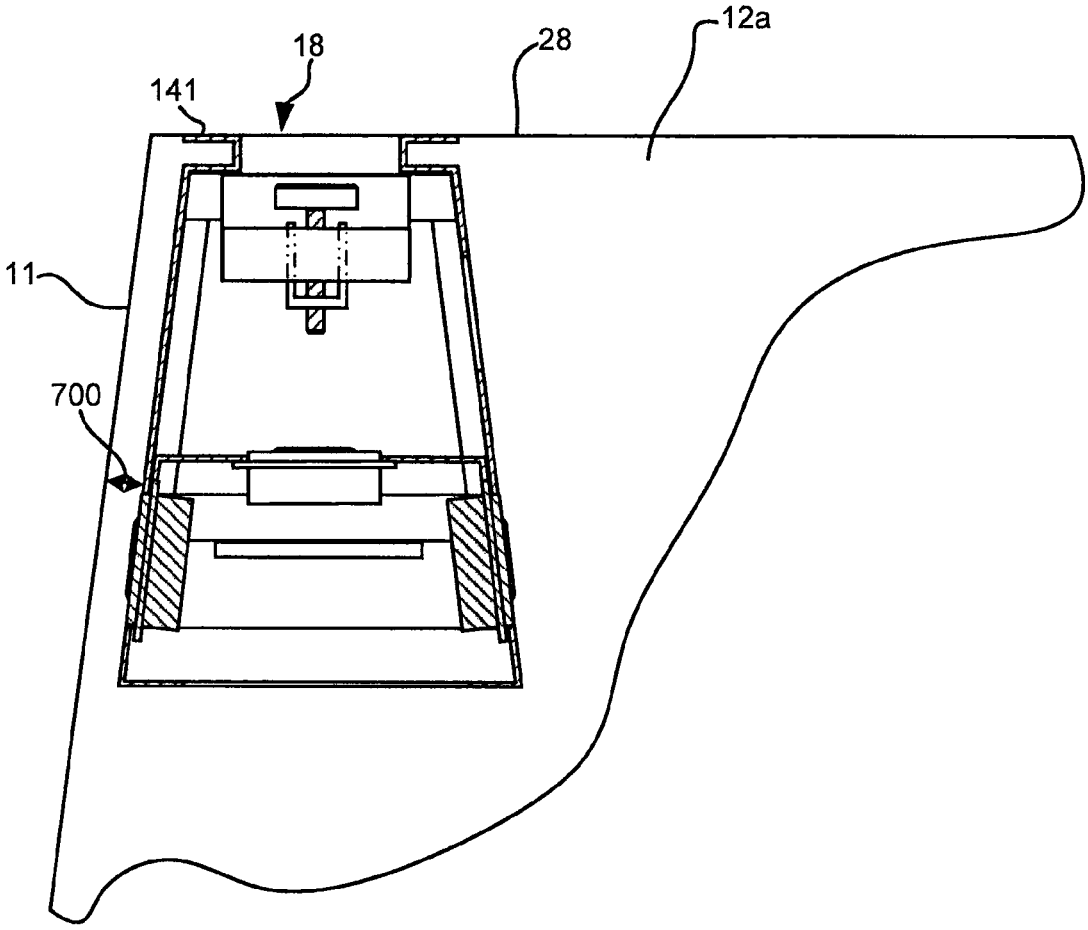
FIG. 20 is a partial cross-sectional view taken along the line 20-20 in FIG. 1.

Referring still to FIGS. 14 through 19, bottom wall member 225 has different depth portions (e.g., from three to twenty inches) along the length dimension of trough member 16. For example, referring to FIG. 17, a general depth portion of trough space 228 is illustrated where the depth is labeled D1. Referring to FIGS. 14, 15 and 16, a left most portion 230 of the trough space forms a further recessed portion 240 having a depth D2 which is greater than depth D1. Here, for instance, depth D2 may be one inch deeper than depth D1 and provide a space for storing pencils, pens, a stapler, a scissors, etc. Referring to FIGS. 14, 15 and 19, at a right most portion of the trough space as illustrated in FIGS. 14 and 15, the lower wall 225 extends to a depth D3 to form a file bin 252 portion suitable for receiving standard size office files or the like.

Figure 25:
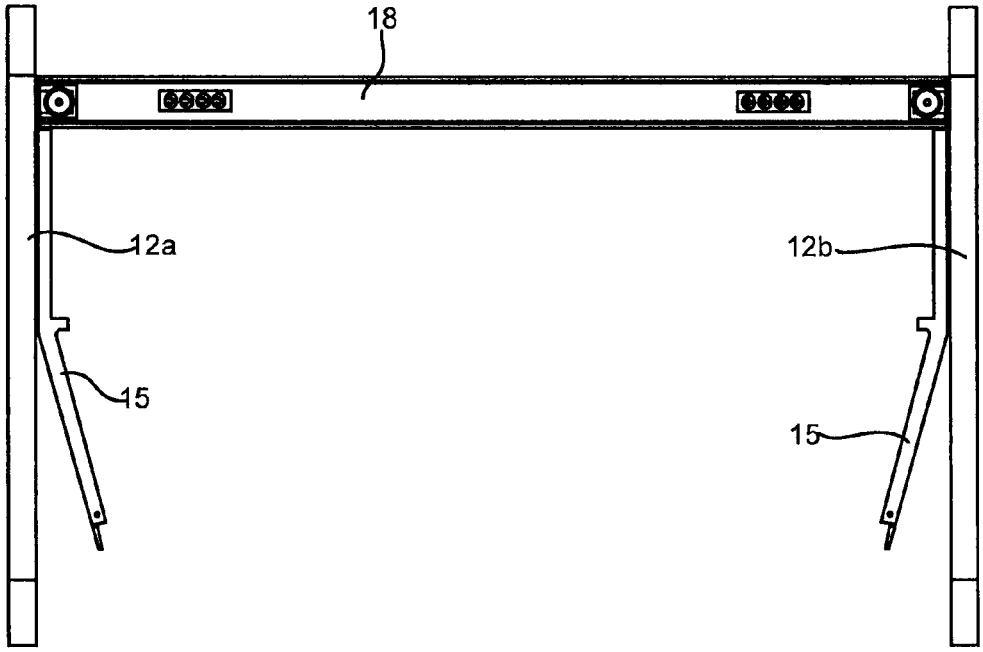
FIG. 25 is a top plan view of a subset of the components that comprise the assembly of FIG. 1 in a partially assembled condition.

Referring still to FIGS. 14 and 15 and also to FIG. 18, centrally, trough bottom wall 225 forms an internal surface 246 that slants from the bottom edge of front wall member 212 downward to a location below the bottom edge of wall member 214 to form a wire access space 234. Here, bottom wall 225 also forms an opening 250 below rear wall member 214. Referring also to FIG. 25, opening 250 is formed at a location that aligns with one of the outlet receptacles 212 mounted in the channel housing member 110 when the overall assembly shown in FIG. 1 is configured.

Because trough member 16 is formed of a plastic material, while rigid, member 16 is also relatively flimsy and therefore, while sufficient for supporting most office supplies, member 16 alone cannot withstand greater loads without potentially bending or flexing along its length dimension. After assembly, as shown in FIG. 25, the rear edge of trough member 16 is received within channel 148 formed by channel housing member 110 and therefore the rear edge of trough member 16 is additionally supported. To help support the front edge portion of trough member 16, a metal stringer member 251 is secured to the outer surface of front wall member 212 just below lip member 220 via screws, rivets, an adhesive, or some other type of mechanical fastener. Stringer member 251 extends the length of trough member 16 between ends 216 and 218 (see again FIG. 14) to provide support along the entire length dimension of trough member 16. As seen in FIG. 16, stringer member 251 is generally L-shaped including a first member 235 and a second or extending member 226 that extends along a length of dimension of member 235 and forms a slightly obtuse angle with member 235. Stringer member 251 is mounted with first member 235 mounted to the external surface of member 212 and member 226 disposed under and extending past a distal edge of lip member 220. The distal portion of extending member 226 forms a top trough support surface (i.e., a support surface associated with the trough member 16 that supports a table top as described hereafter).

Figure 21:
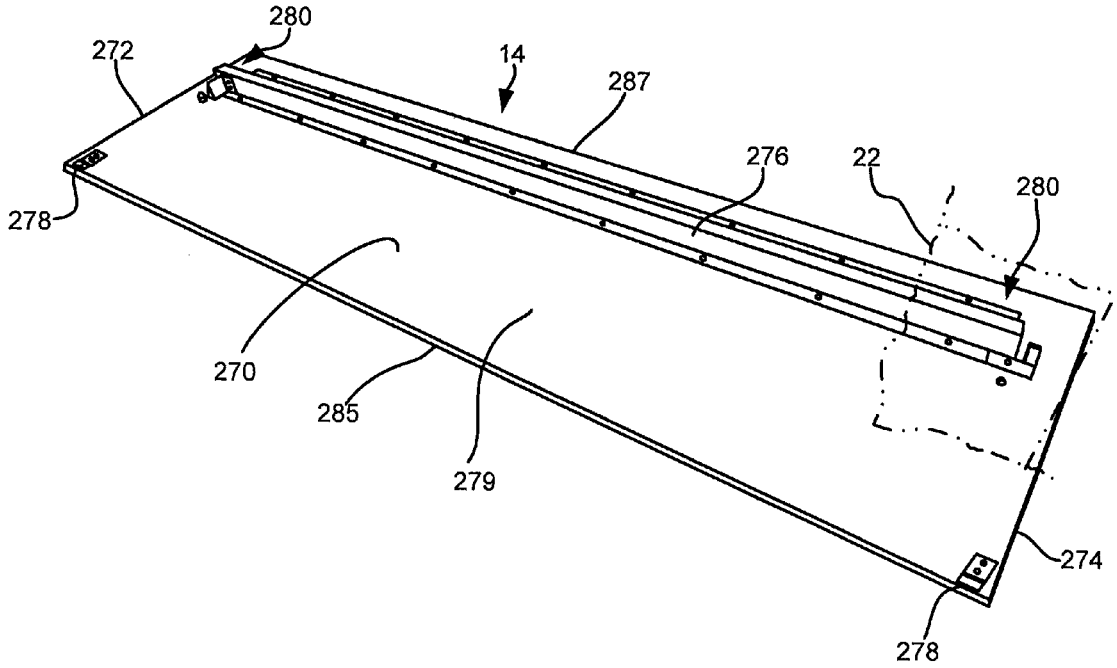
FIG. 21 is a perspective view of the table top assembly shown in FIG. 1, albeit upside down showing an undersurface and structure thereon.
Figure 22:
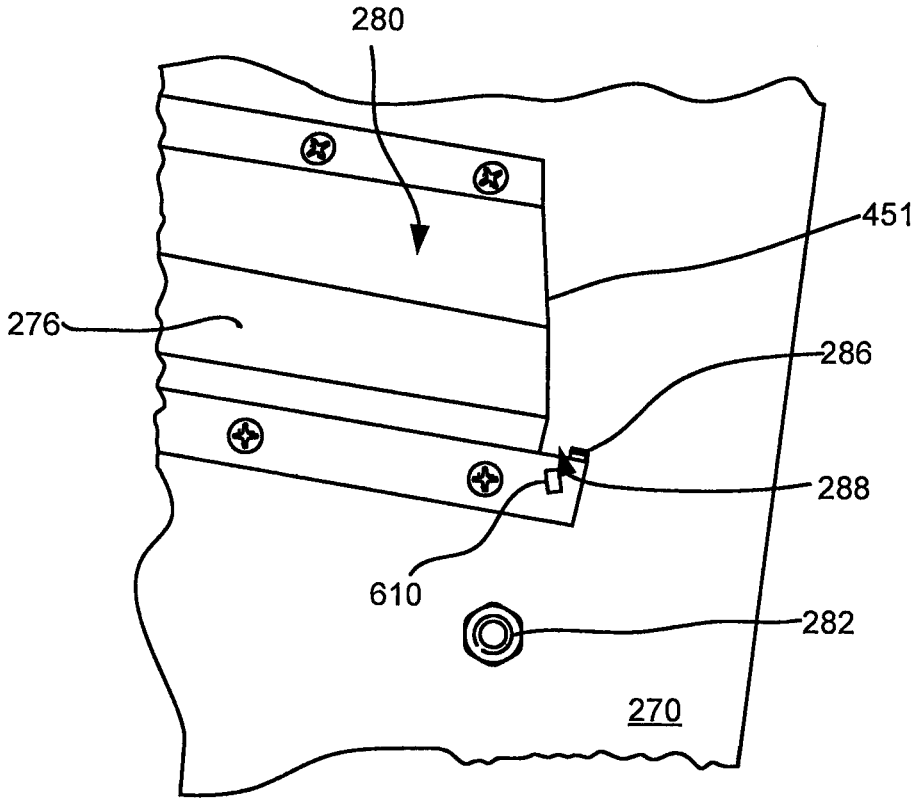
FIG. 22 is a partial perspective view of the coupling assembly at one end of the table top member shown in FIG. 21.

Referring now to FIGS. 21 and 22, table top assembly 14 includes a table top member 279, first and second edge brackets 278, a metal strengthening runner 276 and first and second coupling assemblies 280. Top member 279 is a rigid rectilinear member that extends along a length dimension between side edges 272 and 274 and that has oppositely facing front and rear edges 287 and 285, respectively. Member 279 also has a top surface (see FIG. 1) and a bottom surface 270. Brackets 278, strengthening runner 276 and coupling assemblies 280 are all mounted to bottom surface 270 of top member 279.

Referring still to FIG. 21 and also to FIG. 26, each of the edge brackets 278 has a generally flattened S-shape (best seen in FIG. 26) including a mounting plate 279, an arm plate 299 and a finger member 301. The mounting plate 297 is flat and rectilinear and mounts to the undersurface of top member 270. Arm plate 299 forms an angle with mounting plate 297 so that a distal end is spaced apart from the undersurface of top member 270 and finger member 301 extends from the distal end of arm plate 299 and is generally parallel to mounting plate 297 such that finger member 301 and the undersurface of top member 270 form a slot. The width of the slot is similar to a thickness of the runner member 236 that extends along the length of trough member 16 as shown in FIG. 26. Edge brackets 278, as best shown in FIG. 21, are mounted adjacent rear edge 285 and adjacent lateral edges 272 and 274 of top member 279.

Referring again to FIGS. 21 and 22, strengthening runner 276 is a bent sheet metal member that extends along the length dimension of, and is attached to, the undersurface 270 of top member 279 where distal ends are spaced apart from side edges 272 and 274. Member 276 is located generally along front edge 278 of top member 279. Runner 276 provides additional strength for top member 279 along the front edge thereof.

Referring specifically to FIG. 22, at each end, strengthening runner 280 forms an edge 451 that is generally perpendicular to undersurface 270. In addition, spaced apart from edge 311, runner 276 includes a relatively small finger member 286 (see also FIGS. 29 and 30) that extends generally perpendicular to bottom surface 270 such that the edge of member 286 facing strengthening runner edge 450 and edge 450 form a slot 288. Slot 288 has a width dimension that is slightly greater than the width of finger member 198 at the distal end of arm support member 15 as shown in FIG. 12. Opening 610 is sized and dimensioned to receive key member 203 on support member 15 (see again FIG. 12).

Referring still to FIG. 22, a metal stud 282 is embedded (e.g., adhered within an opening) in the undersurface 270 proximate slot 288 so that when alignment member 203 (see again FIG. 12) is received in slot 610, opening 196 is aligned with a threaded opening formed by the metal stud 282.

Figure 23:
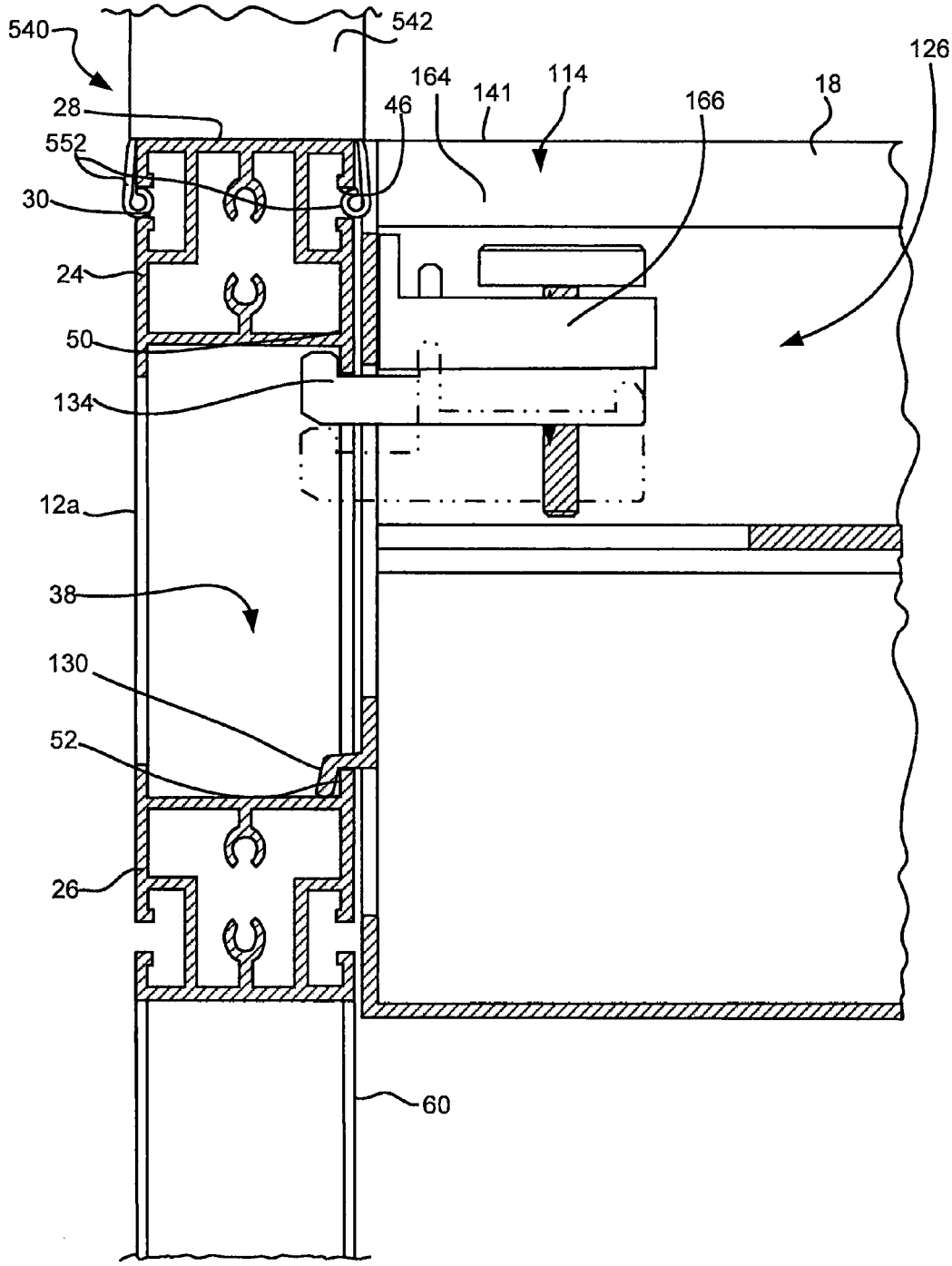
FIG. 23 is a view similar to the view shown in FIG. 4, albeit with the channel assembly of FIG. 1 attached to the leg assembly of FIG. 4.

Referring now to FIGS. 1, 2, 8 and 9, to assemble the configuration shown in FIG. 1, initially, coupling assemblies 114 and 116 are loosened so that finger members 134 are generally spaced apart from top cross members 124. Next, holding one of the leg assemblies 12*a* in an upright position as shown in FIG. 23, channel assembly 18 is aligned with the top end of the leg assembly 12*a* so that lip members 134 and 130 are generally aligned with opening 38 formed between rail members 24 and 26. Channel assembly 18 is moved toward the external surface 60 of leg assembly 12*a* until lip members 134 and 130 are located within the space between rail lip members 50 and 52 and then is moved downward until lip member 52 is received by lip member 130. The second leg member 12*a* is temporarily attached to the opposite end of channel assembly 18 in a similar fashion. To assemble the FIG. 1 configuration 10, channel assembly 18 is located at rear portions of leg assemblies 12*a* and 12*b* so that most of the frame space 13 is to a front side of assembly 18 (see FIG. 25).

Figure 29:
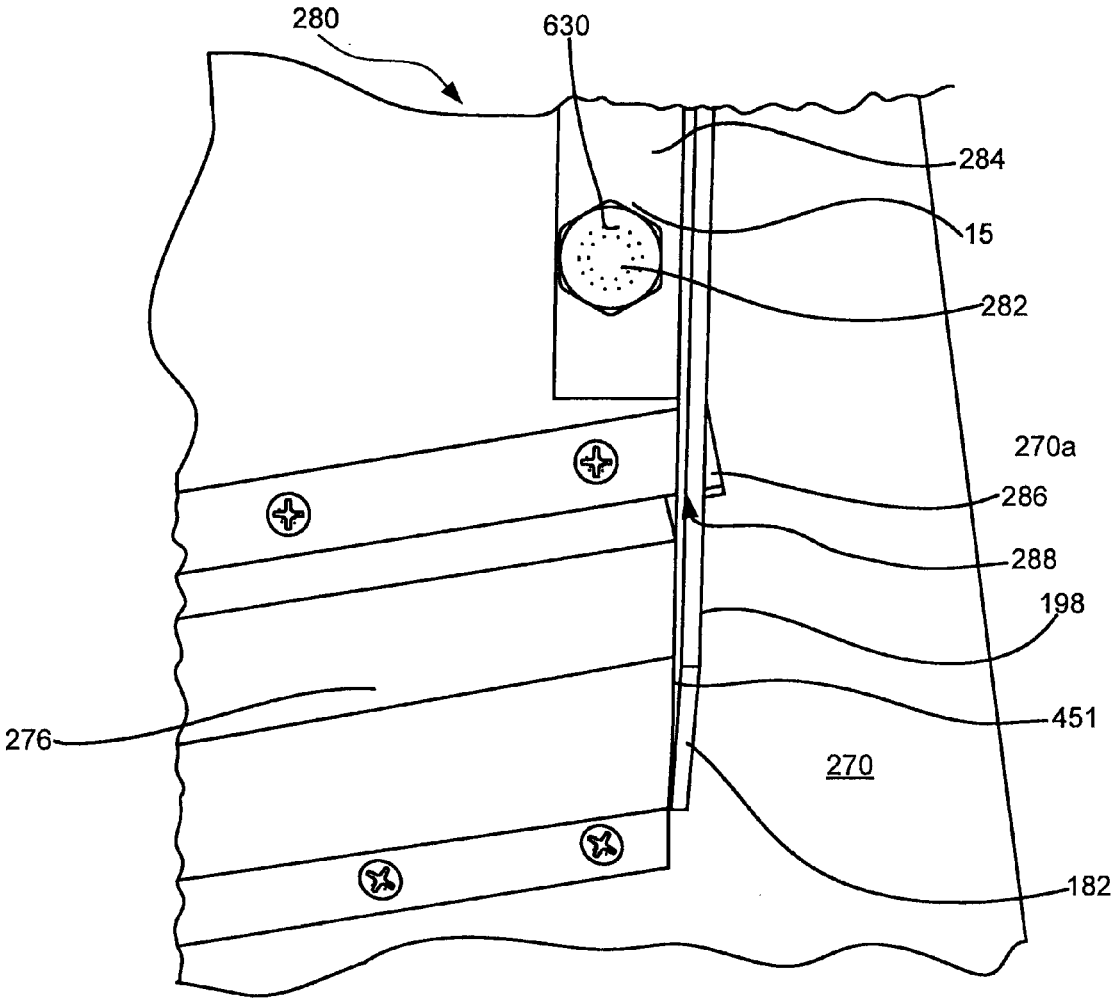
FIG. 29 is a view similar to the view shown in FIG. 22, albeit where a table top assembly is coupled to the distal end of one of the arm support members.

Referring still to FIG. 23, bolt 163 is rotated causing jaw member 164 and associated lip 134 to move upward until lip member 134 catches rail lip 50. Upon further tightening of bolt 163, channel member 18 is tightly secured to leg assembly 12*a*. The other coupling assembly 116 is similarly tightened to secure the opposite end of channel member 18 to second leg assembly 12*b*. At this point, frame space 13 is defined by the facing surfaces of leg members 12*a* and 12*b*, where the frame space has a rear edge portion adjacent channel assembly 18 and a front edge portion near leg member front surfaces 11 and an intermediate portion between the front and rear portions. Referring to FIG. 29, channel assembly 18 is spaced 700 slightly (e.g., ½ inch) from the rear surface of the leg assemblies 12*a*, 12*b* and top surface 141 is flush with the top surfaces 28 of leg members 12*a* and 12*b*.

Referring again to FIG. 23, after channel member 18 is secured to one of the leg assemblies 12*a*, the portion of the upper rail slot 46 aligned with the top opening 114 in the upper channel 126 is exposed within the opening 114. Thus, in at least some cases additional optional accessories may be mounted to upper rail 24 via the exposed portion of slot 46 (e.g., see clips 552 in FIG. 23 that help to attach a privacy screen 540 (see also FIG. 54 described below).

Figure 24:
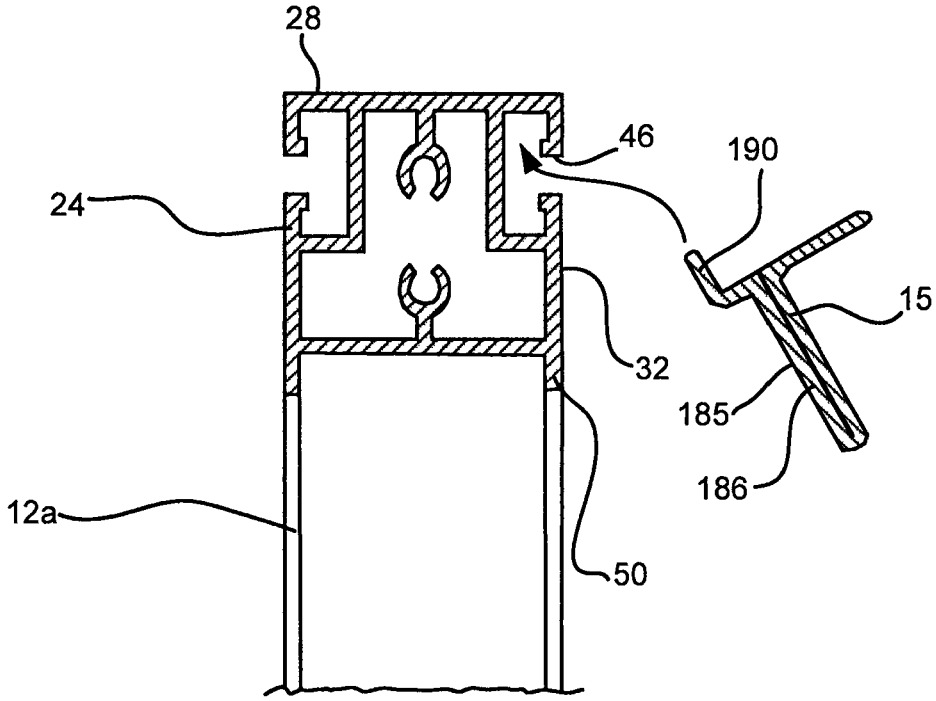
FIG. 24 is similar to the view shown in FIG. 4, albeit showing the support arm member of FIG. 12 being attached to an upper rail of one of the leg assemblies.
Figure 27:
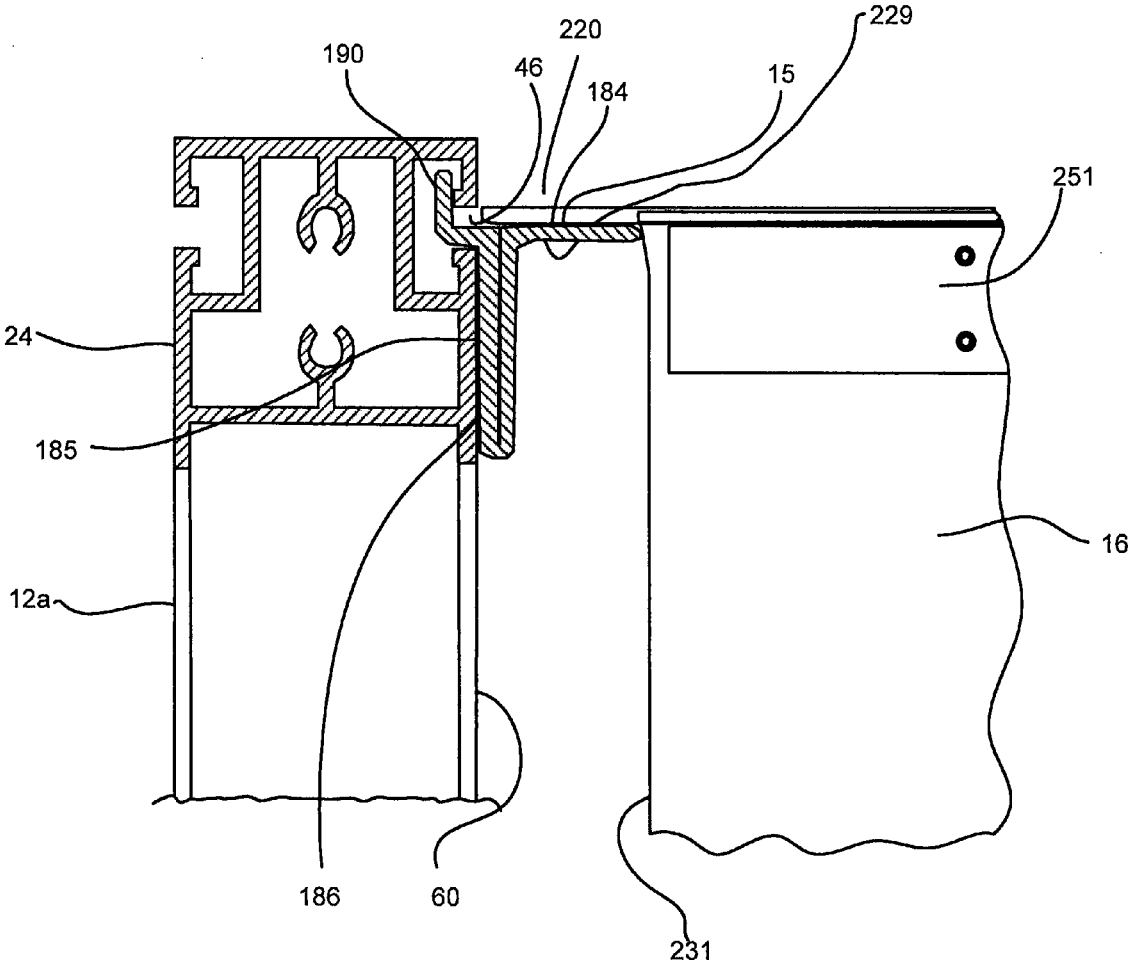
FIG. 27 is similar to FIG. 24 albeit showing the support arm member of FIG. 12 mounted to a top rail of a leg assembly and a trough member mounted to the support arm member.

Referring again to FIG. 2 and also now to FIG. 24, arm support members 15 are next attached to facing surfaces of leg assemblies 12*a* and 12*b*. To this end, the upwardly extending lip member 190 of one of the arm members 15 is aligned with the T-slot 46 formed by top rail 24 and is manipulated there into so that lip member 190 extends into the slot 46 and bearing surface 185 bears against an outer surface of wall member 32 that forms slot 46 (see also FIG. 27). The other arm member 15 is attached to the other leg assembly 12*b* in a similar fashion. At this point, the sub-assembly appears as shown in FIG. 25.

Referring again to FIG. 2 and also to FIG. 26, trough member 16 is next installed. To this end, the rear edge of lip member 220 is aligned with channel 148 formed by channel assembly housing 110 and is moved into the channel 148 while the front edge portion of the trough member is held up above the supporting surfaces of the arm members 15. Once the rear portion of lip member 220 is received within channel 148, the front edge portion of trough member 16 can be lowered until the undersurface of lip member 220 bears against the top support surfaces 184 of support members 15. At this point the sub-assembly configured has the appearance shown in FIG. 28.

Figure 28:
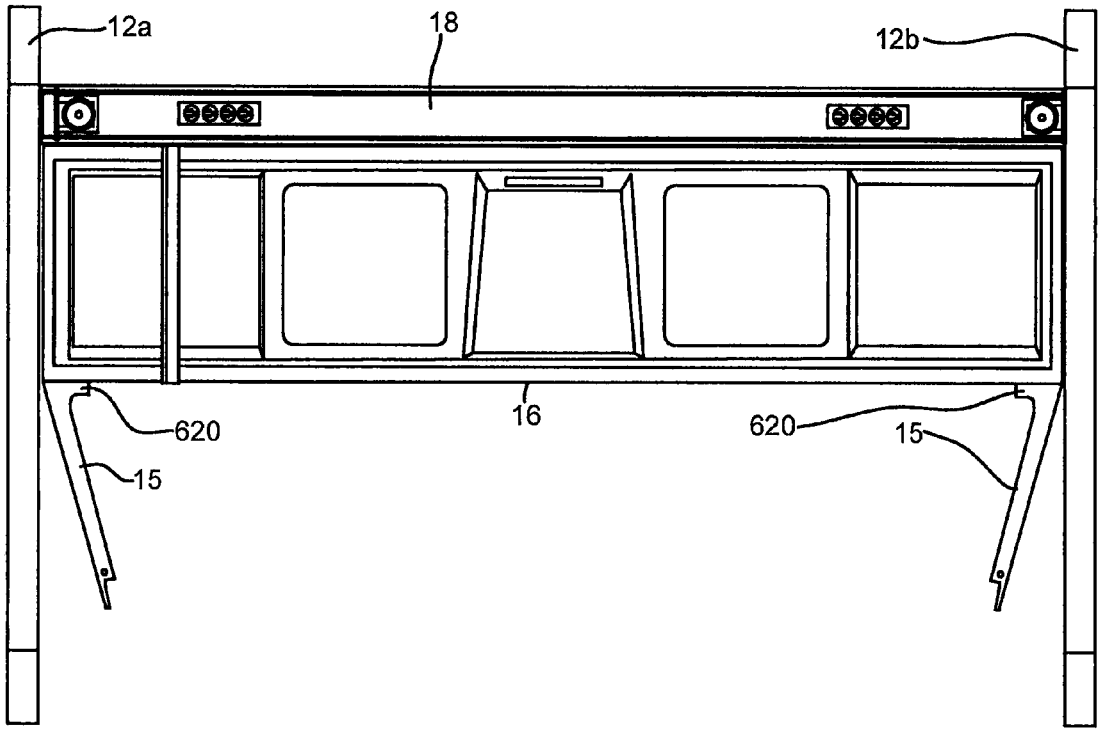
FIG. 28 shows a subset of the components of FIG. 1 in an intermediately assembled state.

Referring again to FIGS. 21 and 26, to mount table assembly 14 to the sub-assembly shown in FIG. 28, the table assembly 14 is positioned with the rear edge 285 adjacent the front edge portion 236 of runner 251 and so that brackets 278 are generally aligned with shoulder members 620 formed by support members 15 (see FIG. 12). Top assembly 14 is moved toward through member 16 until shoulder members 620 are sandwiched between the table top member undersurface 270 and clip member 301. In at least some embodiments the end portions of runner lip member 226 may also be sandwiched between undersurface 270 and clip member 301. Next, front edge 287 portion of table top assembly 14 is rotated downward above the distal ends of arm members 15 with slots 610 aligned with key members 203 (see FIGS. 12 and 22).

Figure 30:
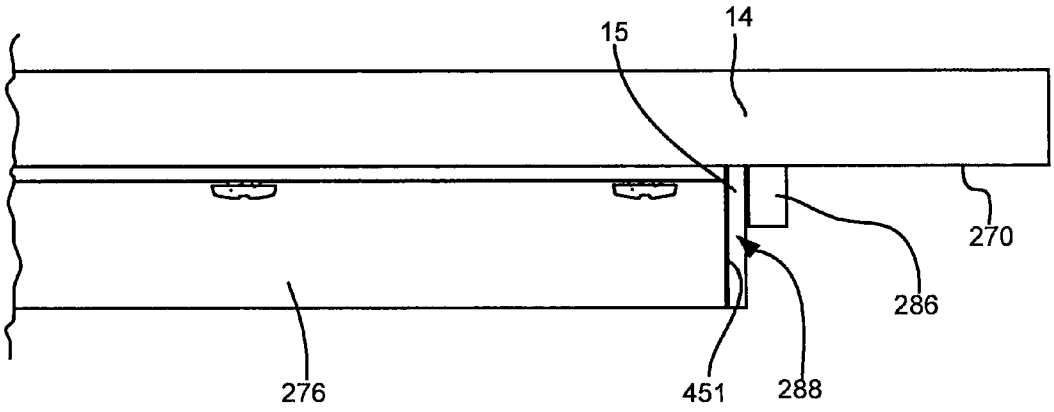
FIG. 30 is a front end view of the coupling assembly and arm support member of FIG. 29.
Figure 31:
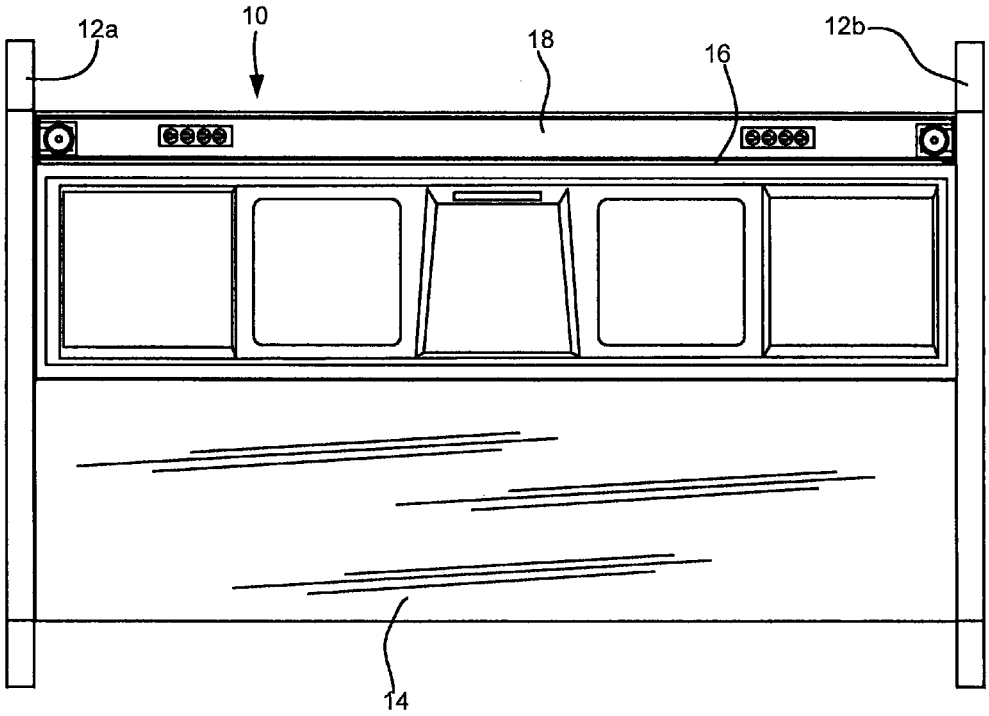
FIG. 31 is a top plan view of the assembly of FIG. 1.

While the front edge portion of the table assembly is being lowered, key members 203 slide into slots 610. In addition, finger members 198 formed at the distal ends of support arm members 15 are received within slots 288 between edge 451 of strengthening runner 176 and the facing edge of finger member 286 as shown in FIGS. 29 and 30. Finger tightenable bolts 630 are passed through openings 196 (see FIG. 12) and are threadably received in studs 282 to secure top member 297 to arm support members 15. Together, the mating between pin 282 and opening 196, the mating between finger member 198 and slot 288 and mating between bolts 630 and studs 282 securely connect top member 279 to arm members 15. Referring once again to FIG. 1, at this point the configuration shown in FIG. 1 is completely assembled. See also FIG. 31 that shows the configuration of FIG. 1 in a top plan view.

Referring again to FIG. 1, top member 279 has a thickness dimension such that after installation, top surface 9 of member 279 is at a height that is flush with the top surfaces 28 of leg assemblies 12*a* and 12*b*. Similarly, referring also to FIG. 10, the top surface 141 of channel housing 110 is at a height that is flush with top surfaces 28 of leg assemblies 12*a* and 12*b* after installation (see also FIG. 23). Referring to FIG. 26, a top surface 221 of trough lip member 220 is recessed below (e.g., one-quarter inch) the top surfaces of the leg assemblies 12*a* and 12*b*.

Figure 32:
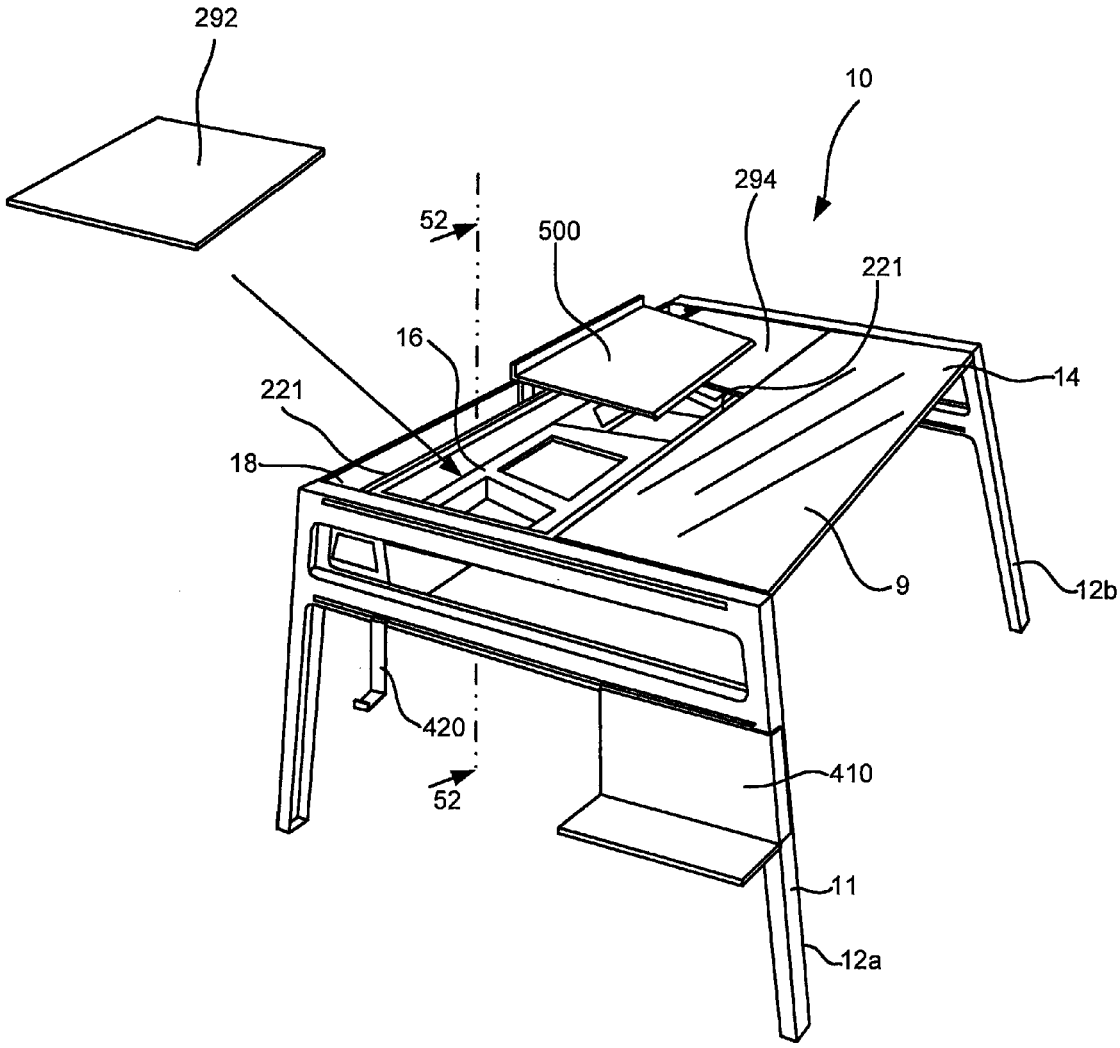
FIG. 32 is a perspective view similar to the view shown in FIG. 1, albeit including sliding board members, a shelf bracket and a purse hook or bracket.

Referring once again to FIG. 16, in at least some embodiments it is contemplated that one or more sliding board or plate members may be provided that are dimensioned to be received on the shelf support surface 221 for sliding motion along the length dimension of trough member 16. Referring also to FIG. 32, exemplary sliding board members 292 and 294 are illustrated that may be placed on the shelf support 221 as shown. Board members 292 and 294 have thicknesses such that, when supported on surface 221, top surfaces of the boards are generally at the same height as top surface 9 of table top member 279. Thus, with boards 292 and 294 installed, the top surfaces thereof operate to provide additional work surface space if desired.

Figure 33:
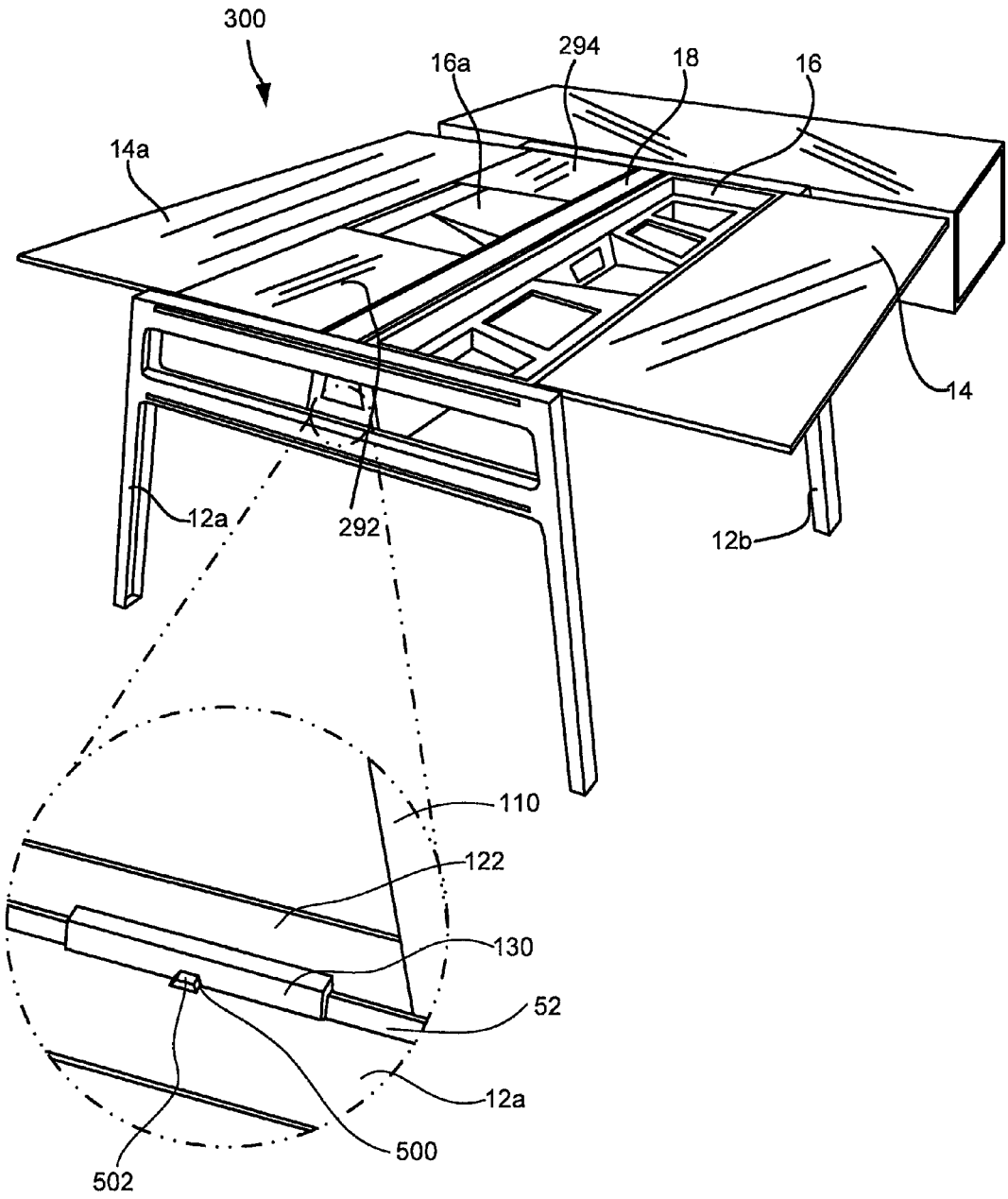
FIG. 33 is a view similar to the view shown in FIG. 1, albeit showing a second desk/table assembly that is consistent with at least some aspects of the present invention.

Referring now to FIG. 33, a second exemplary configuration 300 that is consistent with various aspects of the present invention is illustrated. This second configuration 300 includes all of the components described above with respect to the first configuration 10 as well as some additional components. To this end, configuration 300 includes first and second leg assemblies 12*a* and 12*b*, table top assembly 14, trough member 16 and channel assembly 18. In addition, second configuration 300 includes a second table top assembly 14*a* and a second trough assembly 16*a*. Configuration 300 is also shown with first and second sliding board or plate members 292 and 294 supported by the shelf surface of trough member 16*a*.

To configure the configuration 300 shown in FIG. 33, the configuration shown in FIG. 1 can simply be reconfigured. To reconfigure the configuration shown in FIG. 1, referring to FIG. 34, the coupling assemblies 114 and 116 can be loosened so that channel assembly 18 can be slid along the openings 38 (see again FIG. 1) to a central location with respect to, or to an intermediate portion of, leg assemblies 12*a* and 12*b*. When channel assembly 18 is slid, trough member 16 and table assembly 14 slide therewith into the positions shown in FIG. 34 where trough member 16 and table assembly 14 are generally adjacent front end portions of leg assemblies 12*a* and 12*b*. In addition, referring again to FIGS. 12 and 34, arm support members 15 slide to the locations shown in phantom in FIG. 34 where distal portions 183 thereof extend past the front surfaces 11 and forward of the frame space 13. Next, the coupling assemblies 114 and 116 can be tightened to secure channel assembly 18 in the central position. At this point, table assembly 14 extends past the front surfaces 15 of leg assemblies 12*a* and 12*b* but is still solidly supported by the distal ends of the support arm members 15 and the strengthening member 276 there below.

Figure 34:
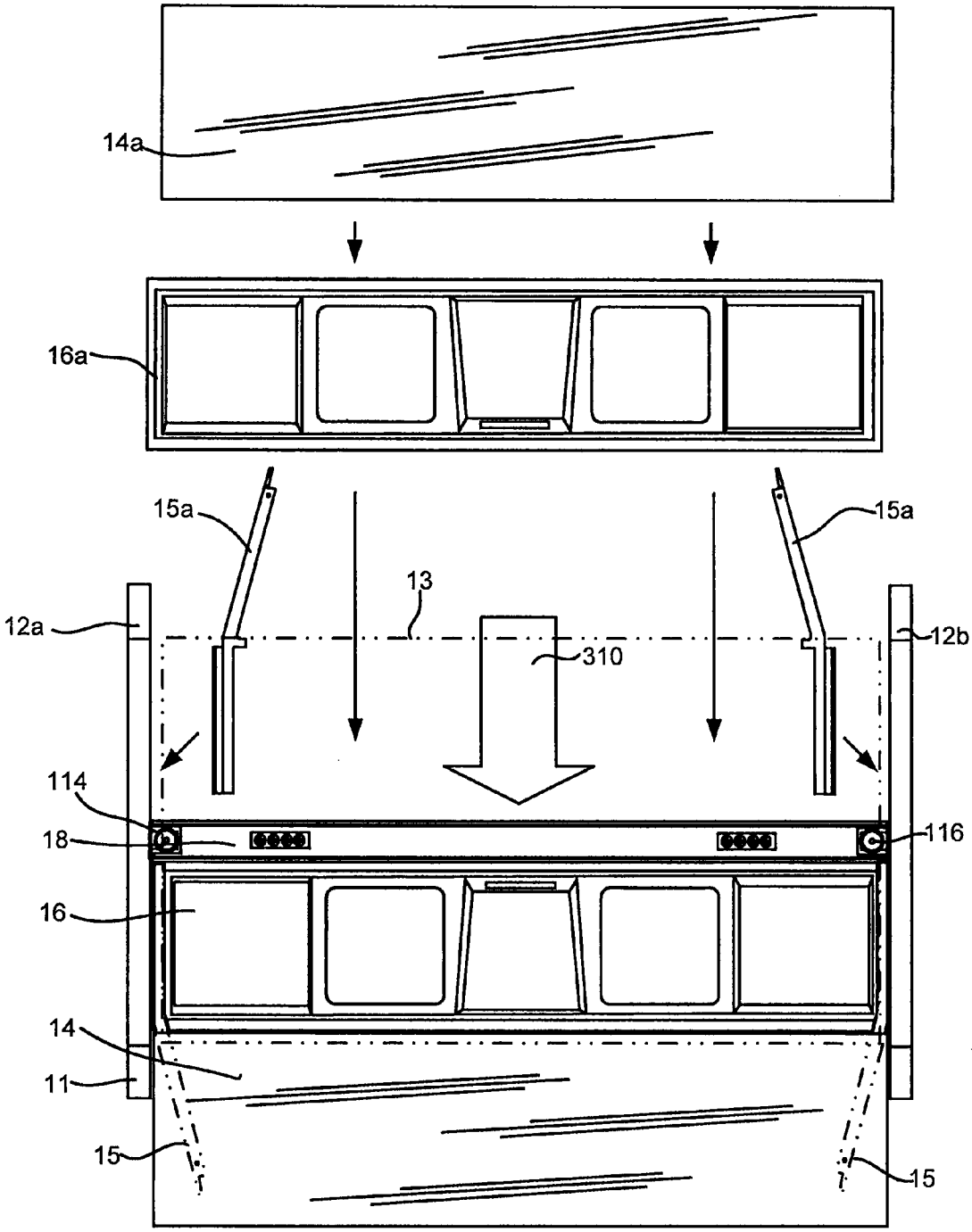
FIG. 34 is a top plan view showing the assembly of FIG. 33 in a partially assembled state.
Figure 35:
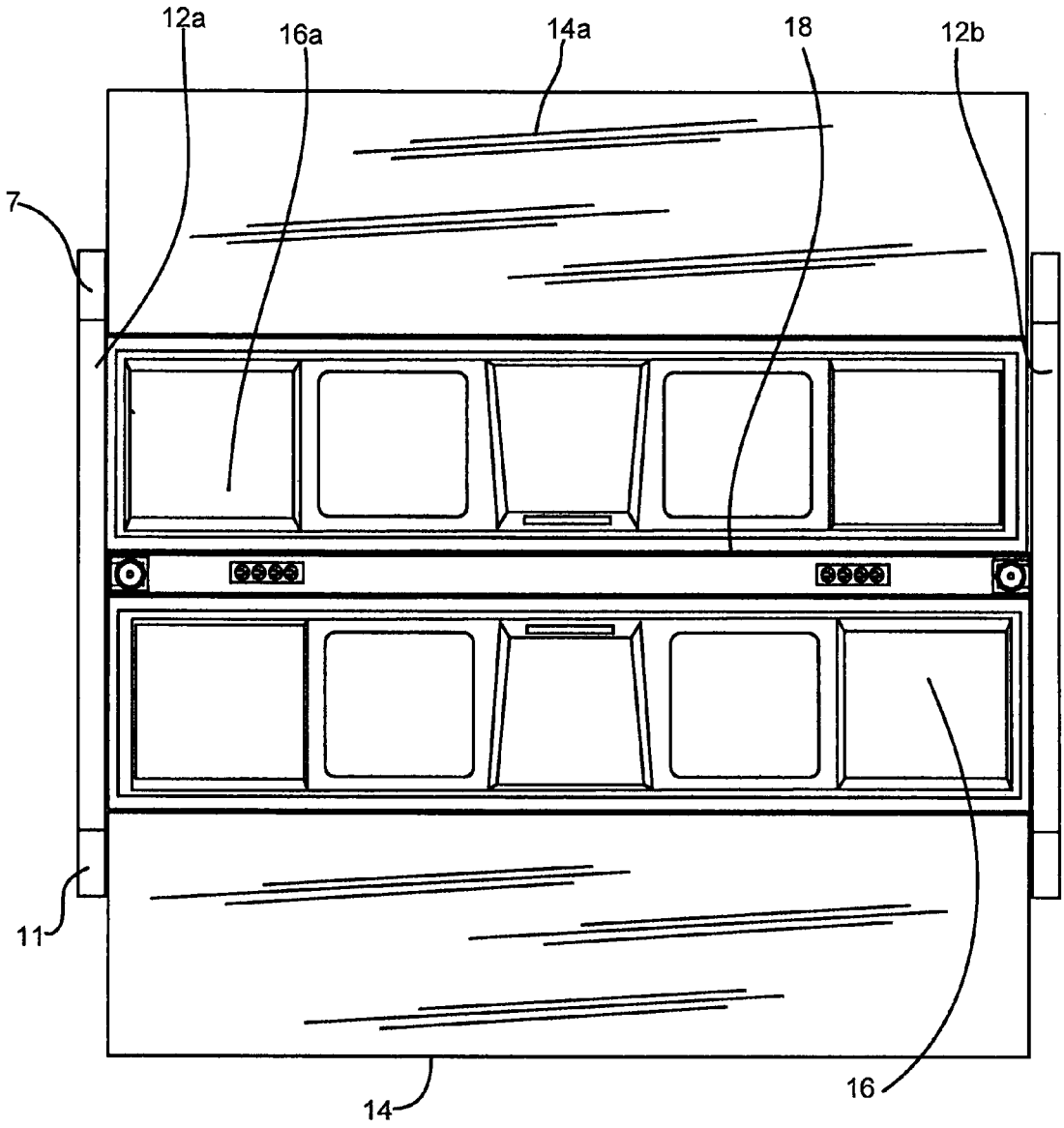
FIG. 35 is a top plan view of the assembly shown in FIG. 33.

Referring still to FIG. 34, third and fourth arm support members 15*a* are attached to the facing surfaces of leg assemblies 12*a* and 12*b* in an similar fashion to that described above with respect to members 15, albeit with the distal ends of arm members 15*a* extending in a rearward direction. Trough member 16*a* is attached with the rear edge thereof received in the second channel 146 (see again FIG. 10) formed by channel housing member 110 and side portions thereof supported by the top support surfaces formed by support arm members 15*a*. Table top assembly 14*a* is attached to the front edge of trough member 16*a* and distal portions of the top surfaces formed by arm members 15*a*. A top plan view of the resulting configuration 300 is shown in FIG. 35 where it can be seen that table assembly 14*a* and trough member 16*a* are generally adjacent rear end portions of leg assemblies 12*a* and 12*b*.

Thus, it should be appreciated that the configuration 10 in FIG. 1 can be reconfigured easily and intuitively to use all of the assembly 10 components from a single person workstation to configure a two person face-to-face workstation that includes a pair of table tops supported at least in part within the frame space formed by the facing surfaces of leg assemblies 12*a* and 12*b*. As shown, the table tops 14 and 14*a* form a split top space between facing rear edges where trough members 16 and 16*a* as well as channel assembly 18 are located in the split top space and are supported by the leg members. The sliding capability of channel assembly 18 with respect to the leg openings 39 (see again FIG. 1) enables fast and easy one-to-two station reconfiguration and vice versa.

Figure 36:
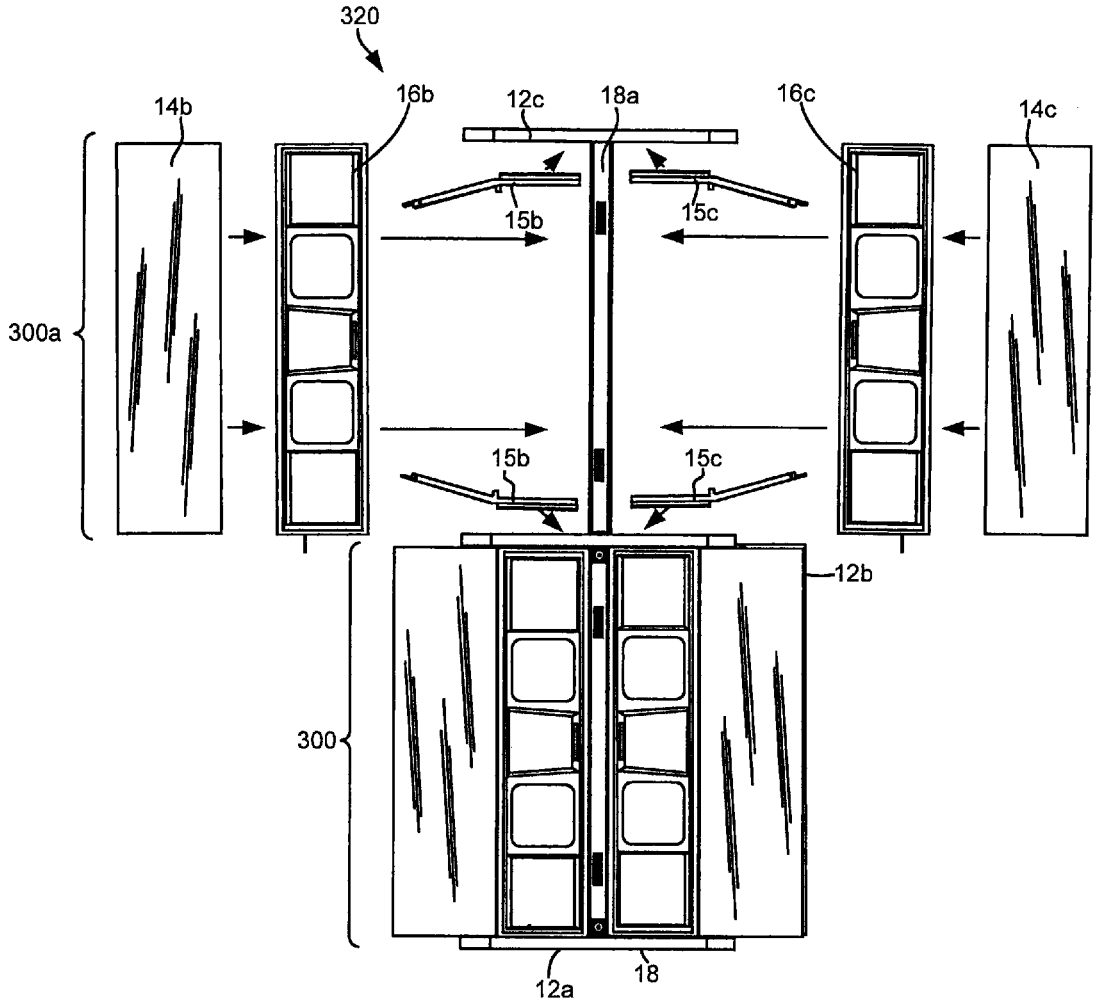
FIG. 36 is a top plan view of a partially assembled desk/table assembly for constructing four different workstations.
Figure 37:
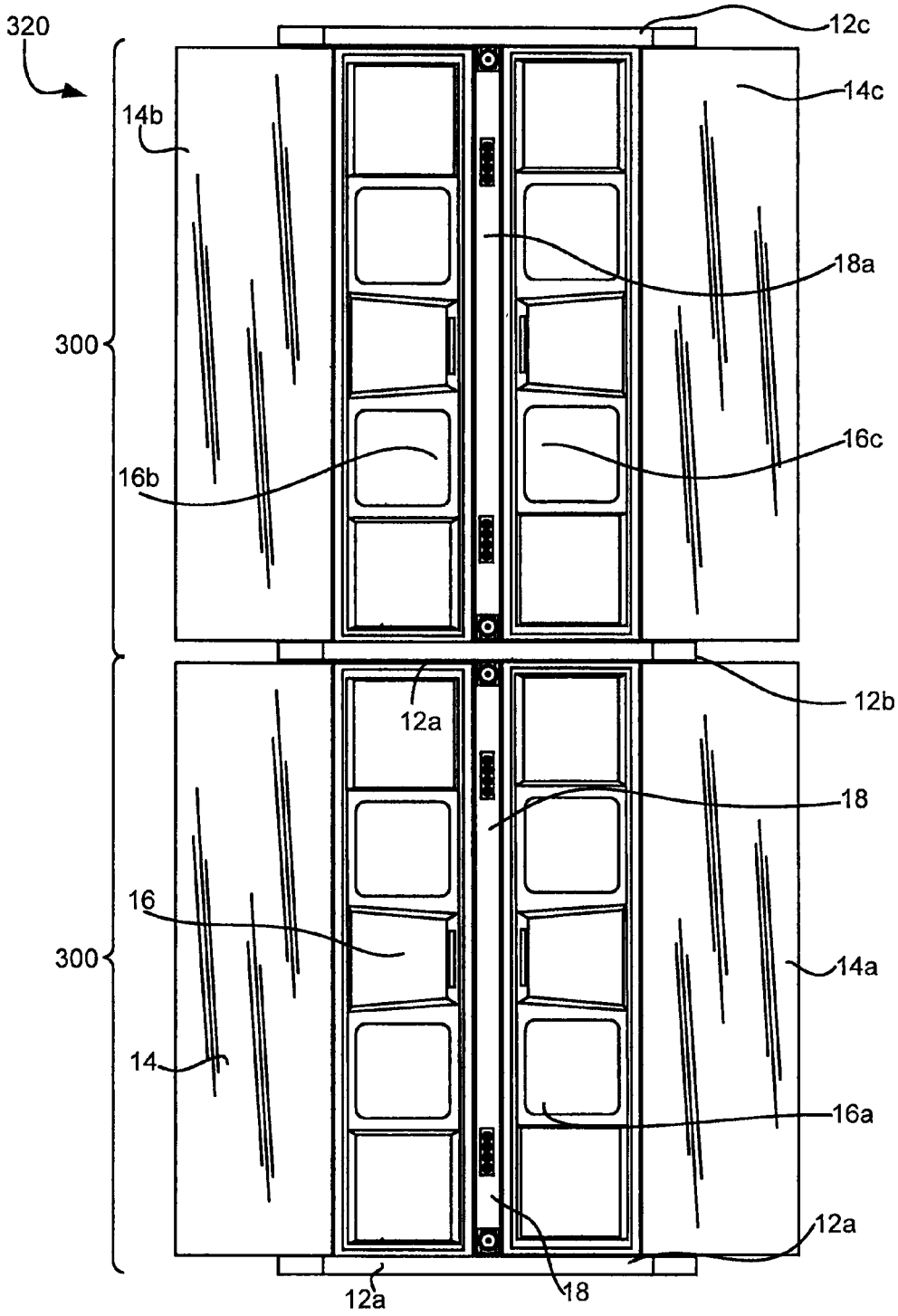
FIG. 37 is a top plan view of the assembly of FIG. 36 in a completely assembled condition.

In addition to the embodiments described above, additional components like those described above can be continually added to a configuration to configure additional work spaces for additional users. To this end, referring again to FIG. 33, after configuration 300 is configured, the outer exposed surfaces of leg assemblies 12*a* and 12*b* have slot and lip arrangements that can be used to secure additional channel assemblies 18 and support arms (see again FIG. 12) that can in turn support additional trough members 16 and table assemblies 14. In this regard, see now FIG. 36 that shows yet another partially assembled workstation configuration 320 that is consistent with at least some aspects of the present invention. As shown in FIG. 36, the configuration 320 includes an instance 300 of the configuration shown in FIG. 33 plus additional components 300*a* for forming two additional workstations. The additional components include a second channel assembly 18*a*, four additional support arm members 15*b* and 15*c*, third and fourth trough members 16*b* and 16*c*, third and fourth table top assemblies 14*b* and 14*c* and a third leg assembly 12*c*. Here, second channel assembly 18*a* is mounted to a surface of leg assembly 12*b* opposite the surface to which channel assembly 18 is mounted and extends in line with and parallel to channel assembly 18 to a second end that is securely connected to one of the side surfaces of leg assembly 12*c*. Support arm members 15*b* and 15*c* are mounted to facing surfaces of leg assemblies 12*b* and 12*c* to extend in opposite directions, trough members 16*b* and 16*c* are installed and table top assemblies 14*b* and 14*c* are installed. The resulting "four pack" of workstations 320 is illustrated in FIG. 37 in top plan view.

Referring still to FIG. 36, the components that comprise configuration 320 generally include two overlapping pairs of leg members including a first pair 12*a*, 12*b* and a second pair 12*b* and 12*c* where each pair of adjacent leg members forms a separate frame space and where a separate pair of table tops (e.g., 14*b* and 14*c*) are supported at least partially within each frame space. Although not shown, additional leg members and table top pairs can be provided to construct additional face-to-face workstations in a similar fashion. In this regard, an additional leg member may be spaced apart from an existing member to form another pair of adjacent leg members that define another frame space and a pair of table top members can then be mounted within the additional frame space.

After assembly 320 has been configured, the wire passing openings at adjacent ends of channel assemblies 18 and 18*a* are aligned and both open into the leg openings 38 (see again FIG. 1) formed by central leg assembly 12*b* so that power/data wires can be directly routed from one channel assembly 18 to the next 18*a*.

Figure 38:
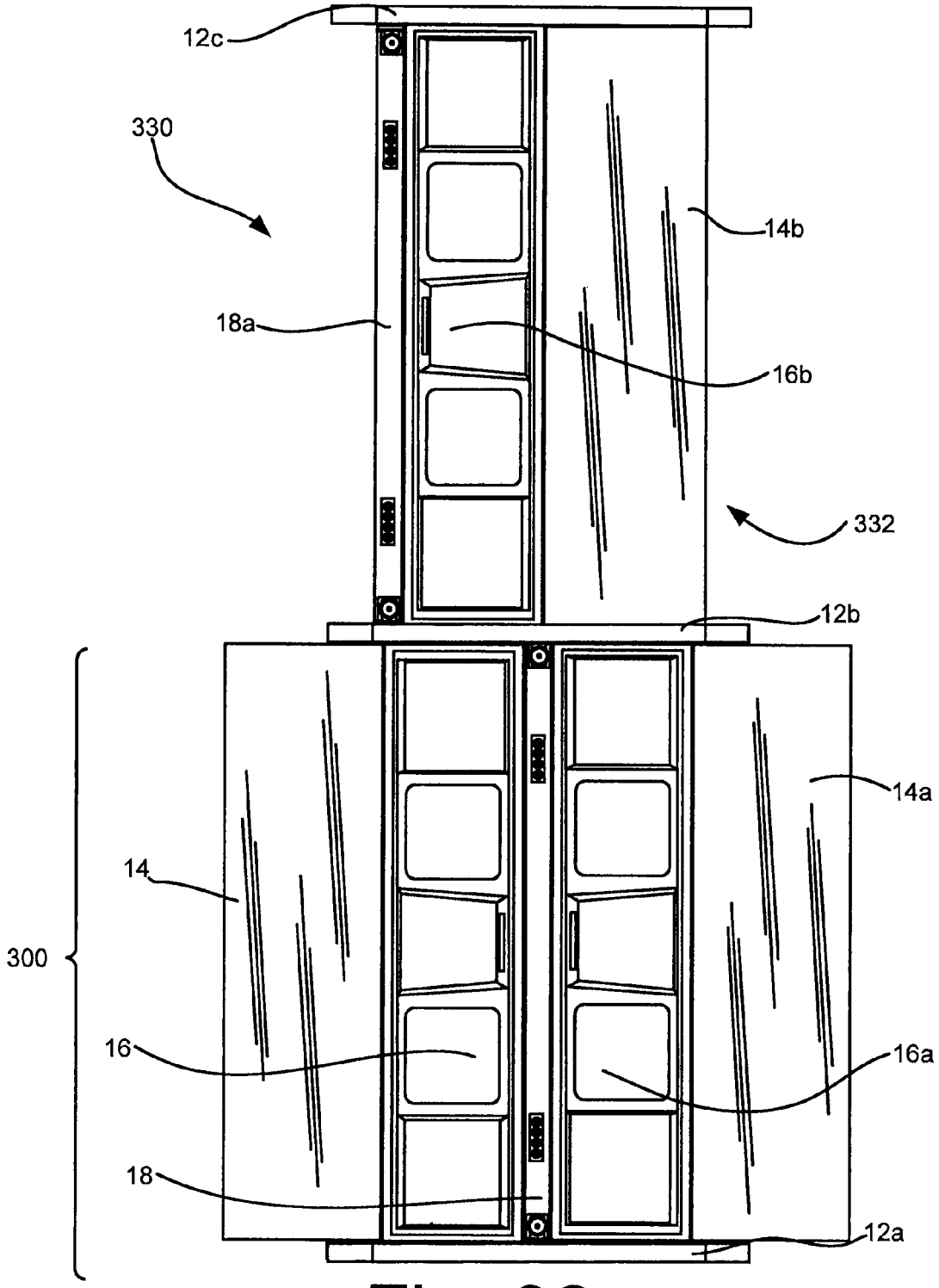
FIG. 38 is a top plan view of yet another workstation assembly.

Other configurations are contemplated. For example, referring now to FIG. 38, yet one additional configuration 330 is illustrated that is consistent with at least some aspects of the present invention. Configuration 330 includes an instance of the configuration 300 shown above in FIG. 33 as well as additional components 332 attached to configuration 300 to form a third workstation. The additional components 332 include a second channel assembly 18*a*, a third trough member 16*b*, a third table top assembly 14*b* and a third leg assembly 12*c*. Second channel assembly 18*a* is mounted to a side of leg member 12*b* opposite the side on which channel assembly 18 is mounted and extends parallel to channel assembly 18. Here, however, second channel assembly 18*a* is not directly aligned with channel assembly 18 and is instead offset to the rear portion of leg assemblies 12*b* and 12*c* in a fashion similar to that described above with respect to assembly 10 in FIG. 1. The trough member 16*b* and table top assembly 14*b* are then attached to the leg assemblies 12*b* and 12*c* and channel assembly 18*a* as described above.

In the case of configuration 330, while channel assemblies 18 and 18*a* are not aligned, both assemblies 18 and 18*a* open into the large leg opening 38 (see again FIG. 1) and therefore power/data wires can be routed from assembly 18 through the leg opening 38 and into assembly 18*a*.

Although not illustrated, many other workstations may be strung on to either side of one of the above described assemblies in a fashion similar to that described above to configure any number of desired workstations (e.g., five, eight, twenty, etc.).

All of the embodiments described above include different "inserts" or rigid furniture components or furniture assemblies that can be mounted between leg assemblies 12 to configure different overall workstation configurations. For instance, in the case of the FIG. 1 configuration 10, the "furniture assembly" that can be secured between first and second leg assemblies 12*a* and 12*b* includes channel assembly 18, trough member 16 and table top assembly 14 (i.e., a first rigid furniture component). In the case of second configuration 300 shown in FIG. 33 above, in addition to the first furniture assembly, a second furniture assembly is included that includes trough member 16*a* and second table top assembly 14*a* (i.e., a second rigid furniture component).

Figure 39:
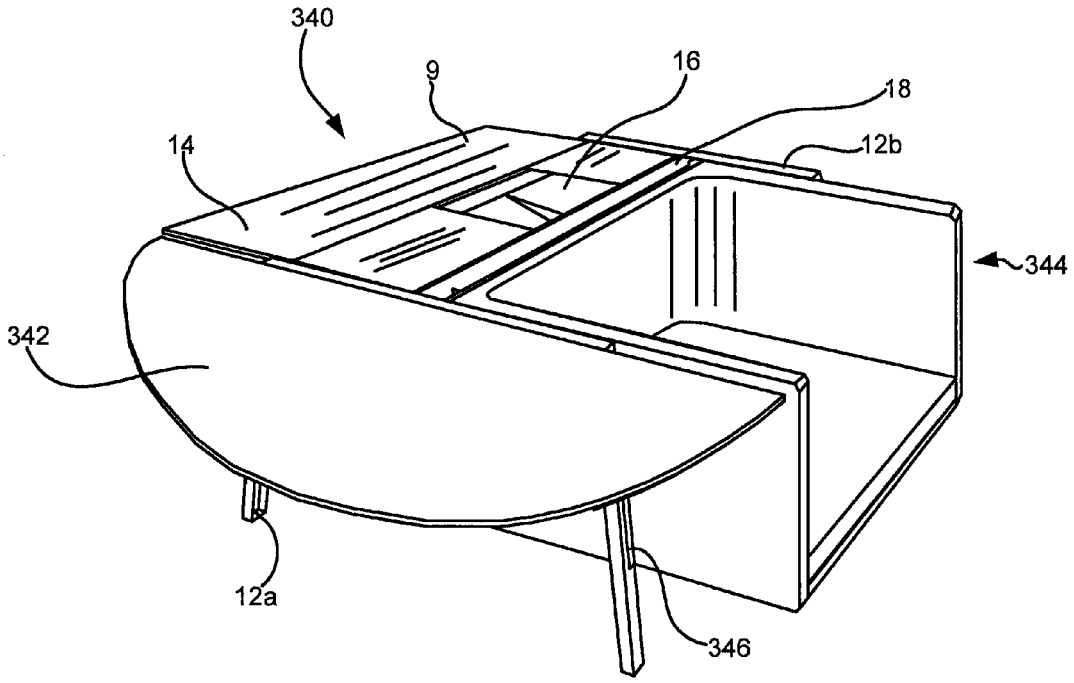
FIG. 39 is a perspective view similar to the view of FIG. 33; albeit where several components in the assembly of FIG. 33 have been replaced by a lounge sub-assembly.

In at least some embodiments it is contemplated that additional different types of furniture assemblies may be provided that can be installed between a pair of leg assemblies 12 to provide yet additional furniture configurations. For example, referring to FIG. 39, an exemplary additional configuration 340 is shown that includes a seating or lounge furniture assembly or sub-assembly 344 that has been substituted for the trough member 16 and table top assembly 14 shown in FIG. 33.

Figure 40:
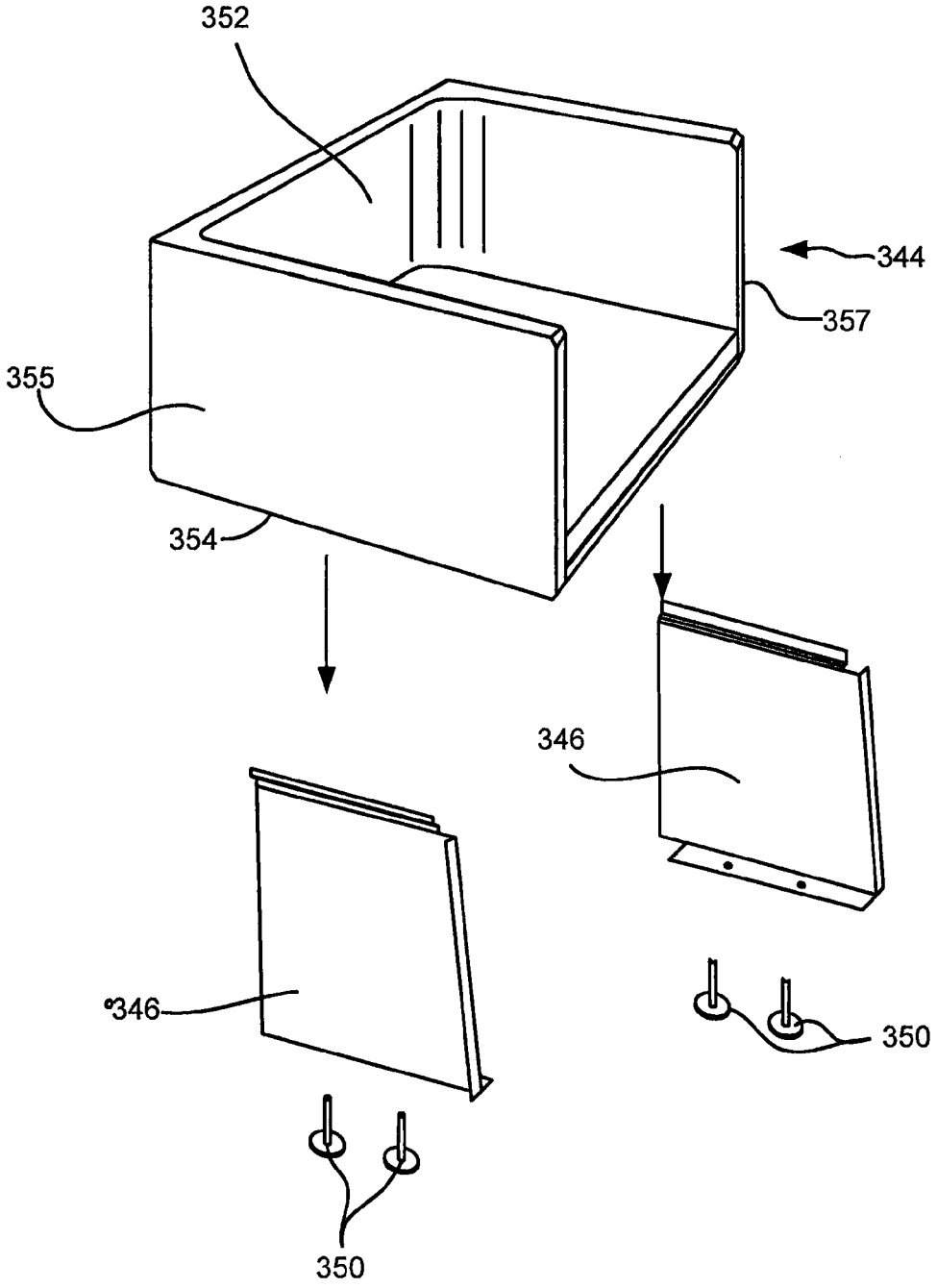
FIG. 40 is a perspective exploded view of the lounge sub-assembly of FIG. 39.
Figure 41:
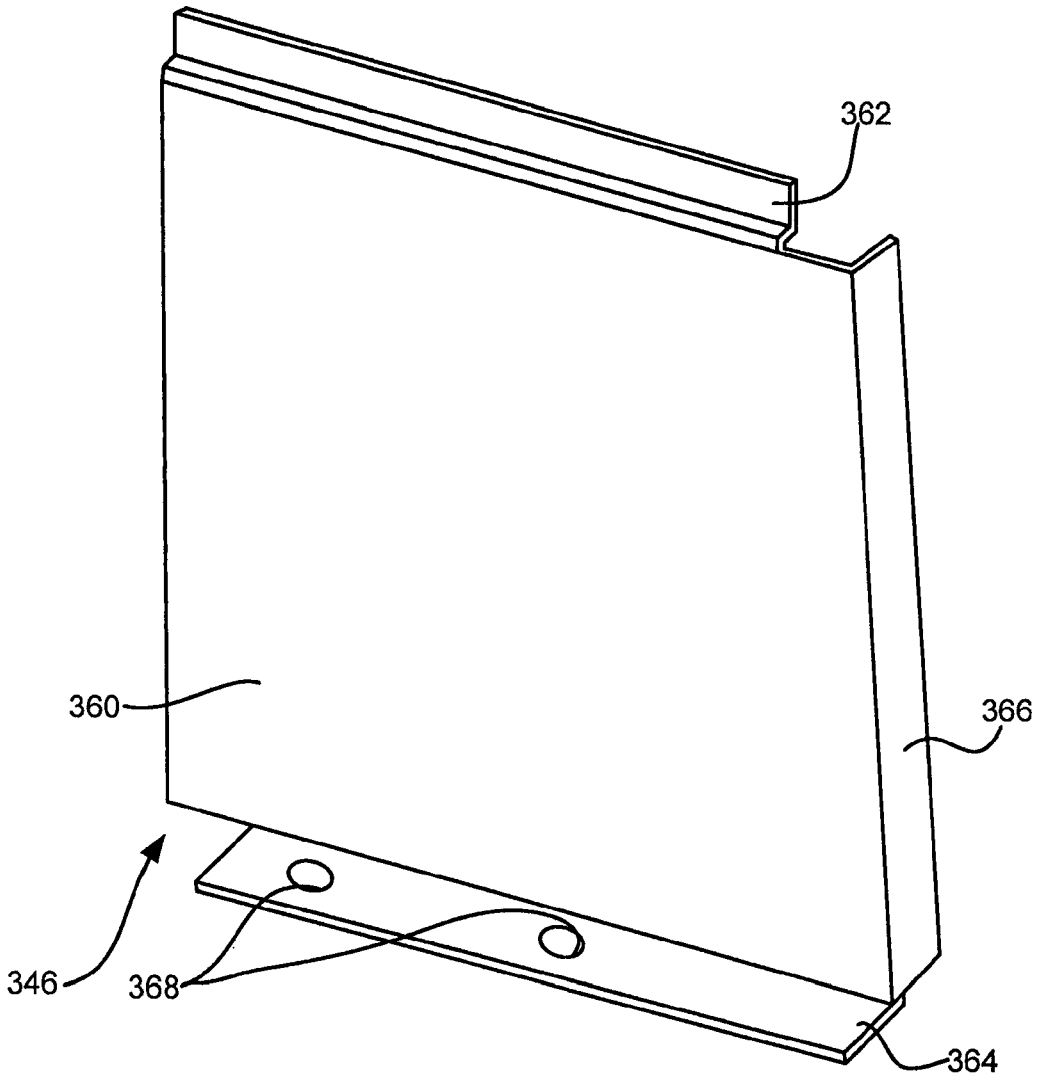
FIG. 41 is a perspective view of one of the lounge brackets shown in FIG. 40.

Referring to FIGS. 40 and 41, lounge sub-assembly 344 includes a lounge or sofa-type structure 352 (i.e., a third rigid furniture component), first and second lounge brackets 346 and finger tightening locking bolts 350. Lounge structure 352 forms a seating structure and includes an undersurface 354 and first and second side surfaces 355 and 357. The lounge structure 352 is dimensioned such that its length is substantially identical to the length dimension of channel assembly 18 described above so that lounge structure 352 can fit snugly between facing surfaces of leg assemblies 12*a* and 12*b* when channel assembly 18 is connected there between.

Lounge bracket 346 includes a large rectangular plate 360 that forms a lip 362 that extends to a first side of plate 360 and that has a form and dimensions similar to lip 190 shown in FIGS. 12 and 13. Along an edge opposite the edge from which lip member 362 extends, a shelf member 364 extends in a direction opposite the direction in which the lip member 362 extends. Member 364 forms two openings 368 for passing locking bolts 350. Along a front edge of plate member 360, a flange 366 extends generally perpendicular to plate member 360 and in a direction opposite the direction in which shelf member 364 extends.

Figure 42:
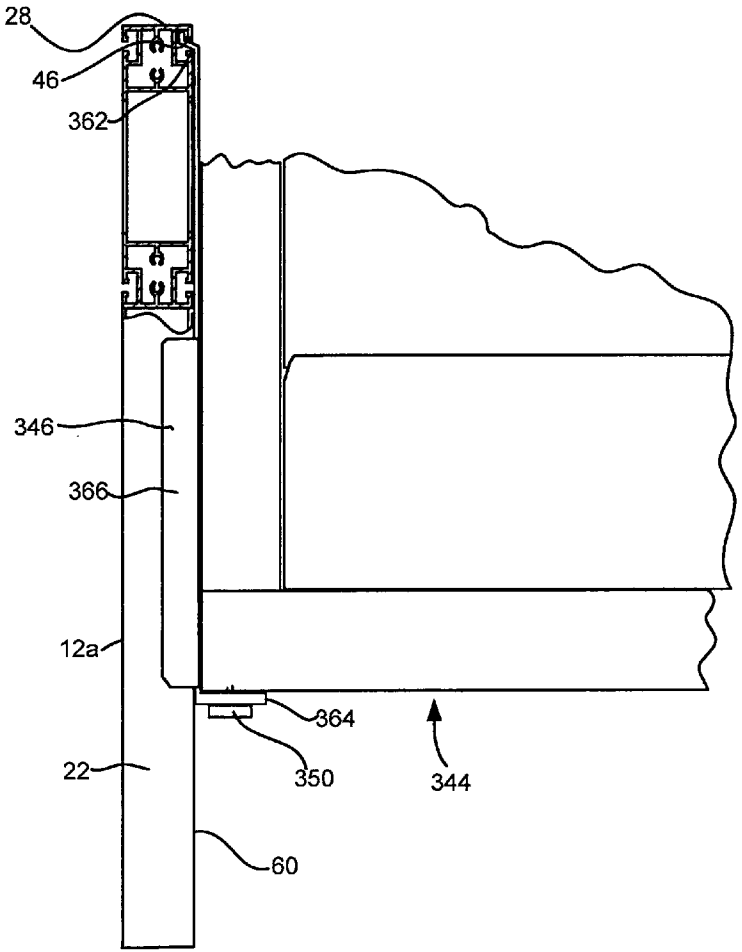
FIG. 42 is a partial cross-sectional view of the assembly of FIG. 39 showing the lounge bracket attached to a leg assembly and a lounge structure attached to the lounge bracket.

Referring once again to FIG. 39, initially it is assumed that channel assembly 18 is securely connected between leg assemblies 12*a* and 12*b*. Referring also to FIGS. 40 and 42, to install lounge sub-assembly 344, first brackets 346 are attached to the leg members 12*a* and 12*b*. To attach a bracket to a leg assembly, the lip member 362 is generally aligned with one of the upper rail slots 46 and is manipulated there into. Next, bracket 346 is rotate downward about the slot 348 until a rear surface of plate member 360 contact an adjacent side surface 60 of member 22. Here, flange member 366 extends in front of and generally contacts a front surface 11 of leg assembly 12*a* to restrict movement of the bracket 346 with respect to slot 48. Next, lounge structure 352 is aligned with the space between brackets 346 and is slid there into and set down on the shelf members 364 as shown in FIG. 42. Finger tightenable bolts 350 are slid through the bracket openings 368 and into threaded apertures in the undersurface 354 of lounge structure 352 to secure the lounge structure in place. The resulting configuration 340 is again shown in FIG. 39.

Figure 43:
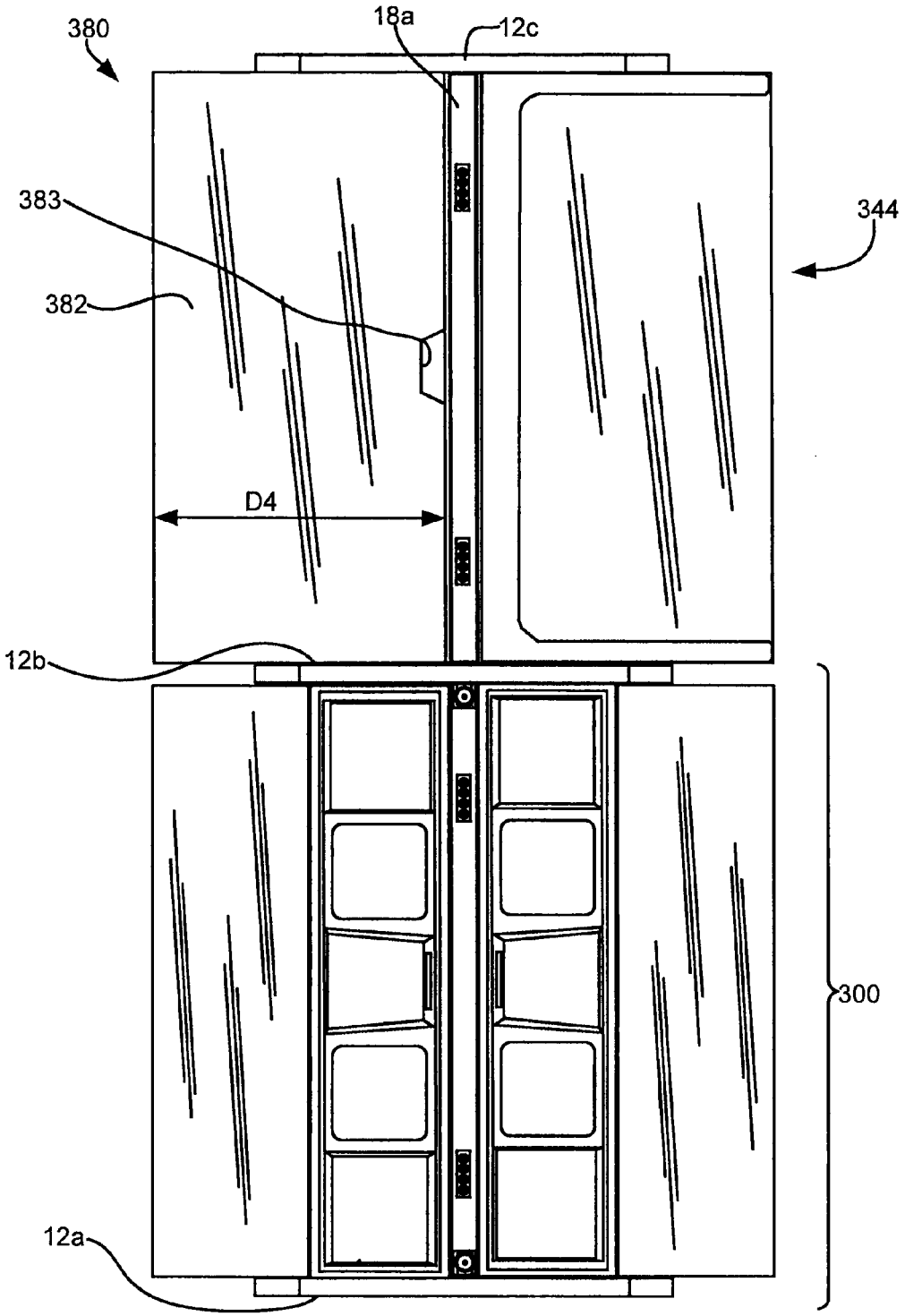
FIG. 43 is a top plan view showing yet another assembly that includes three workstations and a single lounge sub-assembly.

Referring to FIG. 43, another exemplary configuration 380 is illustrated that includes one of the configurations 300 shown in FIG. 33 as well as one of the lounge structures described above with respect to FIGS. 40 through 42 and a relatively deep table top assembly 382. Here, table top assembly 382 has a configuration that is similar to table top assembly 14 described above except that table top assembly 382 has a depth dimension D4 that is equal to the combined depths of the table top assembly 14 and one of the exemplary trough members 16 described above. Thus, table top assembly 382 takes the place of one of the table top assemblies 14 and a trough member 16 between leg members 12*b* and 12*c* and adjacent channel assembly 18*a*. Although not illustrated, table assembly 382 includes all of the components described above with respect to FIG. 21 on an underside thereof and mounts to the support arm members 15 (see again FIG. 15) in a similar fashion to that described above with respect to table top assembly 14. In this case brackets 278 (see FIG. 26) would be located about midway along each lateral edge of top member so as to be positioned to receive shoulder members 620 formed by support arm members 15 (see again FIG. 12). Table top assembly 382 forms a scalloped edge opening 383 along a rear edge to allow power/data wires to pass there through down to a space there below.

Thus, according to one aspect of the disclosed system, a kit of parts may be provided where addition parts can be added to an existing kit to add additional workstation or seating functionality. In addition, an existing configuration can be reconfigured to swap one furniture assembly for another furniture assembly while using a single core structure that includes leg assemblies 12*a* and 12*b* and a channel assembly 18. Any combinations of seating and workstation furniture assemblies may be constructed to fit requirements of specific applications. For instance, two lounge subassemblies 344 may be configured back-to-back, all workstation assemblies may include wide depth table top assemblies 382 (see again FIG. 43), etc.

Figure 44:
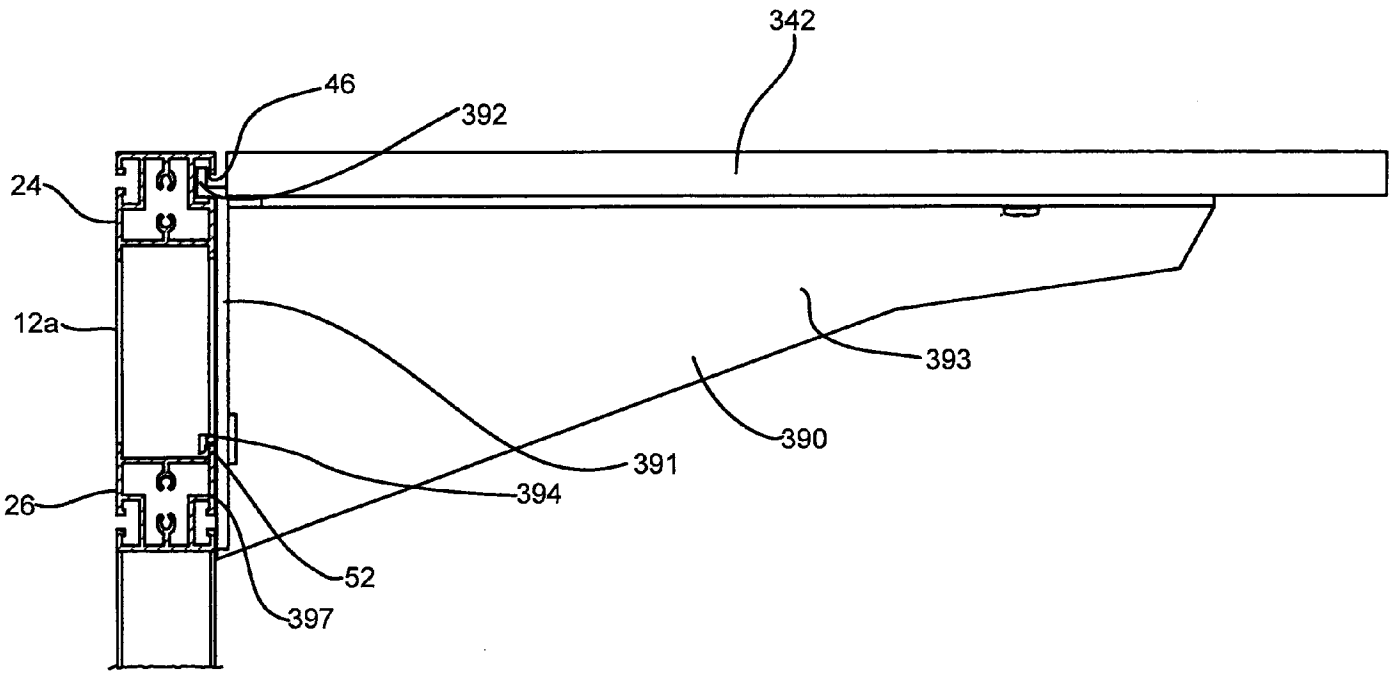
FIG. 44 is a partial cross-sectional view showing an end table and end bracket assembly that may be used to accessorize the assemblies shown in the other figures.

In addition to the components described above, at least some embodiments will include additional accessory components that can be attached to leg assemblies 12*a*, 12*b*, 12*c*, etc., via the slots and/or lips formed by the leg assembly rail members 24 and 26. For example, referring to FIG. 44, end table support brackets 390 (only one shown) may be provided for supporting a half-round table top 342 (see FIG. 39) or other type of end table via an upper rail slot 46 and lower rail lip 52. Exemplary bracket 390 includes a mounting plate 391 and an arm plate 393 that generally form a right angle. The mounting plate 391 includes a rearward and upward extending lip 392 along a top edge that is size and shaped similar to lip 190 in FIGS. 12 and 13 to be received in a rail slot 46. After lip 392 is received in slot 46, the lower portion of bracket 390 is rotated downward until a rear surface of plate 391 contacts an outer or external surface of side wall 397 of lower rail 26 so that arm member 393 is cantilevered from the leg assembly 12.

In the illustrated embodiment, a locking hook 394 is provided through plate 391 that aligns with upward extending lip 52 on rail 26 where the locking hook 394 can be rotated causing the hook 394 to engage lip 52 and retain bracket 390 on leg assembly 12. Half-round top member 342 is mounted via screws or other mechanical fasteners to the top of arm member 393.

As shown, the top surfaces of the half-round member 342, leg assembly 12*a* and top assembly 14 (see FIG. 39) are at the same height in at least some embodiments. Thus, the top surface of table top 342 and leg assembly top surface 28 form an extension of the worksurface 9 of top assembly 14.

Figure 45:
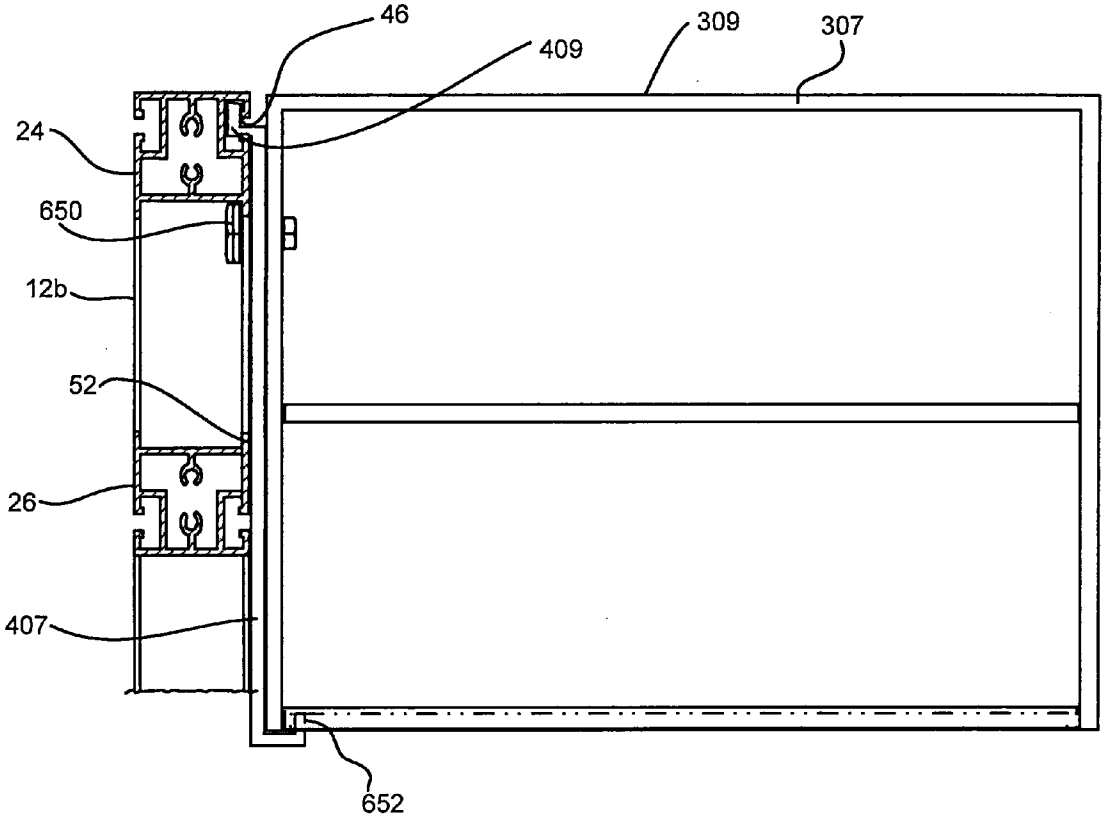
FIG. 45 is a partial cross-sectional view of a casegood accessory mounted to a side surface of one of the leg assemblies of FIG. 33.

Referring again to FIG. 33, a casegood accessory 307 is shown mounted to a vertical side surface of leg assembly 12*b* so that a top surface 309 of accessory 307 is at the same height as the top surfaces of assemblies 14 and 14*a*. Referring also to FIG. 45, to mount a casegood accessory 307 to leg 12*b*, two brackets 407 (one shown) that mount to a side surface of accessory 307 and that form upwardly extending lips 409 akin to lip 190 in FIGS. 12 and 13 are provided. As shown, lips 409 are received in upper rail T-slot 46 to hang accessory 307 along the side of the leg assembly 12*b*. The bottom of bracket 407 forms an upwardly extending hook or lip member 652 that hooks on to a lower edge of one of the side walls that forms a casegood 307 (i.e., the bottom wall of casegood 307 is recessed). Top surface 309 provides an extension of the worksurface of top assemblies 14 and 14*a* as shown in FIG. 33. two nut and bolt pairs 650 (only one shown) are provided for each of the brackets 407. each nut and bolt pair includes a large head bolt and an associated nut. A threaded shaft of each bolt extends through aligned openings in bracket 407 and a side wall of casegood 307 and is received in the associated nut to secure casegood 307 to the brackets 407. In at least some embodiments the openings in bracket 407 and casegood 307 are aligned immediately adjacent a lower edge of lip member 50 formed by upper rail 24 so that lip 50 is sandwiched between facing surfaces of brackets 407 and the large head of bolt 650 so that the bolt head restricts rotation of casegood 307 about slot 46.

Figure 46:
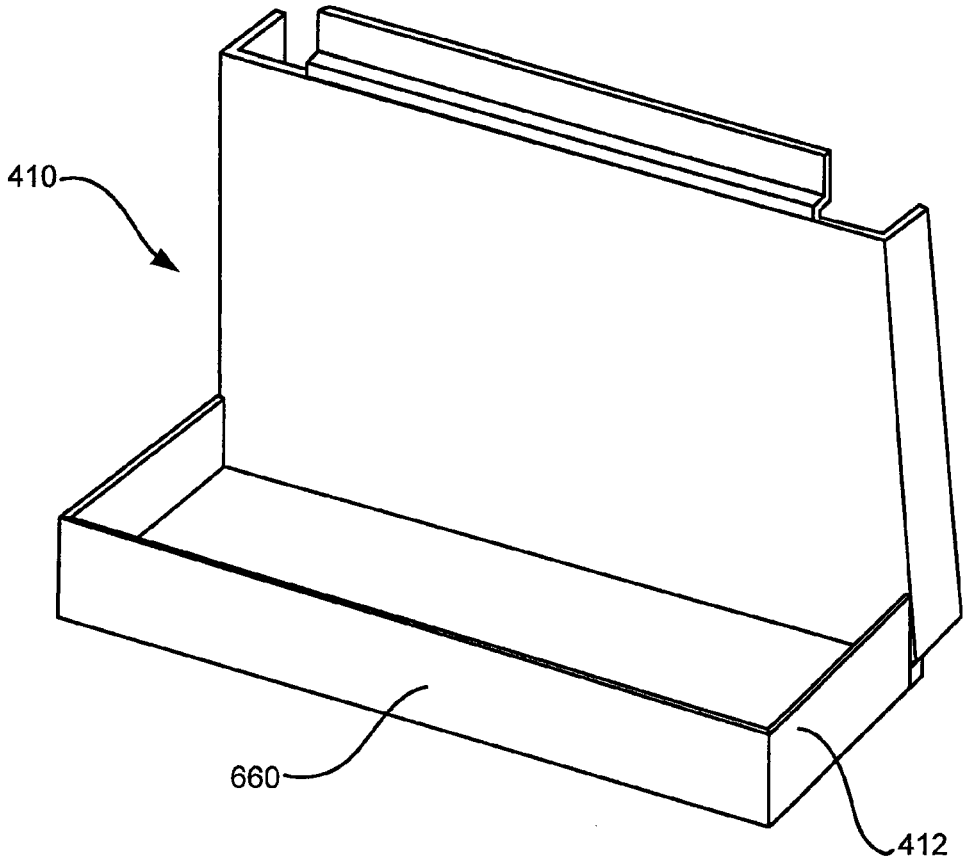
FIG. 46 is a perspective of the shelf bracket shown in FIG. 32.

Referring to FIG. 46, another exemplary accessory that may be provided for use with the configurations described above includes a shelf bracket 410. Here, bracket 410 has characteristics that are similar to the lounge bracket 346 described above except that the member 364 (see FIG. 41) is replaced by a larger shelf member 412 that does not form bolt passing holes. Exemplary shelf 410 is shown in FIG. 32 with an upwardly extending lip member received in a lower rail channel. While shelf bracket 410 is shown on an external surface of the leg assembly 12, it should be appreciated that the shelf bracket 410 may also be attached on an internal surface via an internal rail slot.

Figure 47:
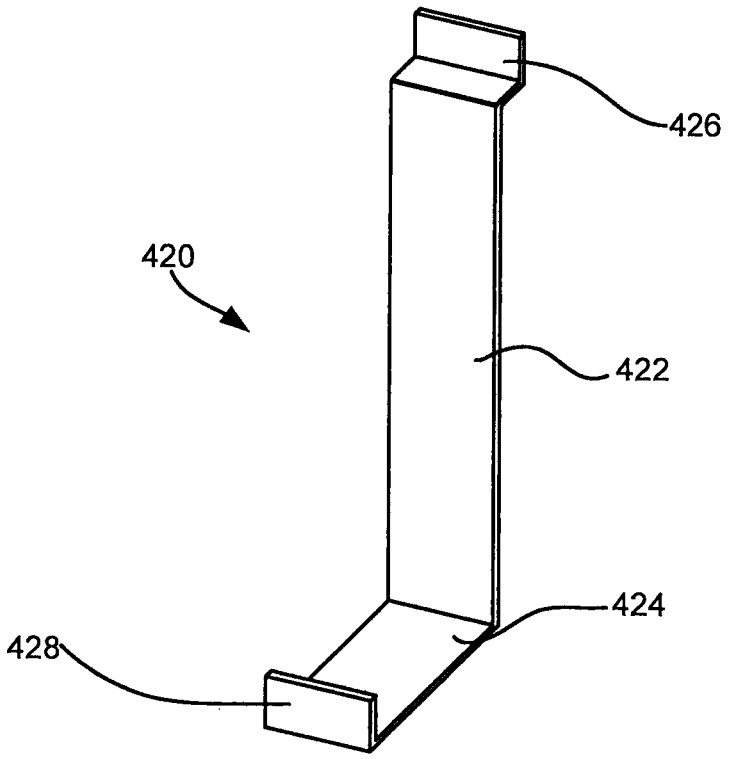
FIG. 47 is a perspective view of the purse or hook bracket shown in FIG. 32.

Referring to FIG. 47, another exemplary accessory includes a purse or hook type accessory 420 that includes a vertical member 422, a horizontal shelf member 424, an end lip member 428 and an attaching lip member 426. Referring again to FIG. 32, the exemplary hook bracket 420 is shown attached to a slot formed by a lower leg assembly rail with the lip member 426 received within the slot.

Figure 48:
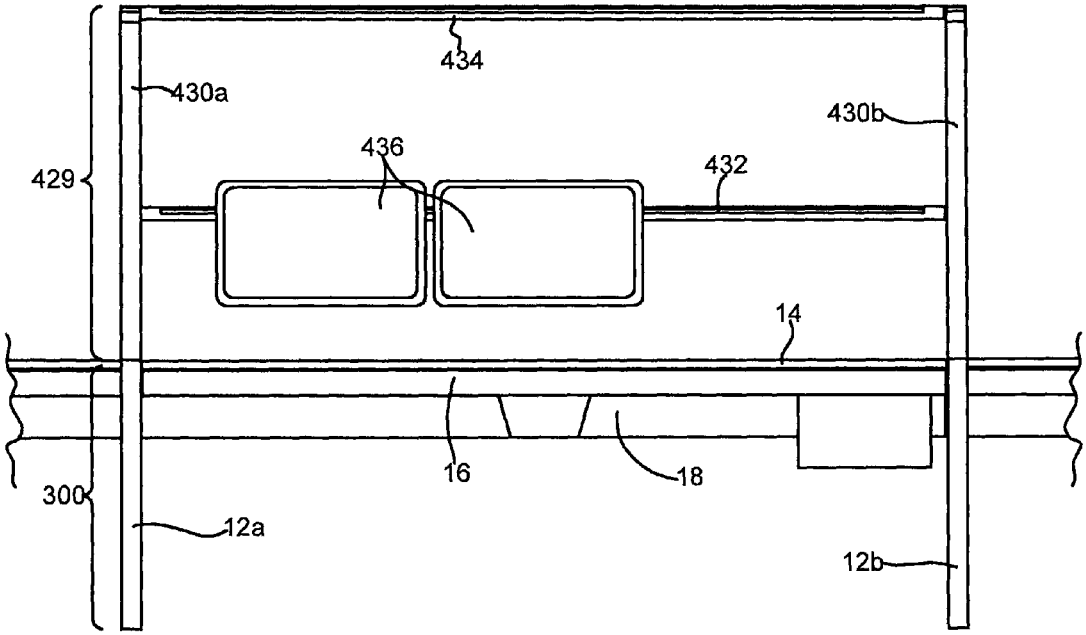
FIG. 48 is a front plan view of a desk assembly including an arch assembly added to the desk assembly.

Referring once again to FIG. 33, in at least some embodiments, it is contemplated that where facing workstations are configured, station users may desire additional arch type structure for supporting computer display screens, additional storage space, etc. To this end, referring to FIG. 48, in at least some embodiments, an additional arch assembly 429 may be added to the configuration 300 described above. Arch assembly 429 includes vertical arch assemblies 430*a* and 430*b* that mount to and extend generally upwardly from leg assemblies 12*a* and 12*b*, an upper cross rail member 434 and an intermediate cross rail member 432. In FIG. 48, two display screens 436 are shown mounted to intermediate cross rail member 432. The rail members 432 and 434 mount to the vertical frame assemblies 430 and extend there between generally above a centrally located channel member 18.

Figure 49:
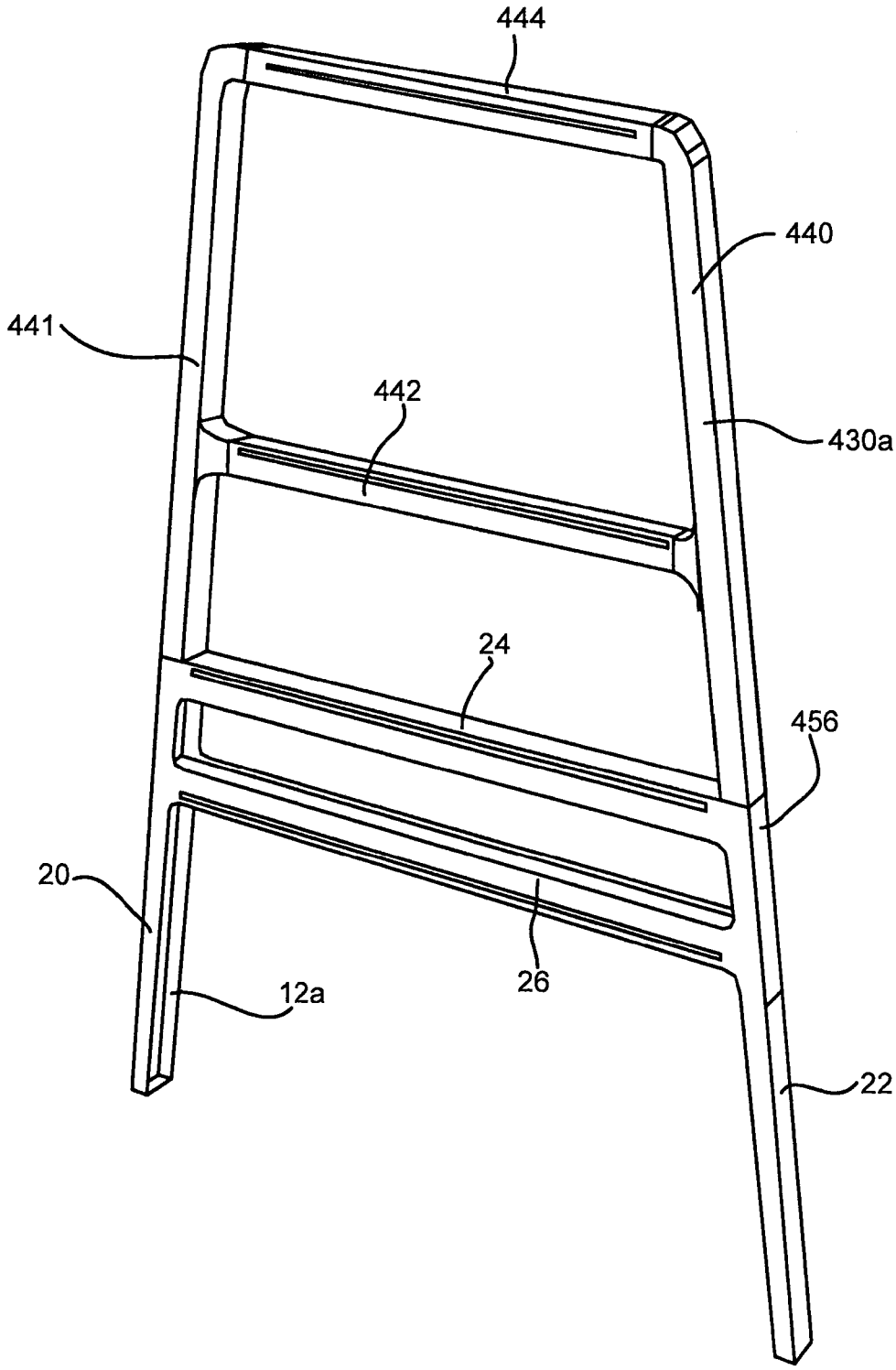
FIG. 49 is a perspective view of the exemplary leg and arch extension structure shown in FIG. 48.

Referring to FIG. 49, an exemplary vertical arch assembly 430*a* includes first and second vertical members 440 and 441 as well as a top rail member 444 and an intermediate or lower rail member 442. The rail members 444 and 442 are formed of the same extruded rail stock that is used to form the leg assembly rail members 24 and 26. Vertical members 440 and 441 attach at lower ends to the top ends of vertical leg members 20 and 22. To this end, referring again to FIG. 6, an arch mounting threaded hole 88 is provided within vertical leg member 20 for attaching an arch mounting bracket 450. In addition, a web/lattice structure including a plurality of ribs 67, 71, 73 is formed within space 91 (see FIG. 6) that operates to guide or restrict placement of the lower end of bracket 450 (see phantom in FIG. 6) upon attachment. In addition to restricting placement, the ribs 67, 71, 73 cooperate with bracket 450 to increase rigidity in the connection between the leg assembly and the arch assembly and to limit side-to-side sway between the two assemblies. Referring also to FIG. 7, the leg assembly 12 cover 40 can be removed to gain access to hole 88.

Figure 50:
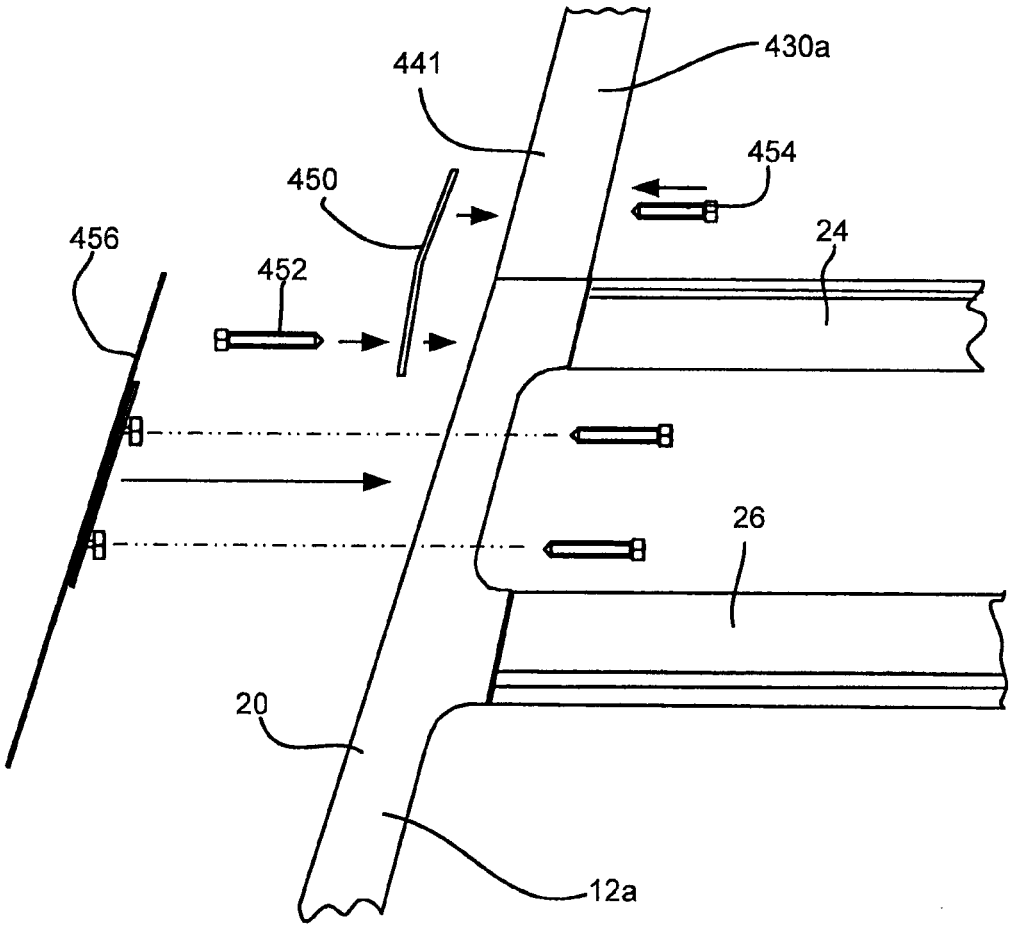
FIG. 50 is a partially exploded view of an arch attachment mechanism that is consistent with at least some aspects of the present invention.
Figure 51:
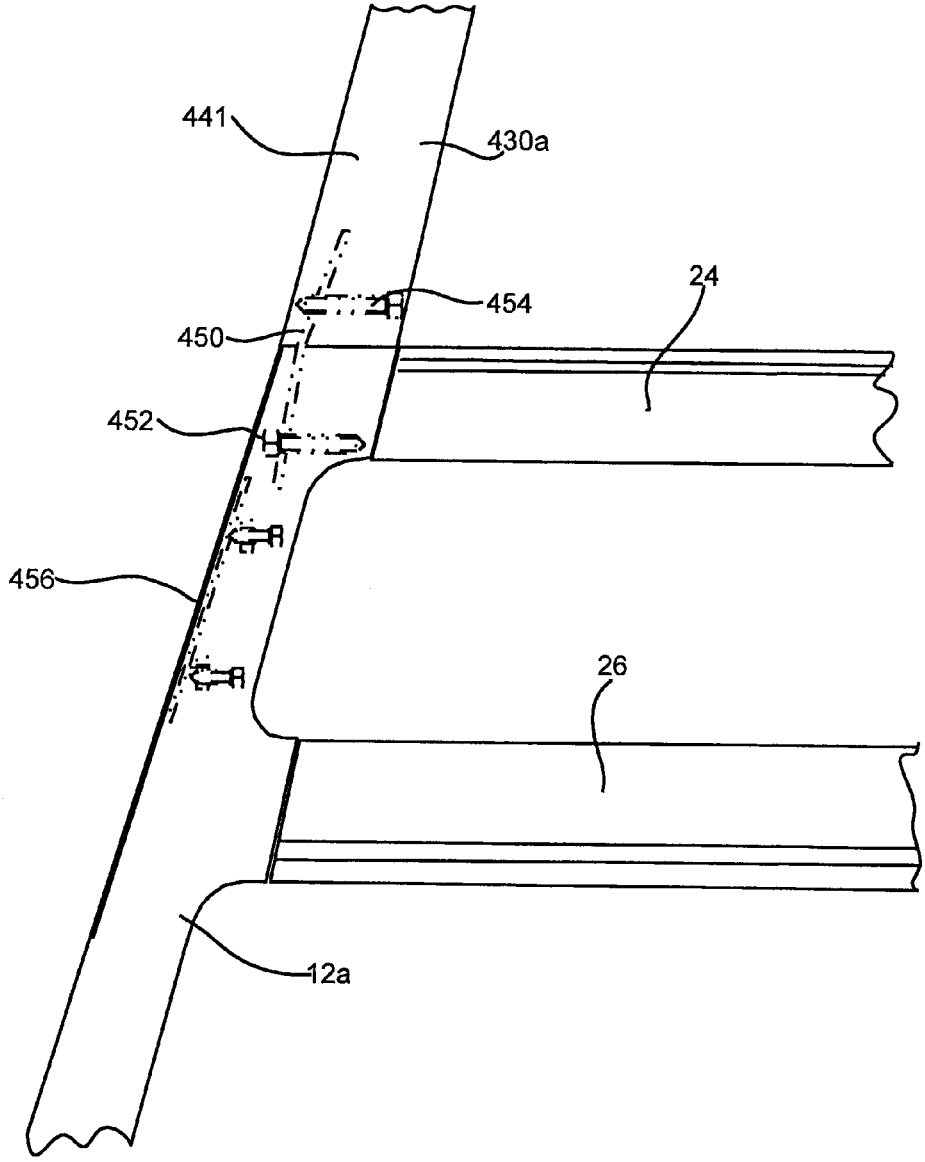
FIG. 51 is similar to FIG. 50, albeit showing the attachment mechanism assembled.

Referring to FIG. 50, a rigid metal bracket 451 and arch mounting screws 452 and 454 are provided. Bracket 451 mounts at one end via screw 452 to hole 88 (see again FIG. 6) where the lower end of bracket 450 is aligned with hole 88 via ribs 67, 71, 73. The top end of arch mounting bracket 450 passes through top slot 90 (see FIG. 6) and is inserted into a slot in the lower end of vertical member 440. Screw 454 is used to lock the bracket 450 to member 440. Next, a second cover member 456 that is designed for use when arch assembly is attached to the leg assembly 12 to close the space formed at the top of vertical leg member 20. FIG. 51 shows the arch/leg assembly connection in phantom.

Figure 52:
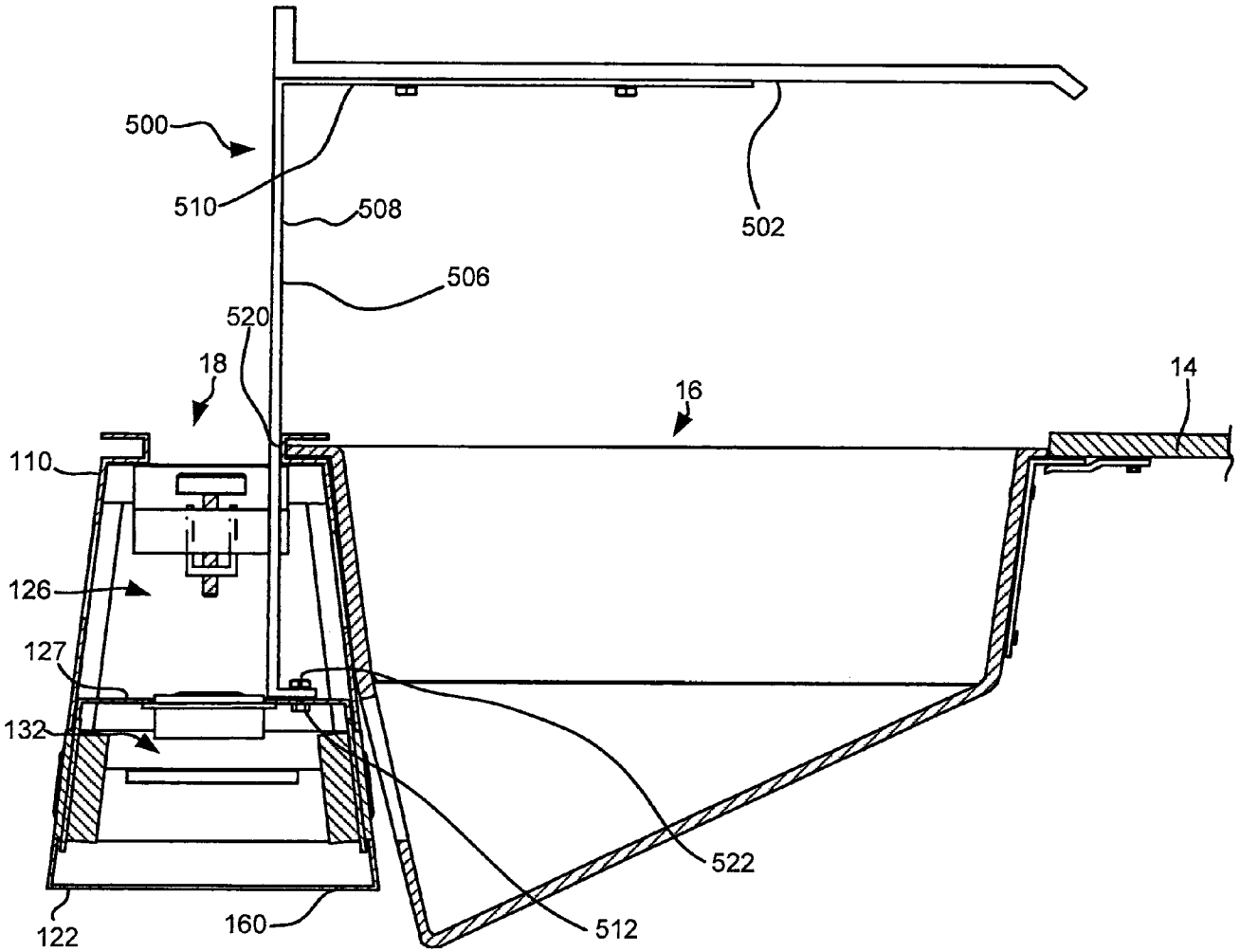
FIG. 52 is a partial cross-sectional view taken along the line 52-52 in FIG. 32 showing a channel mounted shelf assembly.
Figure 53:
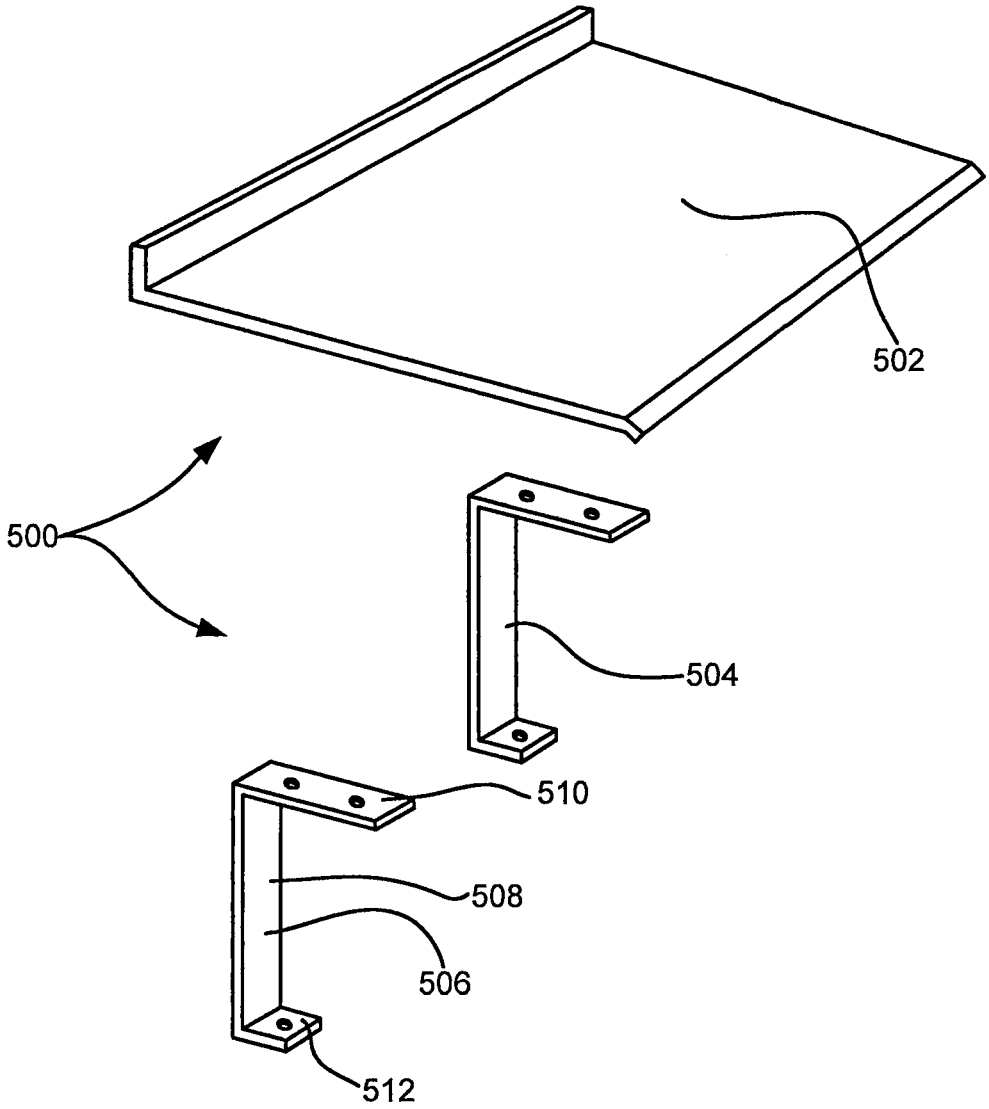
FIG. 53 is an exploded perspective view of the shelf assembly shown in FIG. 52.

Referring again to FIG. 32 and also to FIG. 52, a shelf assembly 500 for providing an over trough shelf is shown mounted within channel 126 formed by channel assembly 18. Referring also to FIG. 9, pairs of mounting holes 670 (shown in phantom) are provided within the intermediate wall 127 of channel housing 110. In the illustrated example six hole pairs 670 are shown, three pairs adjacent each side wall of housing 110 where each three pairs include a left pair, a right pair and a center pair. Referring to FIG. 53, shelf assembly 500 includes a shelf member 502 and first and second brackets 504 and 506. Exemplary bracket 506 includes a foot member 512, a leg member 508 and an arm member 510 where the foot and arm members 512 and 510 extend from opposite ends of leg member 508 in the same direction and are perpendicular to leg member 58. Each of the foot and arm members 512 and 510 form mounting holes. Arm members 510 are longer than foot members 512. Shelf member 502 includes a top shelf surface and an undersurface.

Referring to FIG. 52, a lower end of each bracket 504 and 506 is mounted via a bolt 522 to one of the mounting holes 670 inside channel 126 with leg members 508 extending up and out of the channel housing 110. A surface of leg member 508 facing housing 110 provides additional support to leg member 508. Arm members 510 extend over trough member 16 and shelf member 502 is mounted to arm members 510 as shown in FIGS. 32 and 52. While not shown, two or three shelf assemblies may be mounted over each trough member in a table configuration in a side-by-side manner.

Figure 54:
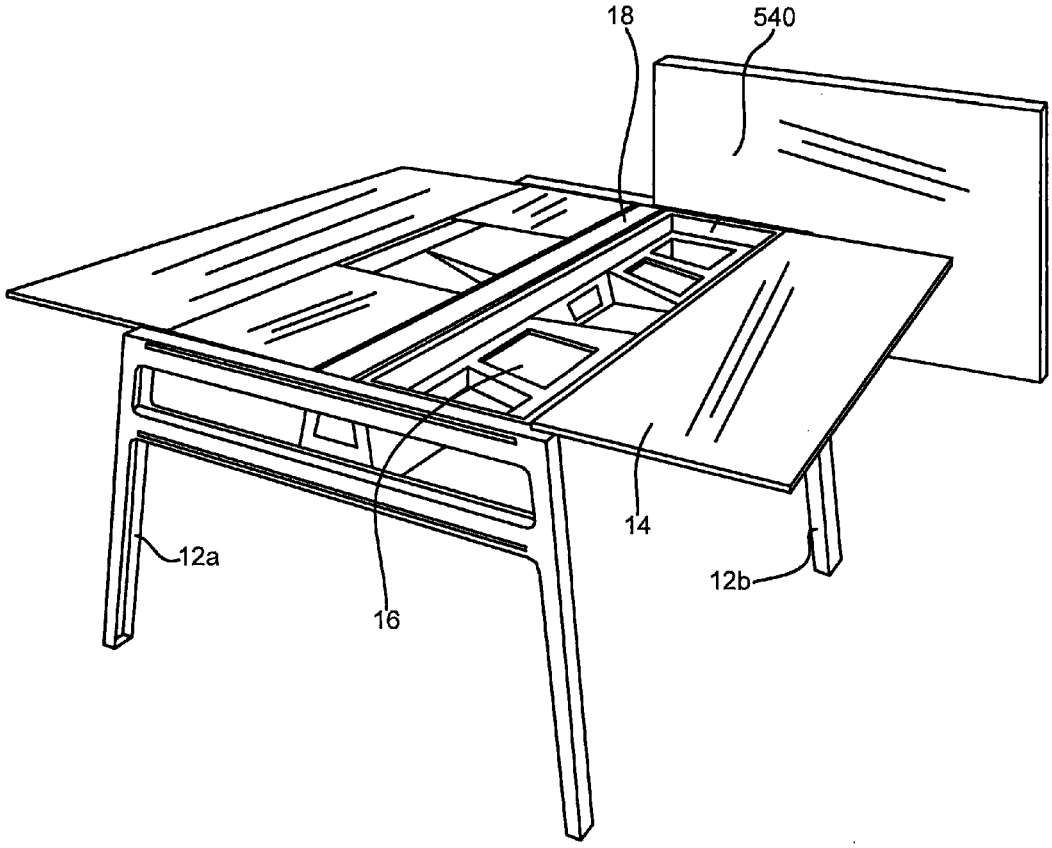
FIG. 54 is a perspective view of a table assembly similar to the table assembly shown in FIG. 33; albeit where a privacy screen assembly has been installed on one of the leg assembly.

Referring now to FIG. 54, yet one other accessory that may be provided in some table configurations includes a space dividing or privacy screen assembly 540 that can be mounted to either end of any of the leg assemblies described above. Referring also to FIGS. 55 through 57 and FIG. 23, exemplary screen assembly 540 includes a screen member 542, a bolting bracket member 548 and a clip type bracket member 550. Screen member 542 can be formed of any rigid and generally planar material. Illustrated screen member 542 is generally rectangular with a lower corner cut out to form a horizontal intermediate edge 544 and an angled intermediate edge 546. The angle between edges 544 and 546 is identical to the angle between the top surface 28 of one of the leg assemblies 12*a* and the front surface 22 of the same leg assembly 12*a* (see FIG. 3) so that after being installed, screen member 542 generally conforms to the top and front surfaces of the leg assembly.

Figure 55:
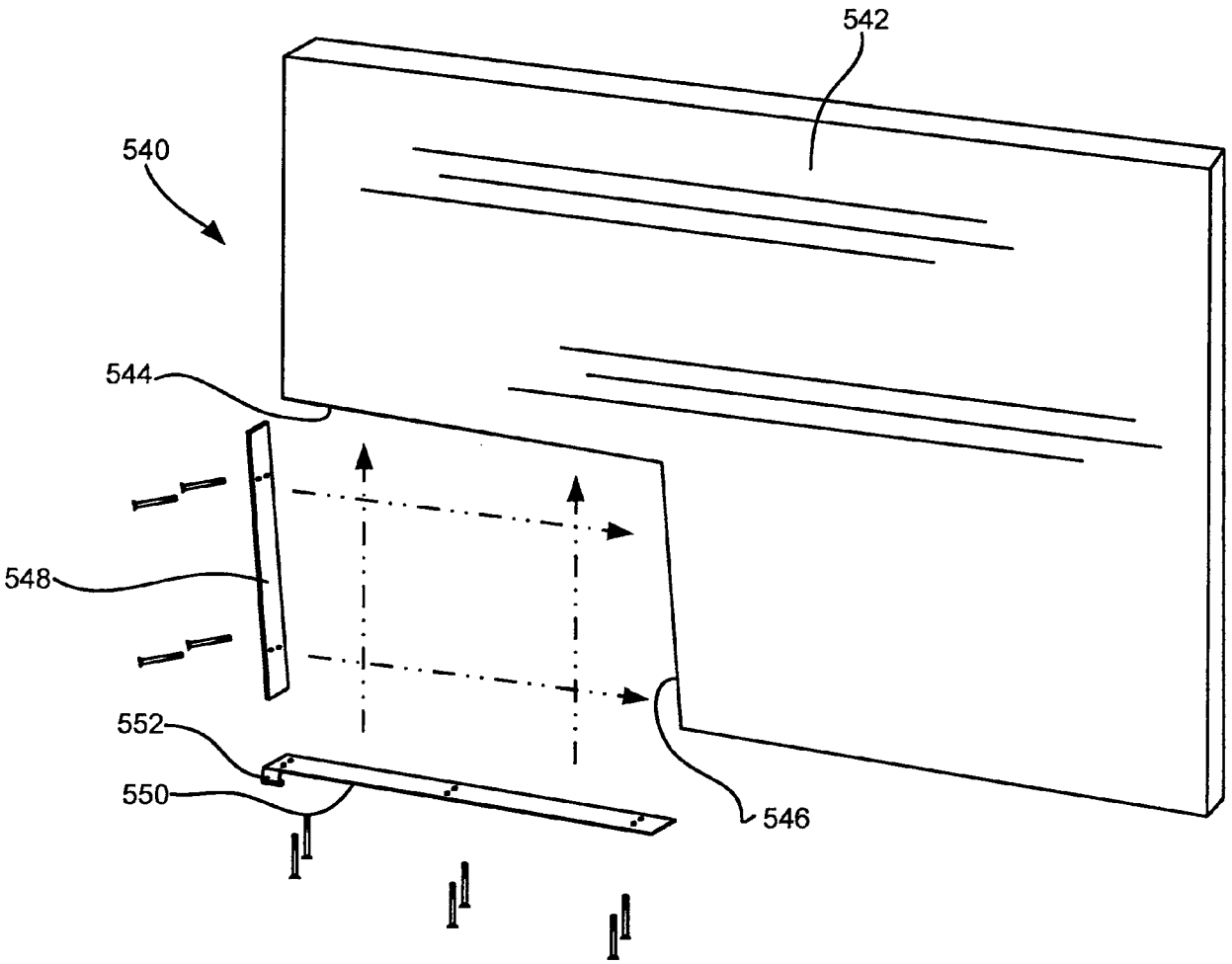
FIG. 55 is an exploded view of the screen assembly shown in FIG. 54.
Figure 56:
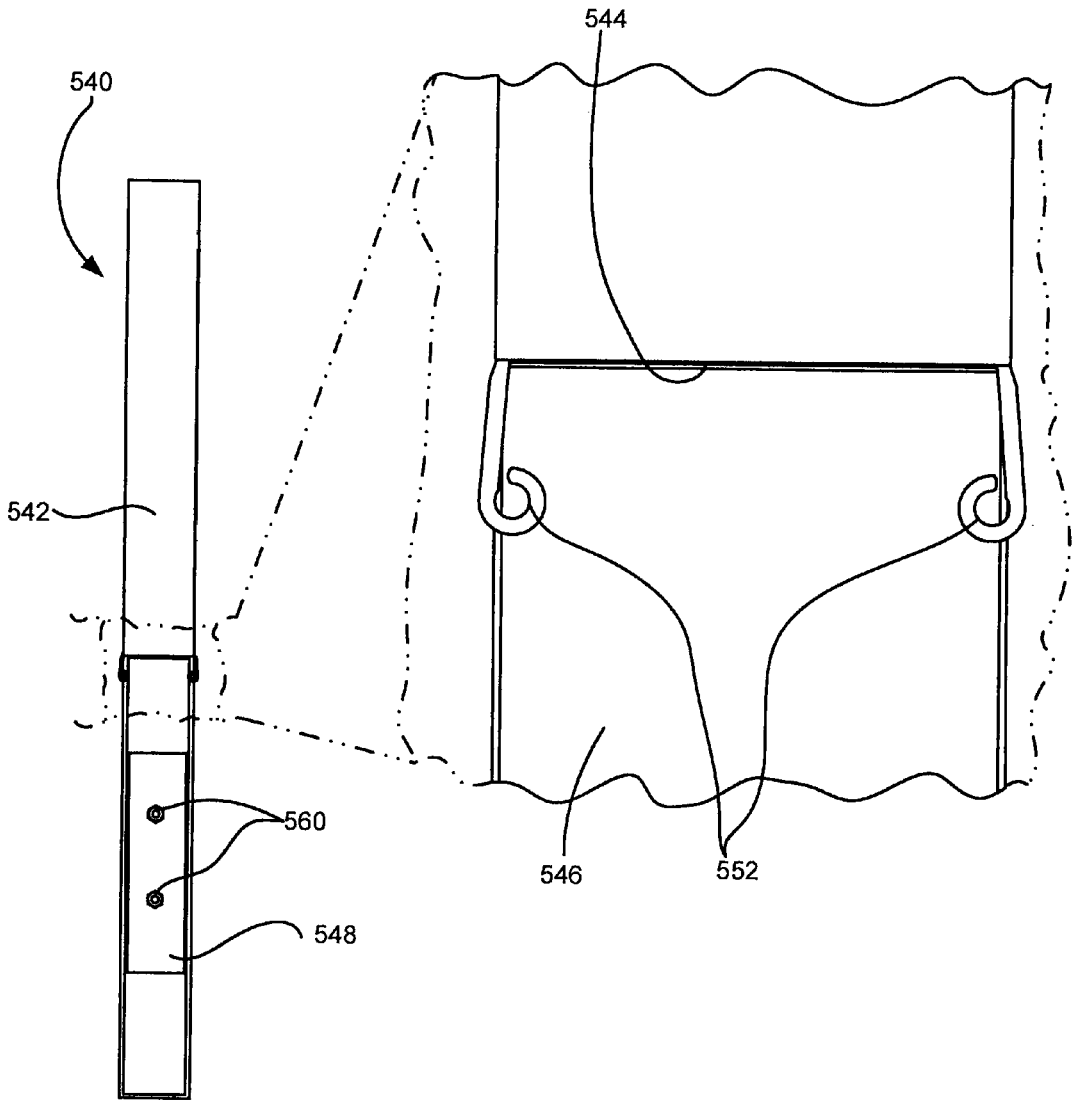
FIG. 56 is an end view of the screen assembly shown in FIG. 54.
Figure 57:
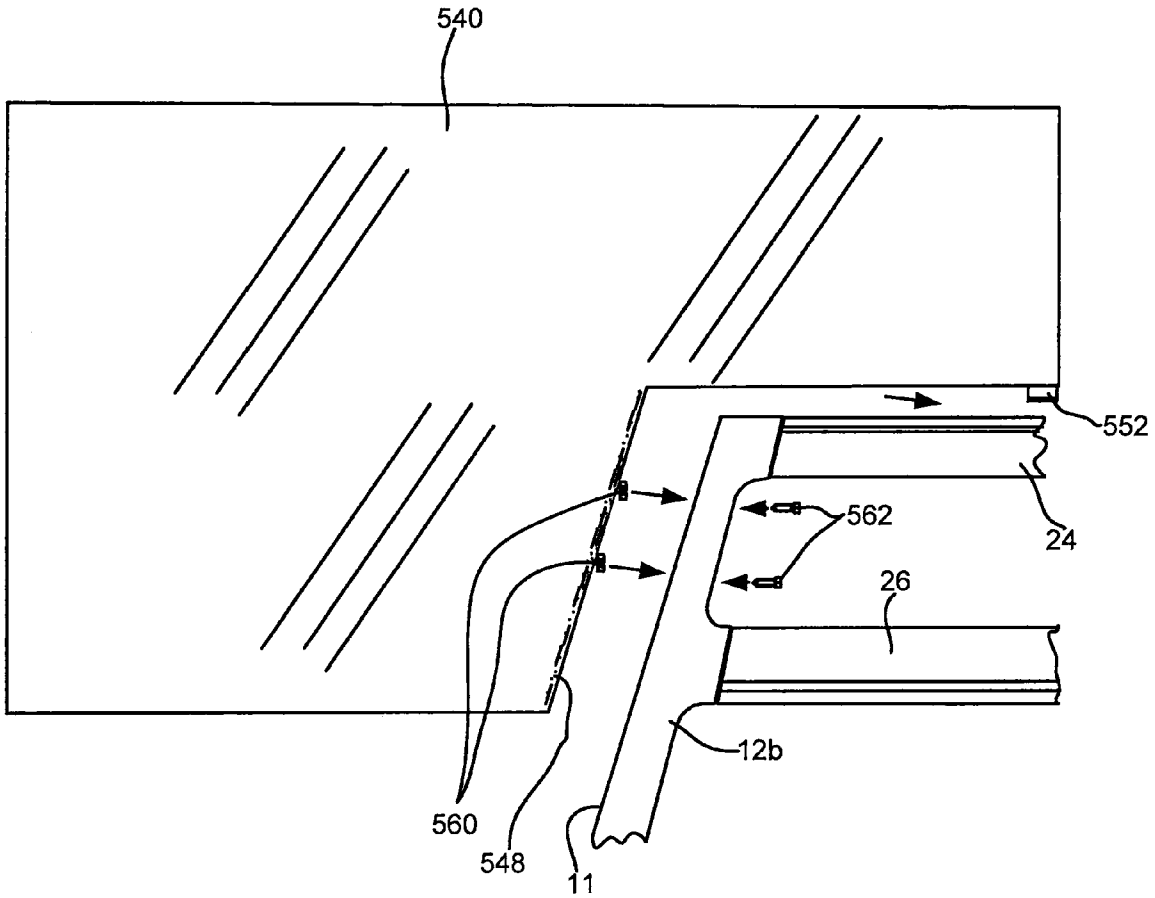
FIG. 57 is a side view of the screen assembly of FIG. 54 and a related leg assembly.

Referring still to FIGS. 55-57, bolting bracket 548 is a metal strip that is secured via screws, adhesive or some other means to angled edge 546. Bracket 548 forms posts 560 that form threaded openings that are sized and arranged to be identical to the mounting structure on the inside surface of one of the cover members described above (see again FIG. 7) so that bracket 548 and the associated screen assembly can be mounted to one of the leg assemblies 12*a* after a corner member has been removed.

Bracket 550 is an elongated rigid metal strip that includes two spring clip members 552 at one end. Clip members 552 are spaced apart a distance similar to the width of rail 24 (see again FIG. 23). Bracket 550 is screwed to, adhered to or otherwise attached to horizontal edge 544 of member 542 with clip members 552 extending downward therefrom at an end opposite the location of bolting bracket 548. In other embodiments members 548 and 550 may form a portion of a larger metal frame type screen structure.

To secure assembly 540 to a leg assembly 12*b*, referring to FIG. 57, assembly 540 is aligned along a side of leg assembly 12*b* and is forced downward until clip members 552 contact edges of top surface 28 and are forced apart. Assembly 540 is forced further downward until distal ends of clip members are received within oppositely opening slots 30 and 46 in top rail 24 (see FIG. 23). Assembly 540 is slid along top surface 28 until bracket 548 is adjacent an outer surface 11 of leg assembly 12*b* and screws 562 are passed through openings 86 and are received in post 560 holes. Thus, screws 562 and clips 552 cooperate to secure screen assembly 540 to leg assembly 12*b*.

Figure 58:
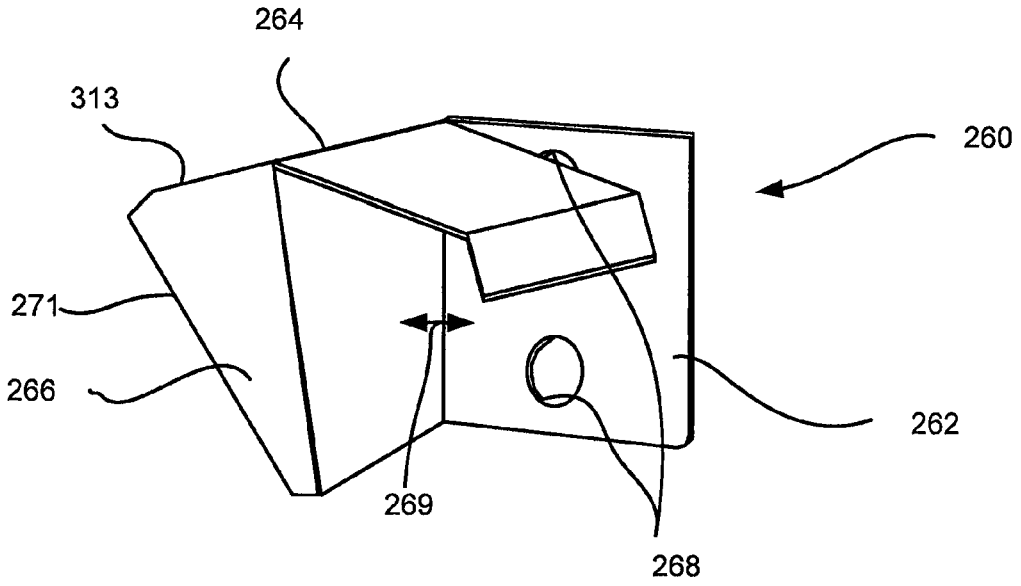
FIG. 58 is a perspective view of a latching bracket used to latch a trough member and/or a table top assembly a to a support arm members according to one additional aspect of the present disclosure.

While one way to secure a trough and a table top assembly to support arm members has been described above, other structure for accomplishing this task is also contemplated. To this end, an exemplary spring clip latching bracket 260 is shown in FIG. 58. Latching bracket 260 is an integrally formed resiliently flexible metal member that includes a mounting plate 262, a spring plate 264, a latch plate 266 and a handle member 271. Exemplary mounting plate 262 is rectilinear and forms two holes 268 for passing screws or bolts for mounting latching bracket 260 to trough member 16. Spring plate 264 extends from one of the long edges of mounting plate 262, is generally rectilinear and forms an obtuse angle with mounting plate 262. Latch plate 266 extends from one of the long edges of spring plate 264 opposite the edge that is attached to mounting plate 262 and generally has a triangular shape. A long edge opposite the edge attached to spring plate 264 forms a bearing edge 271. A short top edge of latch plate 266 forms a latch edge 270.

Latch plate 270 generally extends from spring plate 264 in a direction opposite the direction in which mounting plate 262 extends. Handle member 273 is attached along an upper short edge of spring plate 264 and generally extends to the same side of spring plate 264 as does mounting plate 262. While spring plate 264 has a steady-state configuration as shown in FIG. 58, as the label implies, spring plate 264 can be resiliently deformed by temporarily bending as indicated by arrow 269. To this end, when a force is applied along edge 271, spring plate 264 tends to bend generally toward mounting plate 262. Similarly, when force is applied to handle member 273 tending to move member 273 toward plate member 262, spring plate 264 likewise moves towards member 262.

Figure 59:
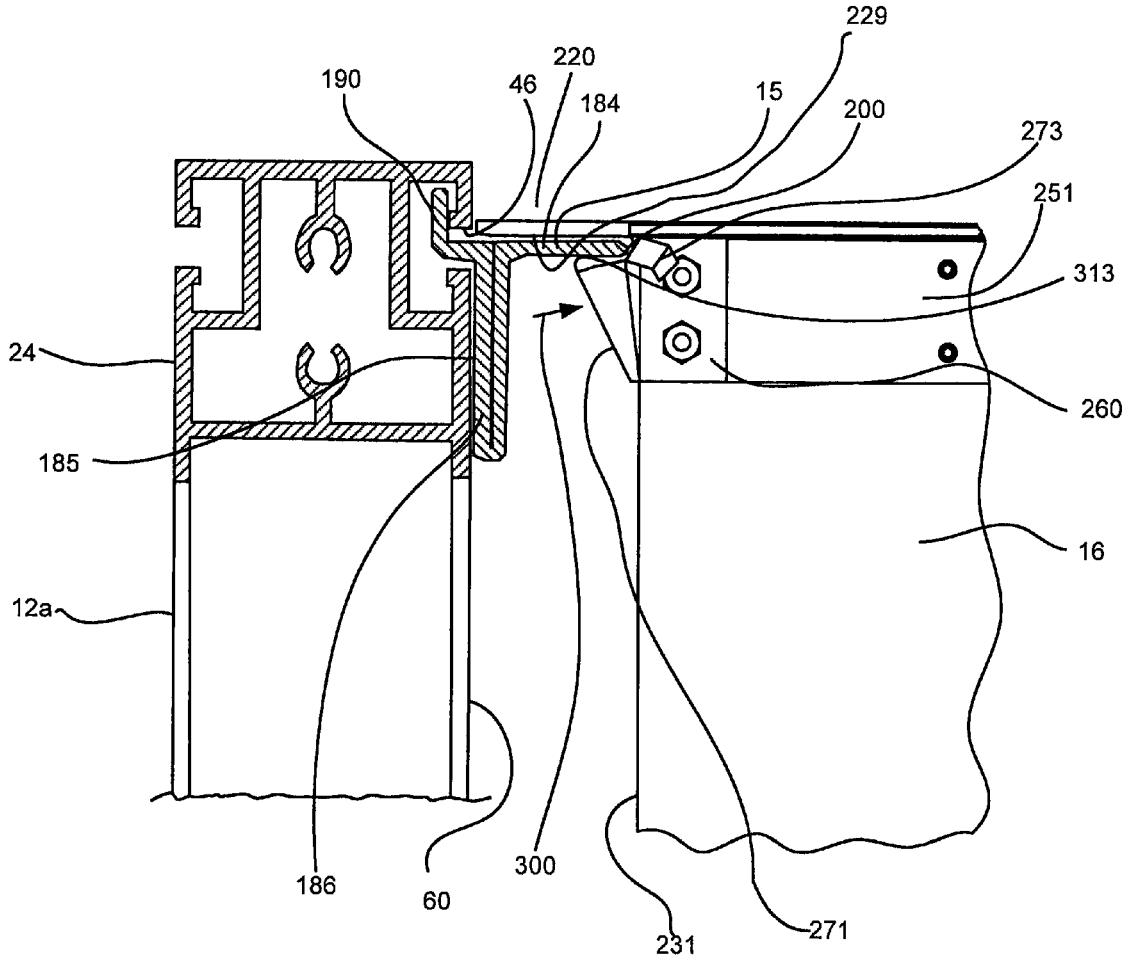
FIG. 59 shows the bracket of FIG. 58 latching a trough member to a support arm member.

Referring now to FIG. 59, an exemplary latching bracket 260 is shown mounted to an external surface of trough member 16 at one end of metal stringer member 251. As shown, latch plate 266 extends past an external surface of side wall member 231 and generally under a bottom surface of the trough lip member 220. Referring also to FIG. 14, the exemplary latching bracket shown in FIG. 59 is mounted generally at the location indicated by numeral 197. Although not shown in detail, a second latching bracket 260 is mounted at the second end 218 of trough member 16 in the area indicated by numeral 680 for interacting with the second arm support member 15 upon assembly.

Where brackets 260 are mounted to a trough member 16, to secure the trough member 16 to a channel assembly 16 and support arm members 15, after the rear portion of lip member 220 is received in channel 148 (see FIG. 26 again), the front edge portion of trough member 16 is lowered until the bearing edges 271 of latching brackets 260 contact adjacent edges 200 of shelf members 180 (see again FIG. 12). As the trough member 16 is forced downward, edges 200 apply a force to bearing surfaces 271 causing spring plates 269 to temporarily deform until latch members 266 clear edges 200. Once members 266 clears edges 200, spring plates 269 springs back to their steady-state positions and members 184 are sandwiched between latch edges 313 and the undersurfaces 229 of the lip member 220.

Bracket 260 in FIG. 58 can also be used as part of a different coupling assembly to mount table top assembly 14 to support arm members 15. To this end, referring to FIG. 60, an exemplary coupling assembly 280 includes a bracket 260*a* akin to bracket 260 illustrated in FIG. 58 and described above as well as a pin member 282. Like bracket 260 described above, bracket 260*a* includes a handle 273*a*, a latch edge 270*a* and a bearing edge 271*a*. Bracket 260*a* is mounted to strengthening runner 276 adjacent edge 451 with latch edge 270*a* generally facing the undersurface 270 of top member 279. In this embodiment a pin 282 is mounted to undersurface 270 and extends therefrom adjacent latching bracket 260*a*.

Figure 60:
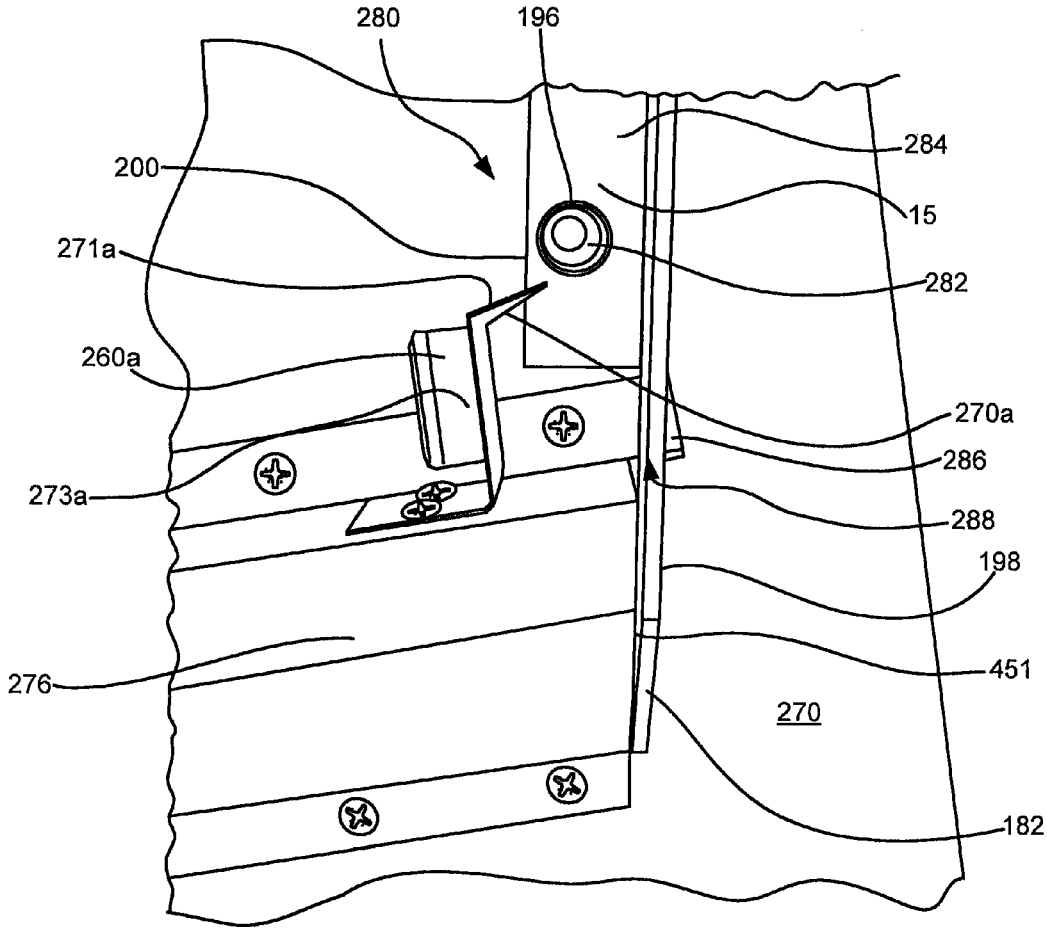
FIG. 60 shows one of the latching brackets of FIG. 58 latching a table top assembly to a support arm member according to another embodiment of the present disclosure.

Referring still to FIG. 60, again to FIG. 12, coupling assembly 280 components are mounted relative to each other such that, upon assembly of the configuration shown in FIG. 1, distal ends of the arm support members 15 are generally aligned with the coupling assemblies 280 and cooperate therewith to secure the table top member 279 to the support arm members 15. To this end, generally, as seen in FIG. 60, upon assembly, finger member 198 at the distal end of one of the support arm members 15 is received within slot 288 formed between edge 451 and the facing edge of finger member 286, pin 282 is received within hole 196 and shelf support member 184 is sandwiched between latch edge 270*a* and the undersurface 270 of the table top member. When so attached, the top member cannot be removed unless an assembly user affirmatively de-latches the latching bracket 260*a* by forcing handle member 273*a* into the unlatched position.

To secure a table top assembly 14 that includes brackets 260*a* to the support arm members 15, as the front edge of the table assembly 14 is lowered, bearing edges 271*a* of brackets 260*a* contact edges 200 formed by arm members 15 (see again FIG. 12) and force is applied through the bearing surfaces 271*a* to the spring plates that form part of brackets 260*a* causing the spring plates to deform until the latch members of the brackets 260*a* clear edges 200. After the latch members clear edges 200, the spring plates spring back into their steady-state positions and members 284 are sandwiched between undersurface 270 of the top member and the latch edge 270*a*.

While the invention may be susceptible to various modifications and alternative forms, specific embodiments have been shown by way of example in the drawings and have been described in detail herein. However, it should be understood that the invention is not intended to be limited to the particular forms disclosed. For example, while the embodiments described above each include a channel assembly 18, it should be appreciated that at least some embodiments may include a rigid rail as opposed to a channel forming member where the rail is slidably mounted at opposite ends to facing leg assembly slots. In this case, separate wire management structure could be mounted to undersurface of table tops. As another example, the leg assemblies may form coupling or support surfaces other than lip members for channel/rail attachment in at least some embodiments.

As still one other example, many other multiple person work station configurations can be constructed using the components described above. For example, referring now to FIG. 61, another configuration 580 is illustrated that includes three separate work station spaces. In configuration 580, the work stations all generally face in the same direction but they are staggered side-by-side. The components that are used to provide configuration 580 include all the components described above with respect to configuration 10 shown in FIG. 1 as well as other station subassemblies 10*a* and 10*b*. Subassembly 10*a* includes a third leg assembly 12*c*, a second table top assembly 14*a*, a second channel assembly 18*a* and a second trough member 16*a*. Similarly, subassembly 10*b* includes a fourth leg assembly 12*d*, a third table top assembly 14*b*, a third channel assembly 18*b* and a third trough member 16*b*. As shown, first channel assembly 18 is mounted at one end to a rear portion of leg assembly 12*a* and at the opposite end centrally to leg assembly 12*b* with trough member 16 and table top assembly 14 arranged to a forward side of channel assembly 18. Thus, while table top assembly 14 resided generally along one of the side surfaces of leg assembly 12*a*, table top assembly 14 is cantilevered generally to a front side of leg assembly 12*b*.

Figure 61:
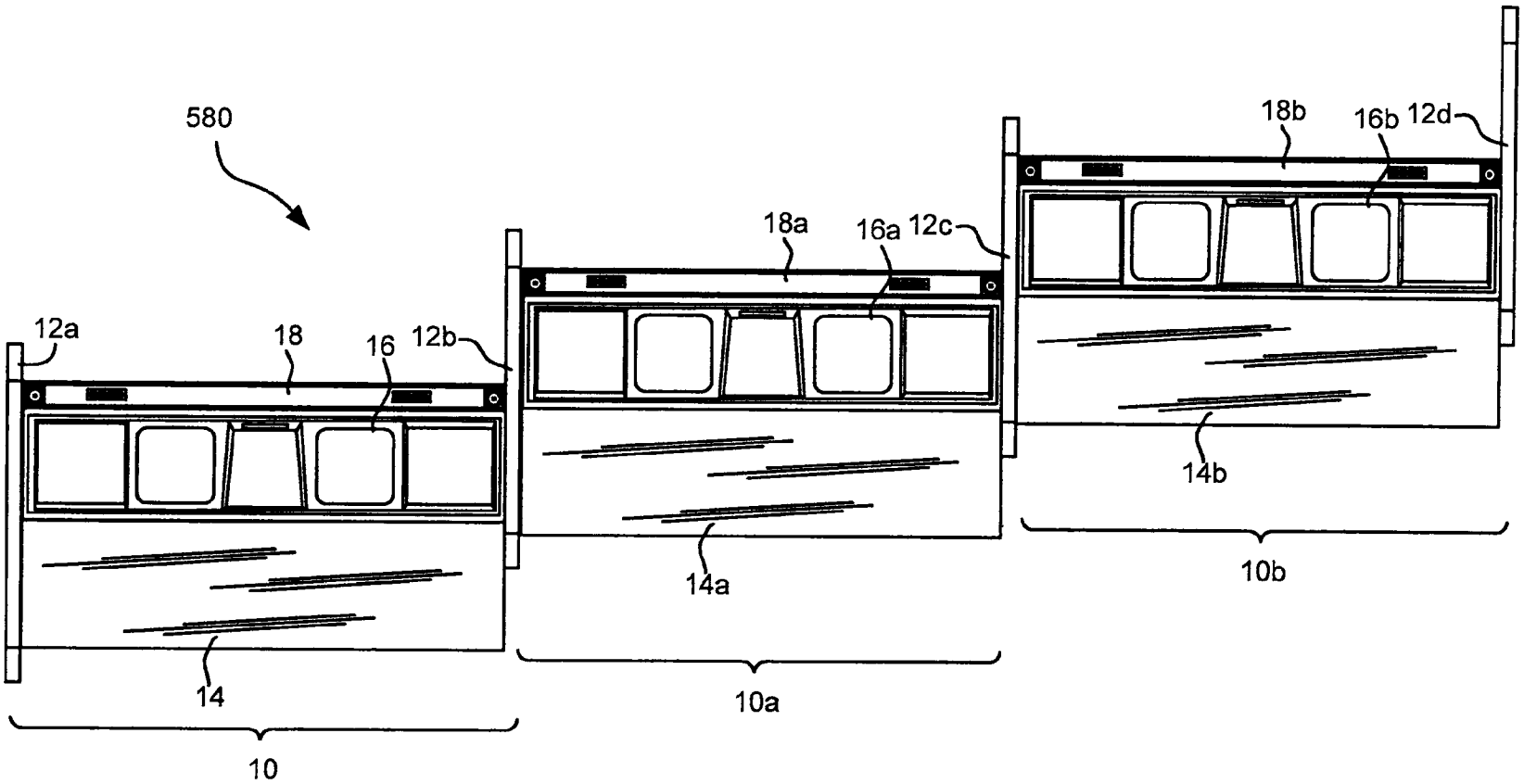
FIG. 61 shows a top plan view of three single person staggered work stations according to another embodiment of the present disclosure.

Referring still to FIG. 61, similarly, second channel assembly 18*a* is mounted at one end to a rear portion of second leg assembly 12*b* and centrally to third leg assembly 12*c* so that second table top assembly 14*a* is positioned to one side of leg assembly 12*b* and is cantilevered generally in front of third leg assembly 12*c*. Channel assembly 18*b* is mounted at one end to a rear portion of third leg assembly 12*c* and centrally to fourth leg assembly 12*d* in a fashion similar to that described above with respect to channel assemblies 18 and 18*a*.

Referring still to FIG. 61, the end result of attaching the components described above in the fashion described above is that the three work stations are staggered one from the other. In this configuration 580, channel assemblies 18, 18*a* and 18*b* are misaligned. Nevertheless, again, because each of the channel assemblies 18, 18*a* and 18*b* is open at its opposite ends and the channel assembly openings are open to the large leg assembly openings 38 (see again FIG. 1), power and data wires and cables can be routed from one channel assembly through the leg opening 38 to an adjacent one of the channel assemblies.

Figure 62:
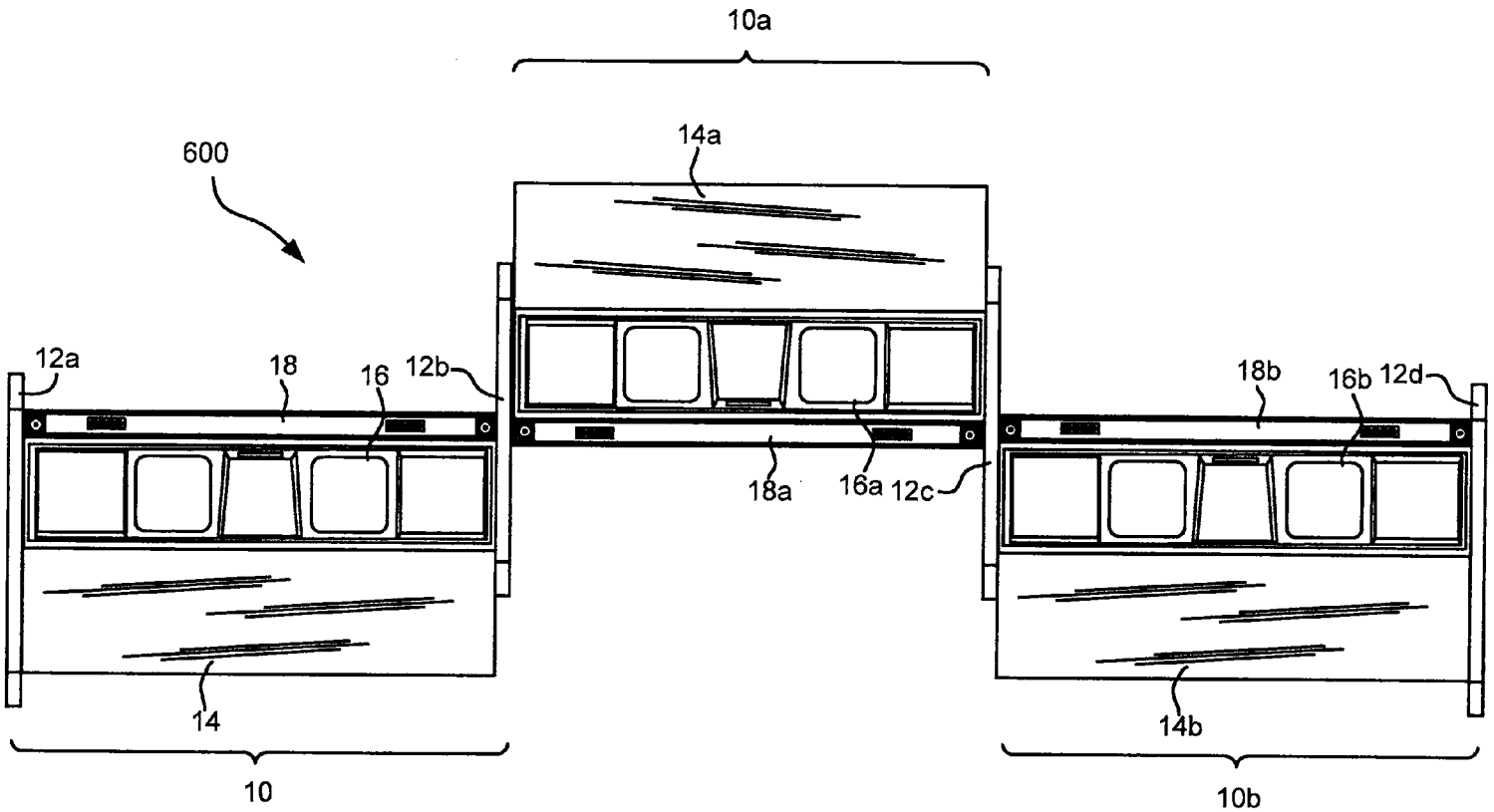
FIG. 62 shown a top plan view of three single person work stations in another staggered configuration.

Referring now to FIG. 62, one additional exemplary configuration 600 is illustrated that includes components for configuring three separate work stations. Here, adjacent work stations are staggered but face in opposite directions. To this end, exemplary configuration 600 includes one work station having all of the components described above with respect to configuration 10 shown in FIG. 1 as well as second and third work station subassemblies 10*a* and 10*b*. Subassembly 10*a* includes a third leg assembly 12*c*, a second channel assembly 18*a*, a second trough member 16*a* and a second table top assembly 14*a* while subassembly 10*b* includes a fourth leg assembly 12*d*, a third channel assembly 18*b*, a third trough member 16*b* and a third table top assembly 14*b*.

Referring still to FIG. 62, first channel assembly 18 is mounted at one end to a rear portion of first leg assembly 12*a* and centrally to second leg assembly 12*b* with first trough member 16 and first table top assembly 14 mounted to a forward side of channel assembly 18. Second channel assembly 18*a* is centrally mounted to each of second leg assembly 12*b* and third leg assembly 12*c* with second trough member 16*a* and second table top assembly 14*a* mounted to a rearward side of assembly 18*a*. Third channel assembly 18*b* is centrally mounted to third leg assembly 12*c* and to a rear portion of fourth leg assembly 12*d* with third trough member 16*b* and third table top assembly 14*b* supported to a front side of channel assembly 18*b*. Thus, as shown, all of the channel assemblies 18, 18*a*, and 18*b* are aligned with the first and third work stations corresponding to table top assemblies 14 and 14*b* located to the front side of the channel assemblies and the second or middle work station corresponding to table top assembly 14*a* located rearward of the channel assemblies.

Figure 63:
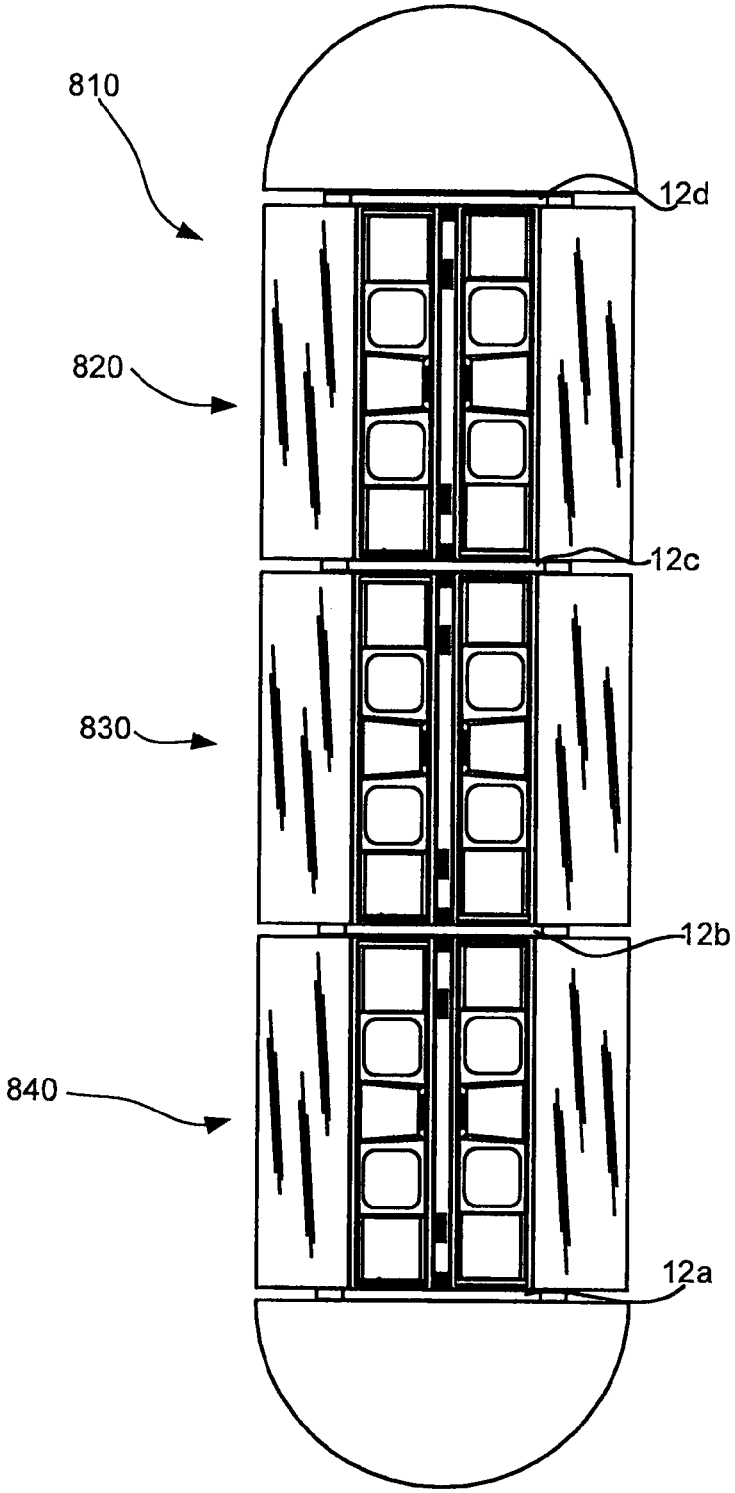
FIG. 63 is a top plan view of a six station configuration consistent with at least some aspects of the present invention.

One additional configuration 810 is shown in FIG. 63 that includes components to configure three pairs of face-to-face workstations 820, 830, 840 and two half-round end tables 850 and 860 supported by four leg assemblies 12*a*, 12*b*, 12*c* and 12*d* where all of the top surfaces of the table tops, end tables, leg members and channel assemblies are at the same height.

Figure 64:
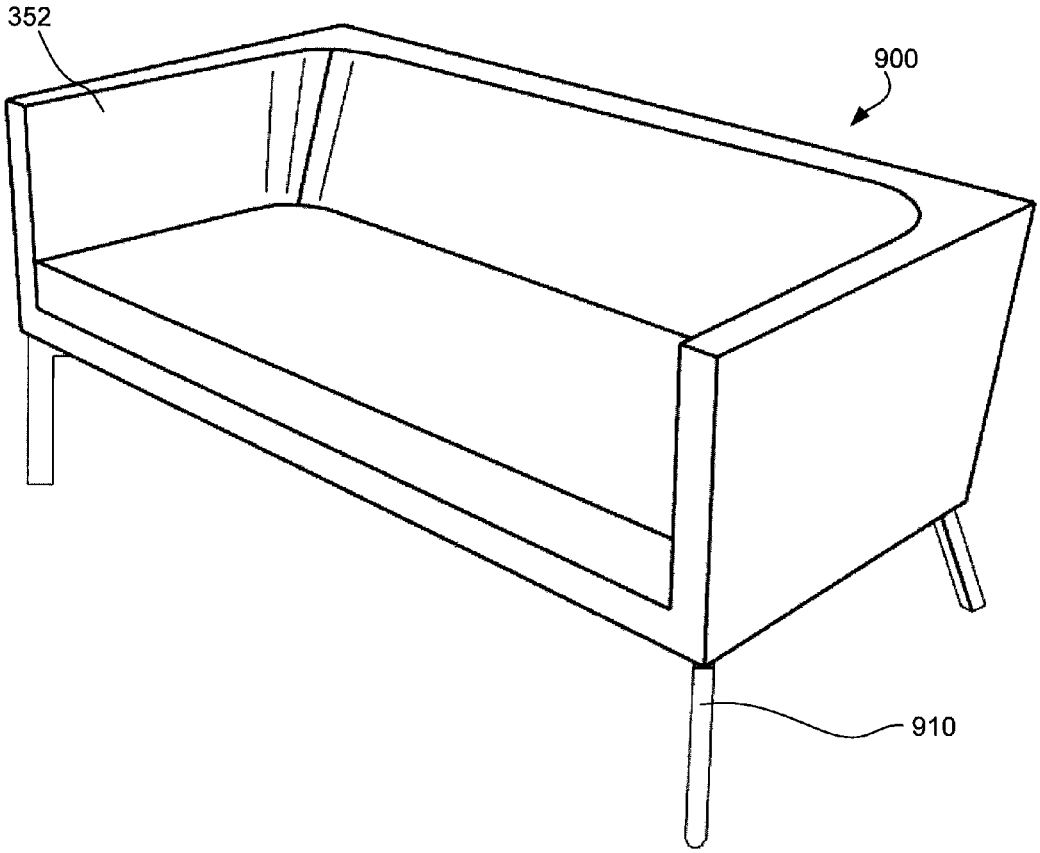
FIG. 64 is a perspective view of the lounge insert of FIG. 40, albeit supported by a lounge leg assembly as opposed to by a frame structure.
Figure 65:
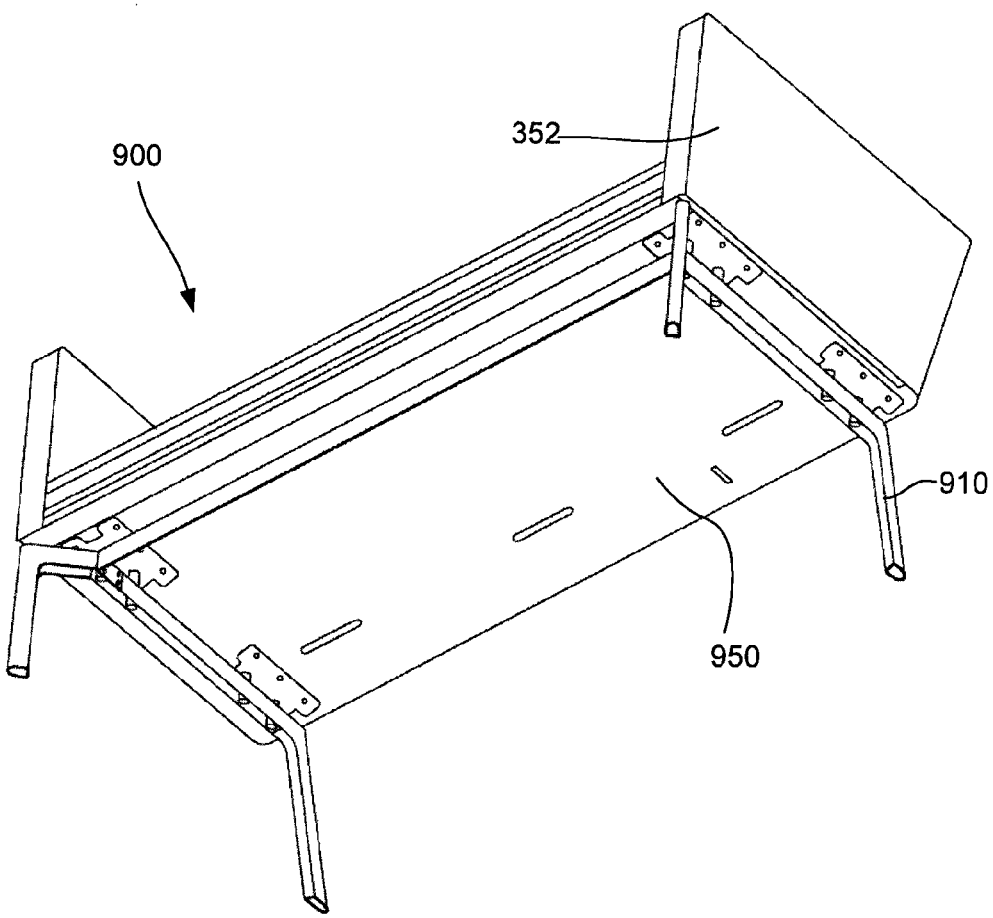
FIG. 65 is a lower perspective view of the lounge shown in FIG. 64.

While the lounge structure 352 is described above as being supported by frame leg assemblies 12*a* and 12*b* (see FIGS. 39 and 40 above), in at least some embodiment is contemplated that lounge structure 352 may be supported by an independent leg structure. To this end, one exemplary lounge configuration 900 where a lounge structure 352 is supported by a leg assembly 910 independent of leg assemblies 12*a* and 12*b* is shown in FIG. 64. Referring also to FIGS. 66-69, the exemplary leg support assembly 910 includes first and second end subassemblies 912*a* and 912*b* and a cross-bar 914. The first and second end subassemblies 912*a* and 912*b* are similarly constructed and operate in a similar fashion and therefore, in the interest of simplifying this explanation, only end subassembly 912*a* will be described here in detail.

Figure 68:
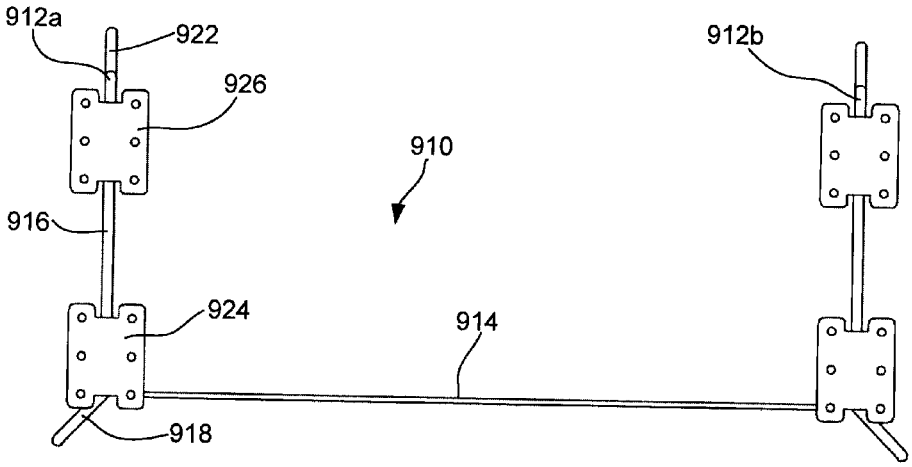
FIG. 68 is a top plan view of the leg structure shown in FIG. 66.
Figure 69:
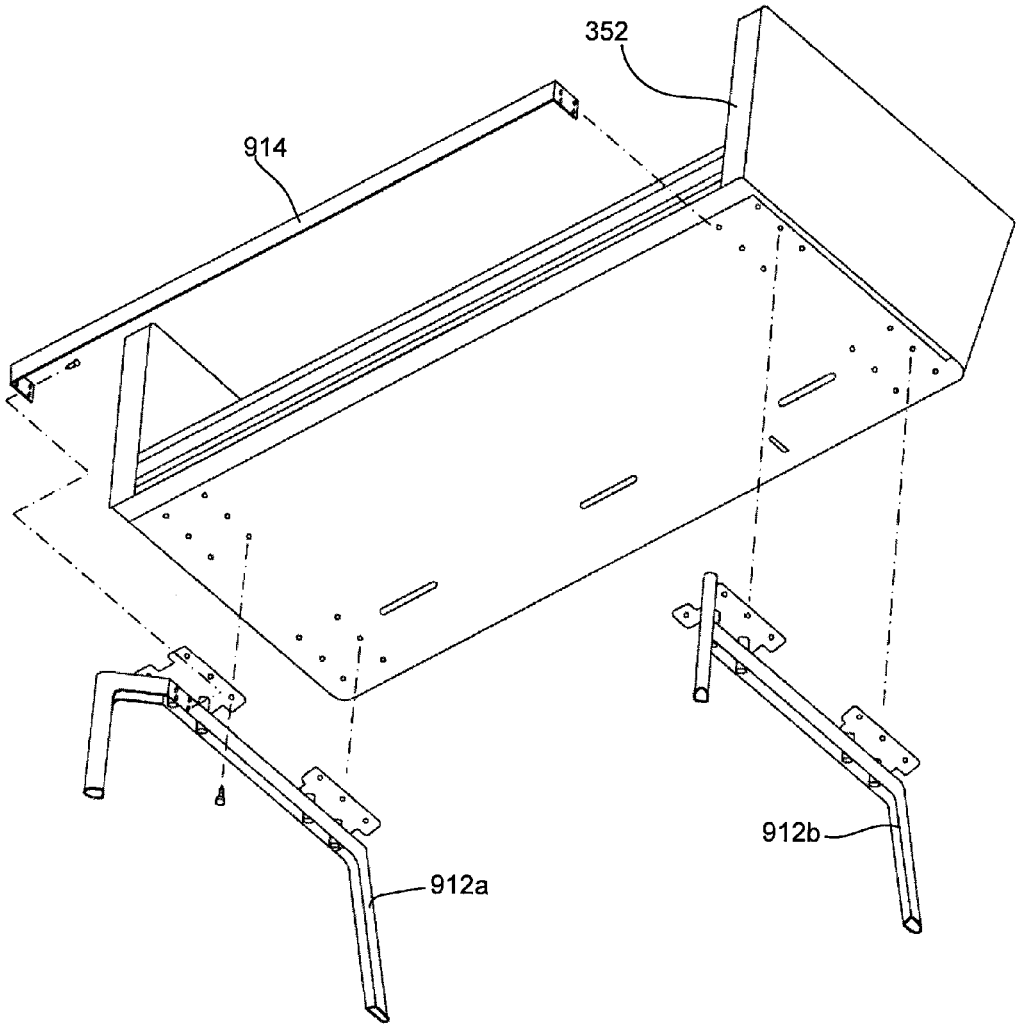
FIG. 69 is a lower exploded perspective view of the leg structure shown in FIG. 66.

End subassembly 912*a* includes first and second horizontal members 916 and 918, first and second leg members 920 and 922, standoff posts 928 and 930, and first and second mounting plates 924 and 926, respectively. The horizontal members 916 and 918 and front and rear leg members 920 and 922, respectively, are integrally formed. The first and second horizontal members 916 and 918 are connected at one end and form an obtuse angle (e.g., 135°) as best seen in FIG. 68. Front leg member 920 extends downward from an end of second horizontal member 918 opposite first horizontal member 916. Similarly, rear leg member 922 extends downward from an end of first horizontal member 916 opposite second horizontal member 918. The leg members 920 and 922 are dimensioned such that members 916 and 918 are substantially horizontal when end subassembly 910 is in an upright orientation as in FIG. 66. Standoff posts 928 and 930 extend upwardly from a top surface of first horizontal member 916 and support lounge mounting plates 924 and 926 thereabove. The top surfaces of plates 924 and 926 are slightly angled with respect to the top surface of member 916 as shown. Each of the plates 924 and 926 forms mounting holes therein for passing screws or bolts as will be described in greater detail below.

Figure 66:
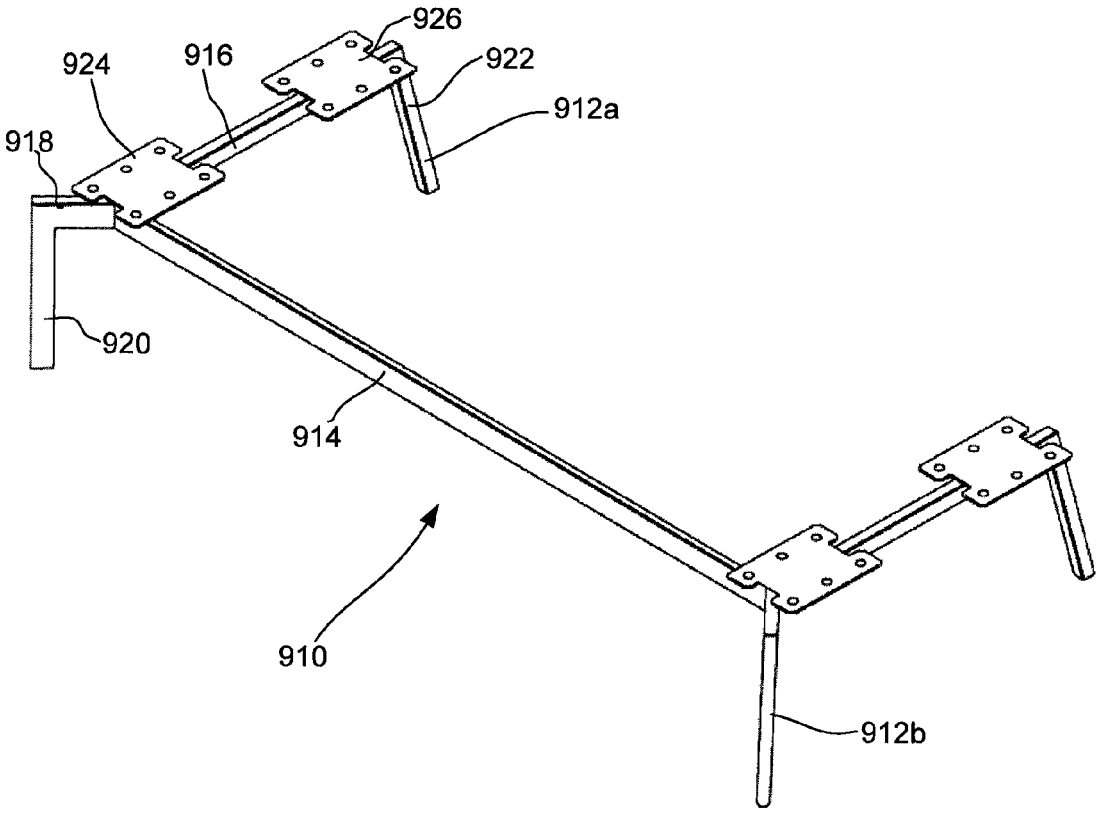
FIG. 66 is a perspective view of the leg structure shown in FIG. 64.
Figure 67:
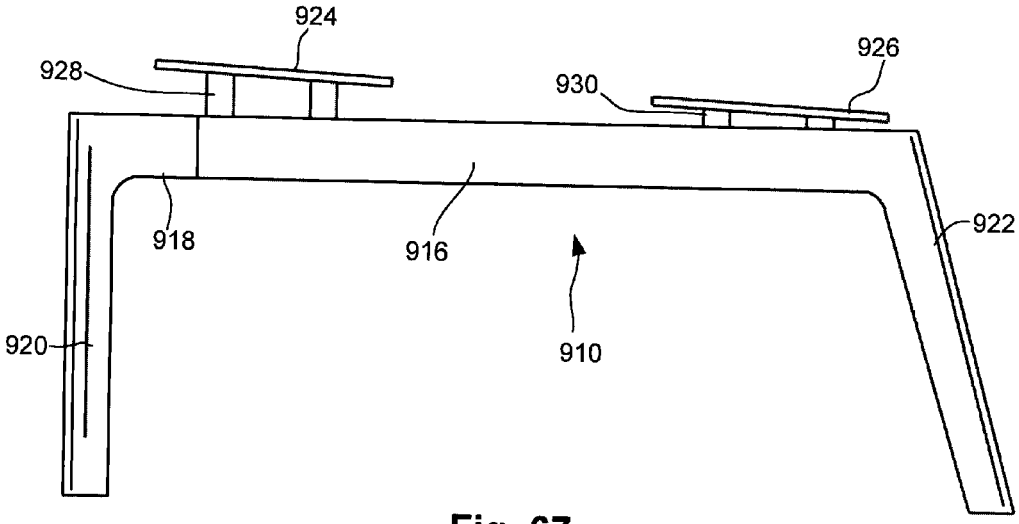
FIG. 67 is a side view of the leg structure shown in FIG. 66.

Cross-bar 914 is a rigid metal bar that, in general, is mounted to and traverses the distance between first horizontal members 916. More specifically, as illustrated in FIG. 66, cross-bar 914 mounts to front ends of horizontal members 916 adjacent the second horizontal members 918. Thus, once the end subassemblies 912*a* and 912*b* and cross-bar 914 are secured together, the combination is rigid and can stand independently as shown in FIG. 66. While some embodiments will include separate components 912*a*, 912*b* and 914 that are relatively easy to ship in small packages, it should be understood that other embodiments may include an integral component including all of subassemblies 912*a*, 912*b* and 914 welded or otherwise secured together in a more permanent fashion.

Threaded hole patterns (not labeled or illustrated) are provided in the undersurface 950 of lounge structure 352 that mirror the hole patterns of mounting plates 924 and 926. Thus, to mount lounge structure 352 to the leg support assembly 910, the structure 352 is simply positioned on top of plates 924 and 926 with the hole patterns aligned and screws or bolts are fed up through the plates 924 and 926 into the hole patterns formed by the undersurface 950. Thus, a single lounge insert 352 may be used with either the illustrated leg assembly 910 or with one of the frame assemblies as described in other embodiments above. To this end, hole patterns for mounting either the leg assembly 910 or frame hanging brackets as described above are both provided in the undersurface of insert 352.

In at least some embodiments the hanging brackets and leg assembly may be designed such that a subset of the holes in the underside of the lounge insert 352 used to mount the insert to the leg assembly may be used to mount the lounge to the hanging brackets to cut down on manufacturing costs as well as materials (e.g., where metal threaded inserts are provided in the undersurface holes).

Figure 70:
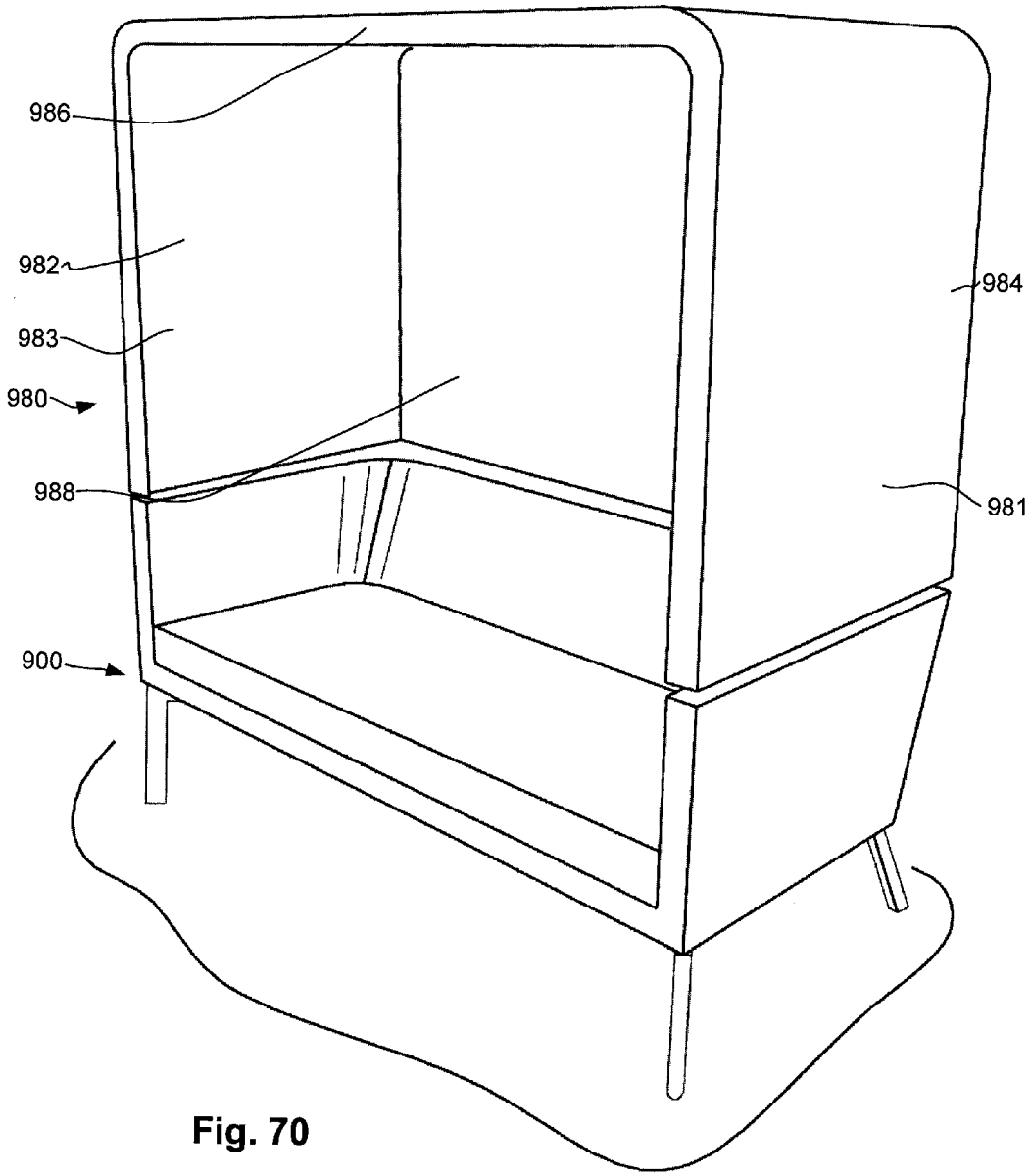
FIG. 70 is a perspective view of a lounge with an optional hood assembly attached thereto.

Referring now to FIG. 70, a lounge configuration 900 is shown with an optional hood assembly 980 mounted thereto. The hood assembly 980 includes a hood structure 981 as well as bracketry shown in FIGS. 72 through 76 for attaching the hood structure 981 to lounge configuration 900. In general, referring still to FIG. 70, the hood structure 981 includes a first side wall 982, a second side wall 984, a rear wall 988 and a ceiling wall 986, where the side walls 982 and 984 and rear wall 988 are dimensioned and sized so that when the structure 981 is mounted to lounge 900, the side walls and rear wall extend upwardly from the lounge arm structure and back rest structure, respectively. The ceiling wall 986, as the label implies, extends between the side walls 982 and 984 and to the top of the rear wall 988 thereby forming a "hood" above lounge 900 to provide a sense of privacy for persons using the lounge 900.

Figure 89:
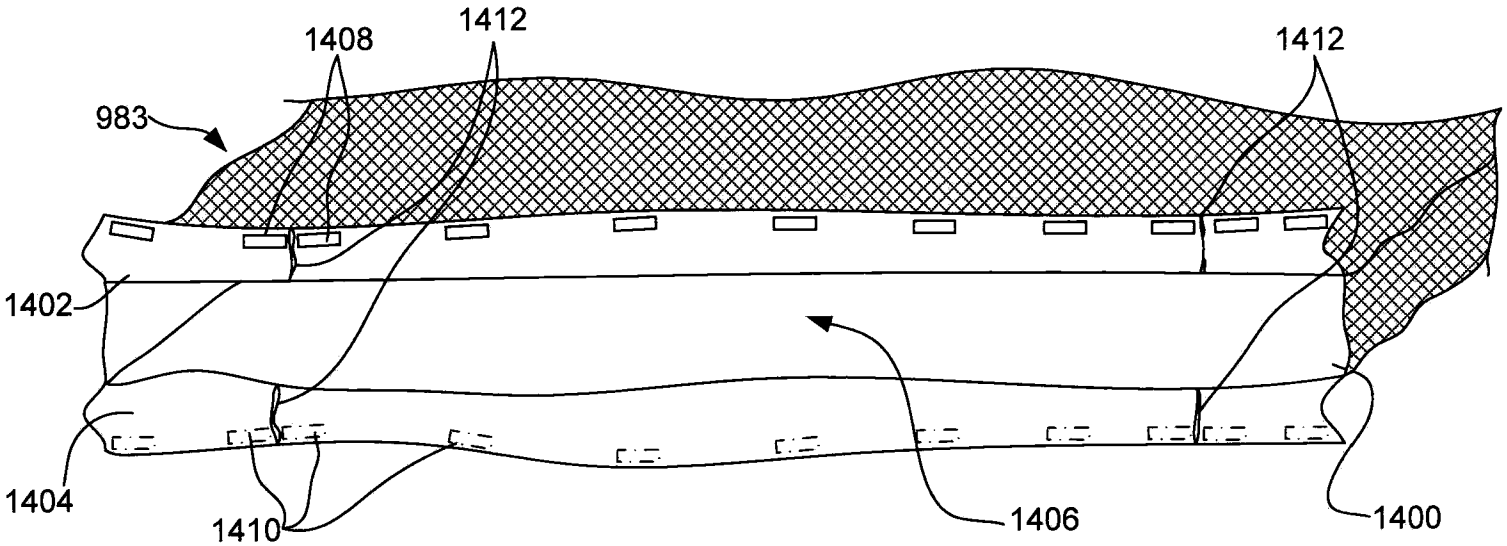
FIG. 89 is a perspective view of one end of the sock cover of FIG. 70, albeit with end flaps open to show a passage formed by the sock cover.

In at least some embodiments, the hood structure 981 is relatively light weight so that it can easily be lifted onto and removed from lounge 900 during installation. To this end, in at least some embodiments, hood structure 981 may be formed of a light weight rigid skeleton or frame structure with a fabric sock cover (see 983 in FIGS. 70 and 89) slid over the frame structure to provide the side and ceiling walls. In at least some cases it is contemplated that the sock cover would be tube shaped forming an internal passage 1406 and open at a first end 1400 (see FIG. 89) and a second end (not illustrated) to enable the sock to be slid on to the frame. The sock may be formed of a slightly stretchable material so that the sock fits on the frame smoothly and without any bunching. The sock may have dimensions such that the frame effectively stretches the sock after assembly. In at least some cases, referring to FIG. 89, the sock cover 983 will include end flaps 1402 and 1404 that form slits 1412 to accommodate mounting brackets below the frame structure and may include hook and loop strips 1408 and 1410 sewn to the flaps 1402 and 1404 so that the flaps can be fastened together to close the ends after the sock cover is slid on to the frame.

Other sock and closing structure is contemplated such as a zipper, snaps, buttons, etc. Rear wall 988 may be formed of a single layer of fabric installed via hook and loop material to the rear of the sock after the sock has been installed on the frame. Again, other fabric connecting structure is contemplated including but not limited to sewing, zippers, snaps, buttons, etc. In FIG. 70, the sock is identified by numeral 983. In at least some cases, the fabric used to form the sock 983 may be relatively light weight so as to enable a person sitting on the lounge 900 to have some capability to see through the side walls 982 and 984 after the sock has been installed while still affording a sense of privacy under the hood.

Figure 71:
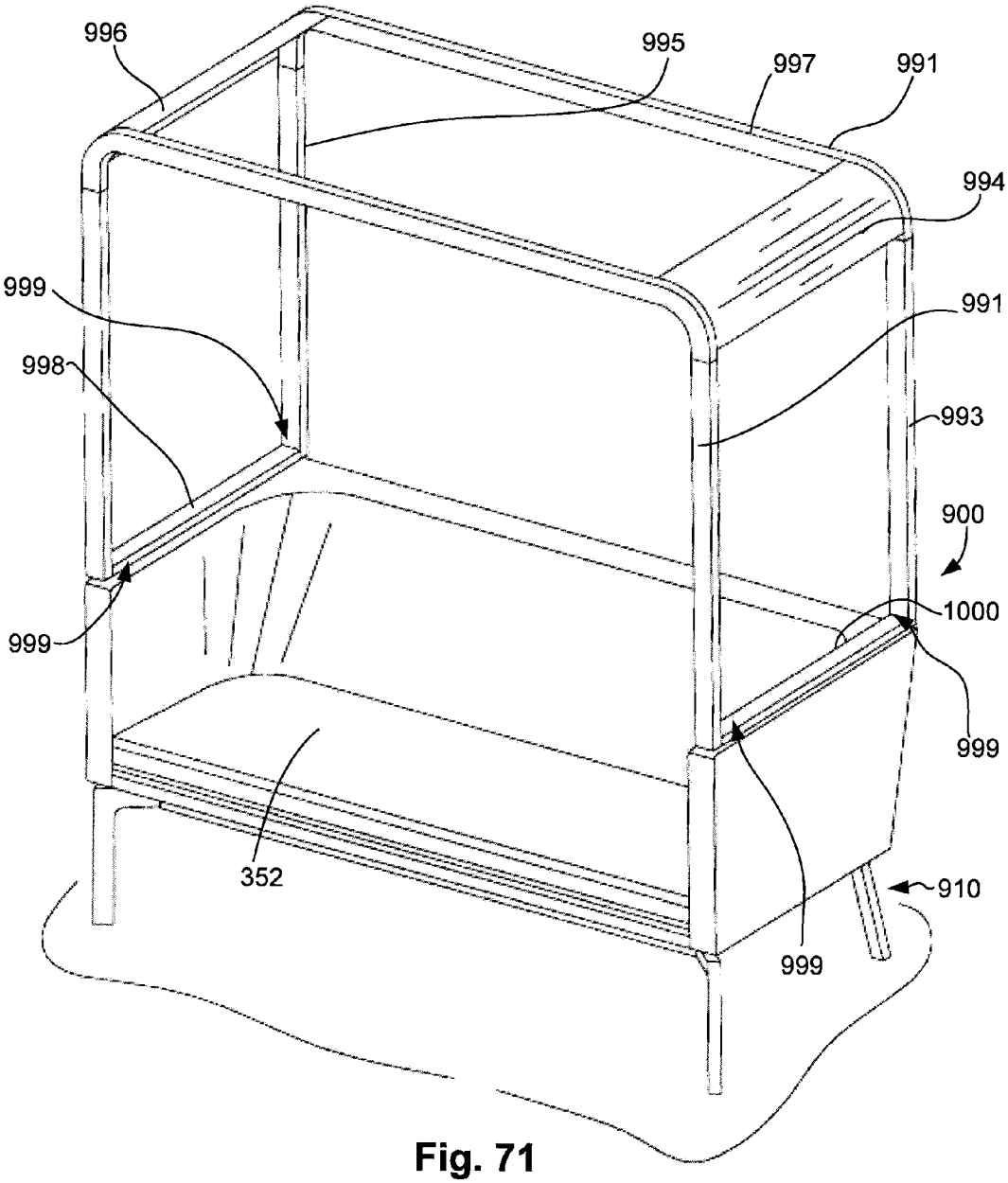
FIG. 71 is a perspective view showing an internal frame of the hood assembly of FIG. 70 mounted to a lounge.

Referring now to FIG. 71, an exemplary hood frame 991 is shown, albeit without the fabric sock, mounted to a lounge 900. The hood frame 991 includes a rear or first frame member 990, a front or second frame member 992, a first upper brace member 994, a second upper brace member 996, a first lower brace member 998 and a second lower brace member 1000. The rear frame member 990 is formed from an extruded rectilinear aluminum bar where the bar is bent at two locations so that the rear frame member 990 includes first and second vertical members 993 and 995 which are connected at their top ends by the integrally formed horizontal member 997. The member 990 is bent such that the bends each have a rounded appearance as shown in FIG. 71. In at least some embodiments, where the bar is relatively thick, small cuts (not shown) may be made to the side of the bar on the inside of each bend to enable the bend to be made without undue distortion to the structure of the bar. Front frame member 992 is formed in a fashion similar to that described above with respect to rear frame member 990.

The final appearance of the hood assembly 980 is directly related to the thickness of the front and rear frame members 990 and 992. Thus, for instance, where frame members 990 and 992 are relatively thicker, the resulting hood assembly 980 will have a heavier appearance as the frame thickness will affect the thickness of the hood assembly 980. In at least some embodiments it is contemplated that the frame thickness and hence hood assembly thickness may be anywhere between ½ inch and 2½ inches. In some embodiments the frame and hood assembly thickness will be approximately 1 inch.

Referring once again to FIG. 71, first upper brace member 994 is formed of sheet metal (e.g., aluminum, steel, etc.) which is bent to have a curvature similar to the curvature of the outer surface of each of the frame members 990 and 992 after the frame members have been bent. Second upper brace member 996 has a similar shape and construction. The upper brace members 994 and 996 are welded, epoxied or otherwise secured to the bent portions of the frame members 990 and 992 to support the sock 983 between the frame members 990 and 992 and to increase rigidity of the hood frame 991.

Figure 74:
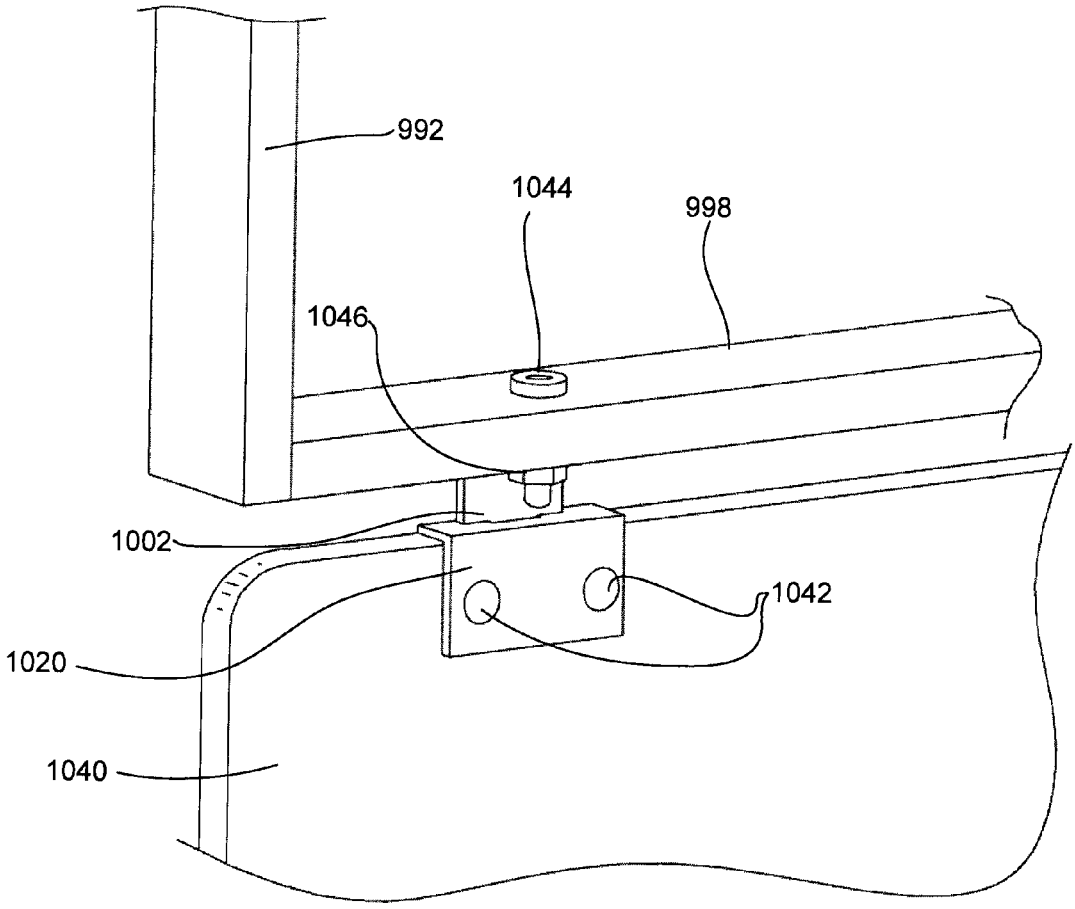
FIG. 74 is a perspective view of the lounge and hood brackets of FIGS. 72 and 73 cooperating to secure a hood frame to an internal structural member of the lounge of FIG. 71.

Referring yet again to FIG. 71, the lower brace members 998 and 1000 are formed of extruded aluminum or steel, are rectilinear in cross section and are mounted at opposite ends to the lower ends of each of the front and rear frame members 992 and 990, respectively (see also FIG. 74). Members 998 and 1000 may be mounted to the front and rear frame members with screws or with any other type of mechanical fastening structure (not illustrated). Each member 998, 1000 forms two spaced apart mounting holes 1060 (see one of the holes in FIG. 76).

Figure 72:
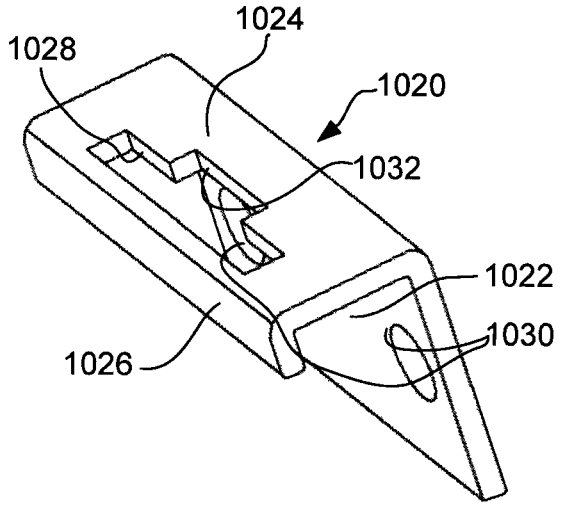
FIG. 72 is a perspective view of a lounge bracket used to mount the hood frame of FIG. 71 to the lounge.
Figure 73:
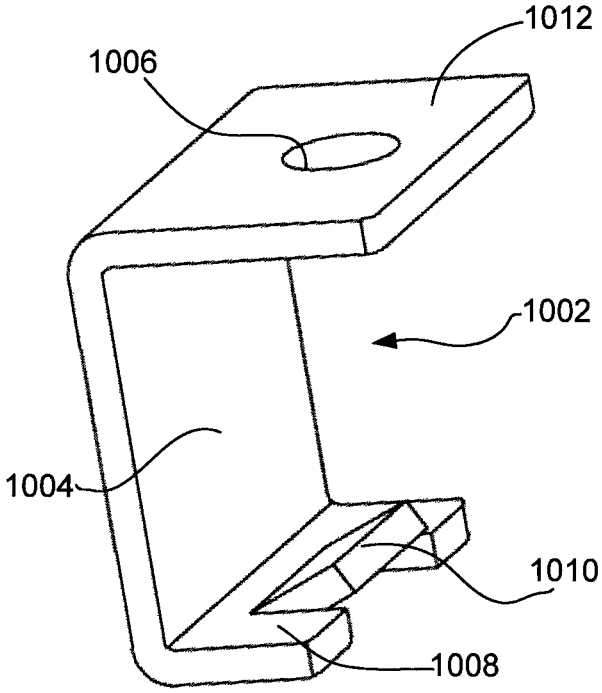
FIG. 73 is a perspective view of a hood bracket that cooperates with the lounge bracket of FIG. 72 to mount the hood frame to the lounge of FIG. 71.

Referring now to FIGS. 72 and 73, an exemplary bracket assembly for mounting the hood frame 991 shown in FIG. 71 to a lounge 900 includes a lounge bracket 1020 and a hood bracket 1002. While only a single bracket assembly will be described here, it should be appreciated that, in at least some embodiments, four or more instances of the bracket assembly may be provided for mounting the frame 991 to lounge 900. For example, in at least some embodiments, a separate bracket assembly 1002/1020 may be provided at each of the four locations identified by numeral 999 in FIG. 71.

Referring to FIG. 72, lounge bracket 1020 is an integral member formed out of bent sheet metal and includes a mounting plate 1022, a flange 1024 and a lip 1026. The mounting plate 1022 is a flat rectilinear member that forms two screw holes 1030. Flange 1024 extends at a right angle from a top edge of mounting plate 1022 and forms a T-shaped slot 1028 generally at a central location. As shown, the T-shaped slot 1028 includes a notch space 1032. Lip 1026 extends from the edge of flange member 1024 opposite the mounting plate 1022, in the same direction that mounting plate 1022 extends and is parallel to plate 1022. The dimension between facing surfaces of lip 1026 and mounting plate 1022 is similar to a thickness dimension of a structural member locate inside the arm of the lounge assembly 900. To this end, see also FIG. 74 that shows an internal lounge arm structural member 1040 and that lounge bracket 1020 mounts to a top edge there of with lip 1026 and mounting plate 1022 straddling opposite sides of the structural member 1040.

Referring again to FIG. 73, hood bracket 1002 is an integral member formed out of bend sheet metal and includes a plate member 1004, a top flange 1006 and a lower flange 1008. The plate member 1004 is a rigid flat rectilinear member. Top flange 1006 extends at an right angle from one edge of plate member 1004 and forms a central mounting hole 1012. Lower flange 1008 extends from an edge of plate member 1004 opposite top flange 1006, extends to the same side of plate 1004 as does flange 1006 and extends parallel to flange 1006. Lower flange 1008 includes a central alignment tab 1010 which extends at an approximately 30° degree angle generally toward top flange 1006. Alignment tab 1010 is dimensioned and shaped to be received within the notch 1032 (see again FIG. 72) formed by lounge bracket 1020 when hood bracket 1002 is mounted to lounge bracket 1020.

Figure 75:
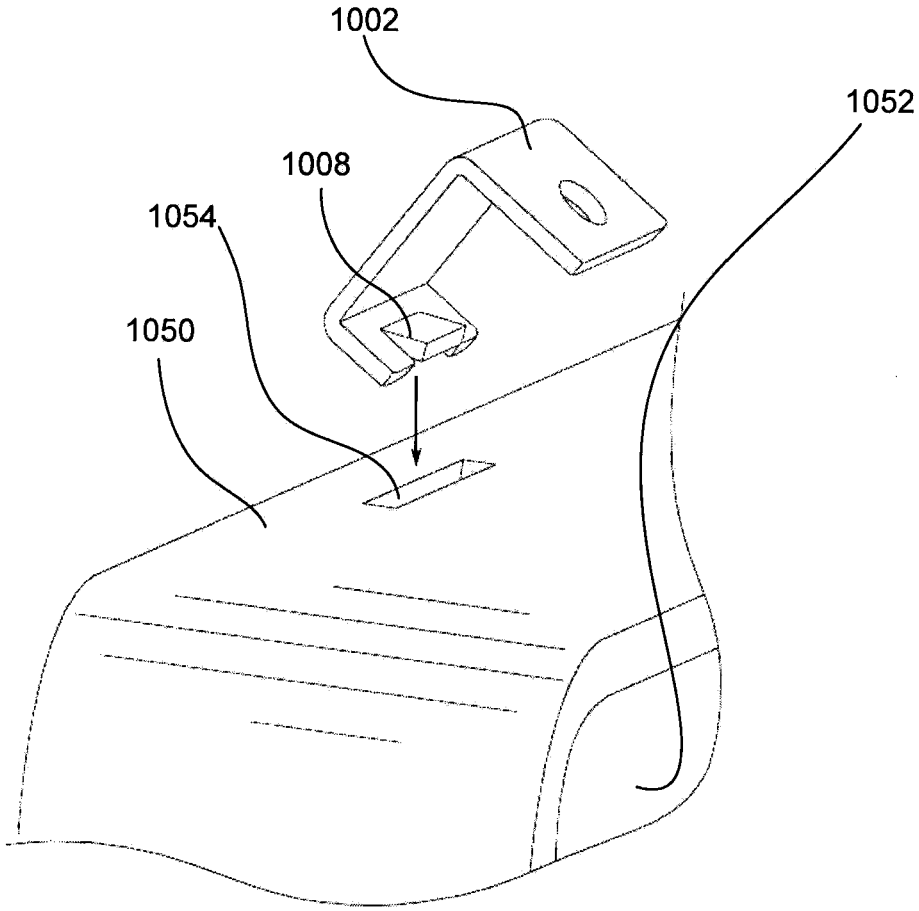
FIG. 75 is a perspective view showing the hood bracket of FIG. 73 being moved into and engaging position with respect to a lounge arm structure.

In the illustrated embodiment, it is contemplated that lounge brackets 1020 will be installed in the arm structures of each lounge assembly during manufacturing and will only be optionally used when a hood assembly is to be mounted to the lounge assembly. To this end, referring again to FIG. 74, the lounge brackets 1020 are mounted to the structural arm members 1040 as shown via two screws 1042 per lounge bracket. Thereafter, other structural arm components are added to the lounge assembly to finish the lounge assembly for use. In this regard, see FIG. 75 where a structural rim band 1050 has been installed over the structural member 1040 in FIG. 74 and a lounge pad 1052 has been applied to the side of the structural member 1040. As shown in FIG. 75, the structural rim band 1050 forms an elongated slot 1054 which aligns with the elongated portion of the T-shaped slot 1028 (see again FIG. 72) in the lounge bracket 1020.

Although not shown in FIGS. 74 and 75, a lounge fabric is installed over the arm structure shown in FIG. 75 to provide a finished appearance. Here, it is contemplated that the finishing fabric will include removable stitches in at least some embodiments, near the bracket slot 1054 shown in FIG. 75 and an instruction manual would instruct an installer to remove the stitches to expose slot 1054 when a hood assembly 980 is to be installed.

Figure 76:
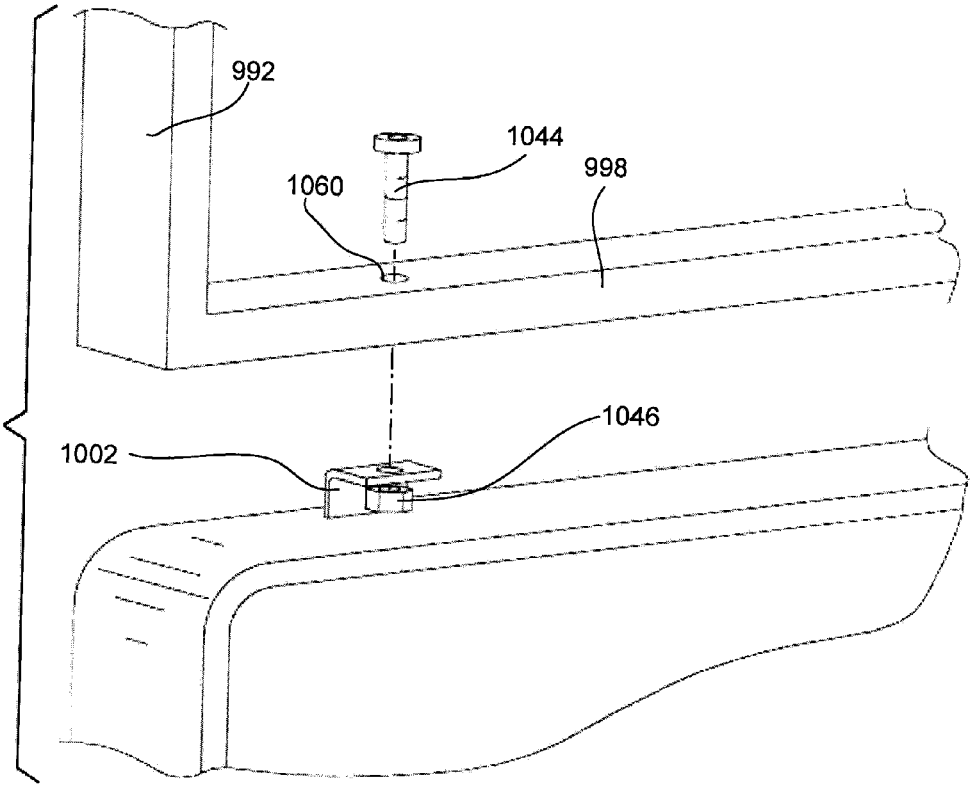
FIG. 76 is a partially exploded view showing a hood frame being mounted to the hood bracket shown in FIG. 73.

Referring again to FIGS. 72, 73 and 75, to mount hood bracket 1002 to lounge bracket 1020, lower flange 1008 is inserted in to bracket slot 1054 and hood bracket 1002 is rotated to cause the lower flange 1008 to be forced under flange 1024 formed by lounge bracket 1020 with alignment tab 1010 received in notch 1032. At this point, hood bracket 1002 is positioned as shown in FIG. 76 with an upper surface of top flange 1006 facing up.

After all four mounting bracket assemblies have been installed at locations 999 shown in FIG. 71, with the fabric sock cover slid over the hood frame 991 and pulled back at its ends to expose the lower brace members 998 and 1000, the hood structure 981 is lifted up and placed on to the lounge 900 (see FIG. 76) so that the lower brace members 998 and 1000 rest on the top surfaces of hood brackets 1002 and so that mounting openings 1060 are aligned with bracket holes 1012. Nuts and bolts 1046, 1044, respectively, are used to secure the lower members 998 and 1000 to the hood brackets 1002 as shown in FIG. 76 (see also FIG. 74). After installation, the hood brackets 1002 form a small gap between hood frame 991 and the top surface of the lounge 900. The sock end flaps 1402 and 1404 (see again FIG. 89) of the sock cover 983 can be pulled downward over the lower brace members 998 and 1000 with the brackets 1002 extending through the slits 1412 and can be fastened via hook and loop strips 1408 and 1410 or other closing structure there below to provide a finished appearance. If desired, the rear wall fabric (see 988 in FIG. 70) or other rear wall structure may be installed to provide additional privacy.

Referring again to FIGS. 74 and 76, in other embodiments the bolt and nut pairs 1044/1046 may be inverted so that the bolts 1044 extend upward through the mounting holes and the nuts 1046 are located above brace members 998 and 1000 to provide a more finished appearance. In addition, although not shown, in some embodiments an undersurface of member 1012 (see FIG. 73) may form a recess about hole 1006 so that the head of the mounting bolt 1044 is received therein upon mounting resulting in an even more finished appearance.

Figure 77:
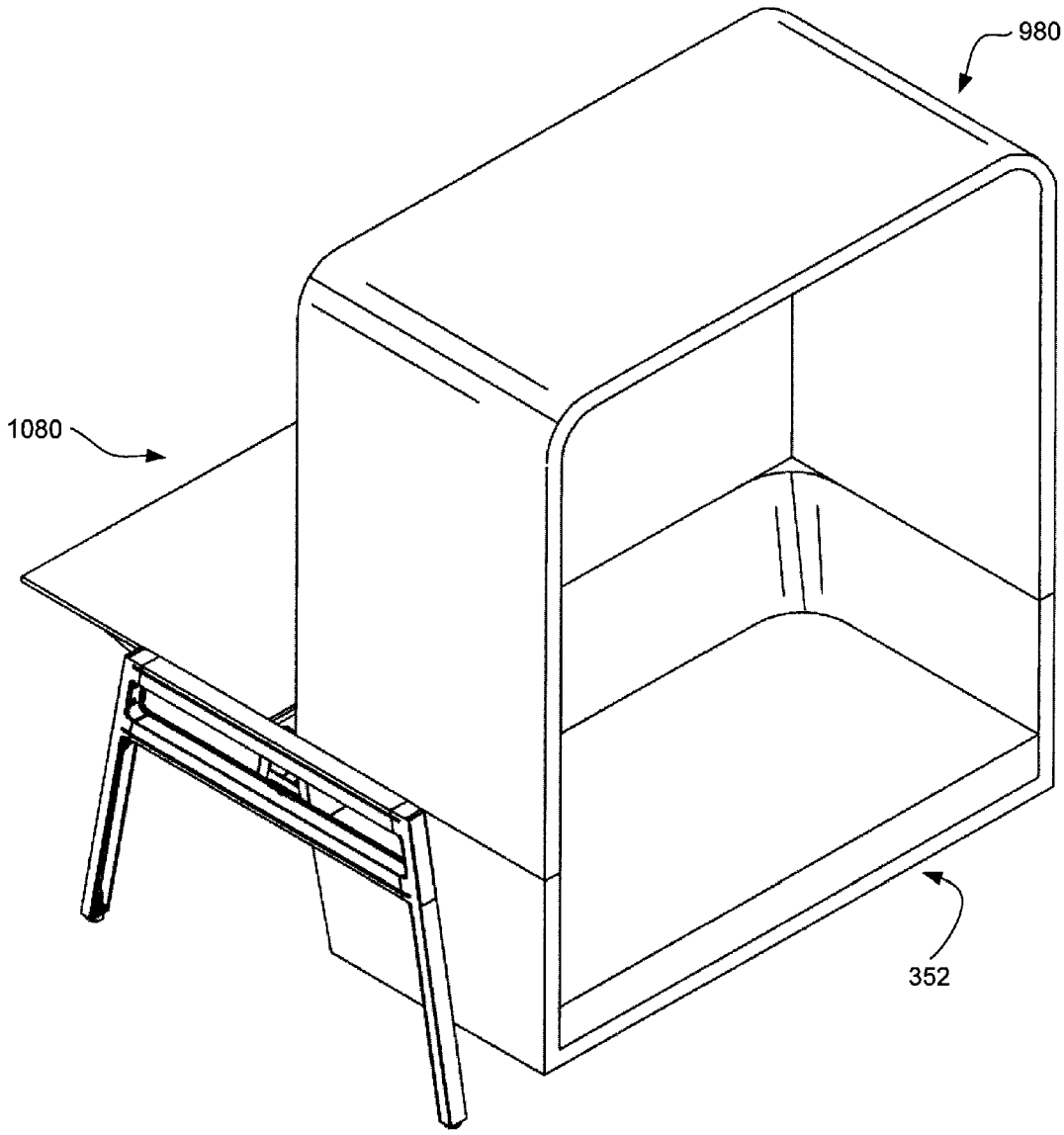
FIG. 77 is a perspective view of a hood structure mounted to a lounge insert that is in turn supported by a table/desk frame structure that is consistent with at least some embodiments of the present invention.

While hood assembly 980 is described in the context of a lounge 900 that is supported by a stand-alone leg structure, it should be appreciated that the hood assembly 980 may also be used with a lounge insert 352 that is supported by the table/desk frame assembly described in other embodiments above. To this end, see FIG. 77 that shows an exemplary hood assembly 980 mounted to a lounge insert 352 where the lounge insert 352 is in turn supported by the table/desk frame assembly described above resulting in yet another useful configuration 1080.

Figure 78:
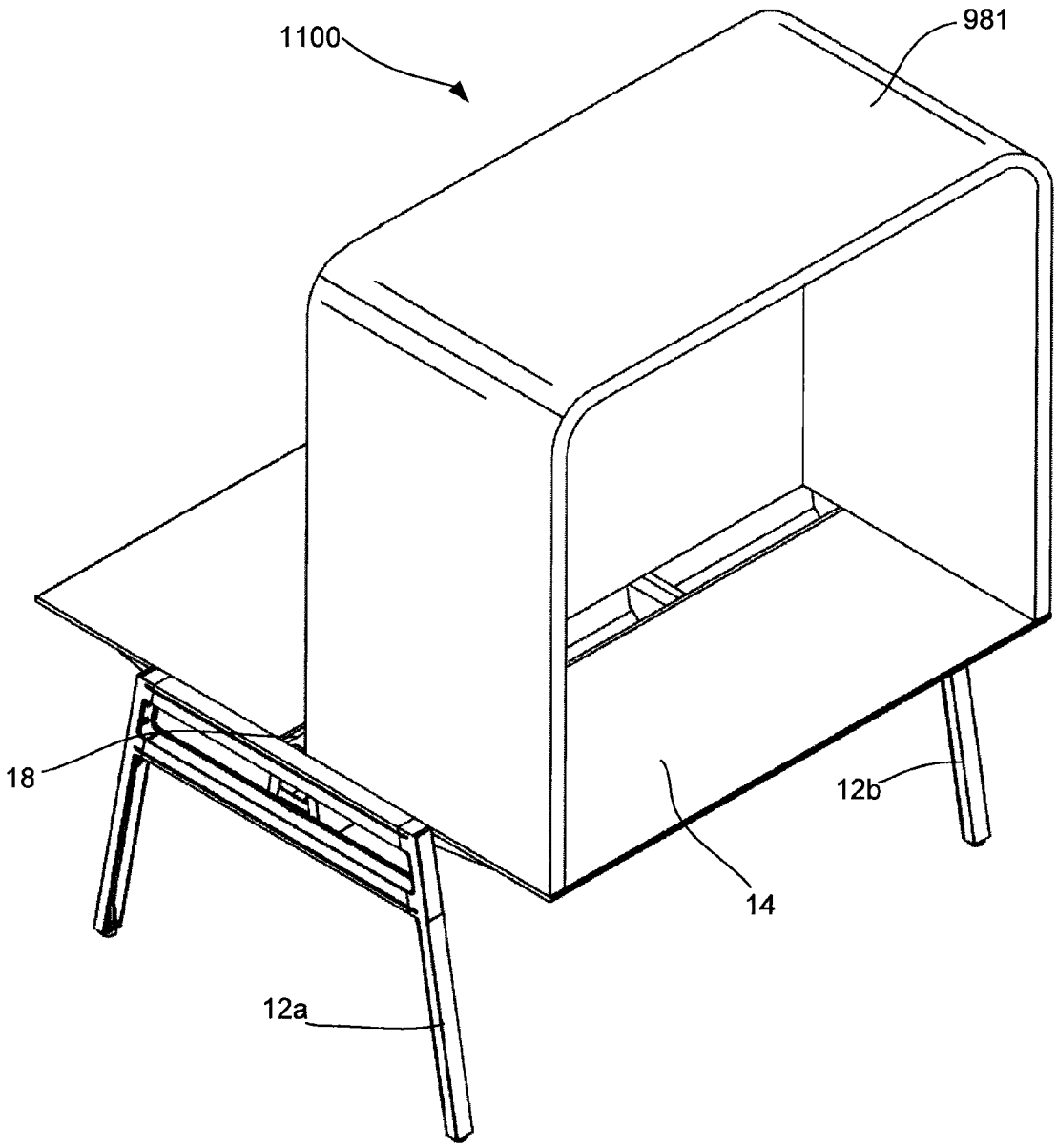
FIG. 78 is a perspective view of a hood structure mounted to a desk assembly that is consistent with at least some aspects of the present invention.

In at least some embodiments it is also contemplated that a hood structure 981 may be used in conjunction with a table or desk assembly instead of being used with a lounge. To this end, see FIG. 78 which shows a configuration 1100 including a hood structure 981 mounted to one side of a two person desk assembly that includes, among other components, frame leg assemblies 12*a* and 12*b*, a channel member 18 and a table top member 14 that have features consistent with the components described in other embodiments above.

Figure 79:
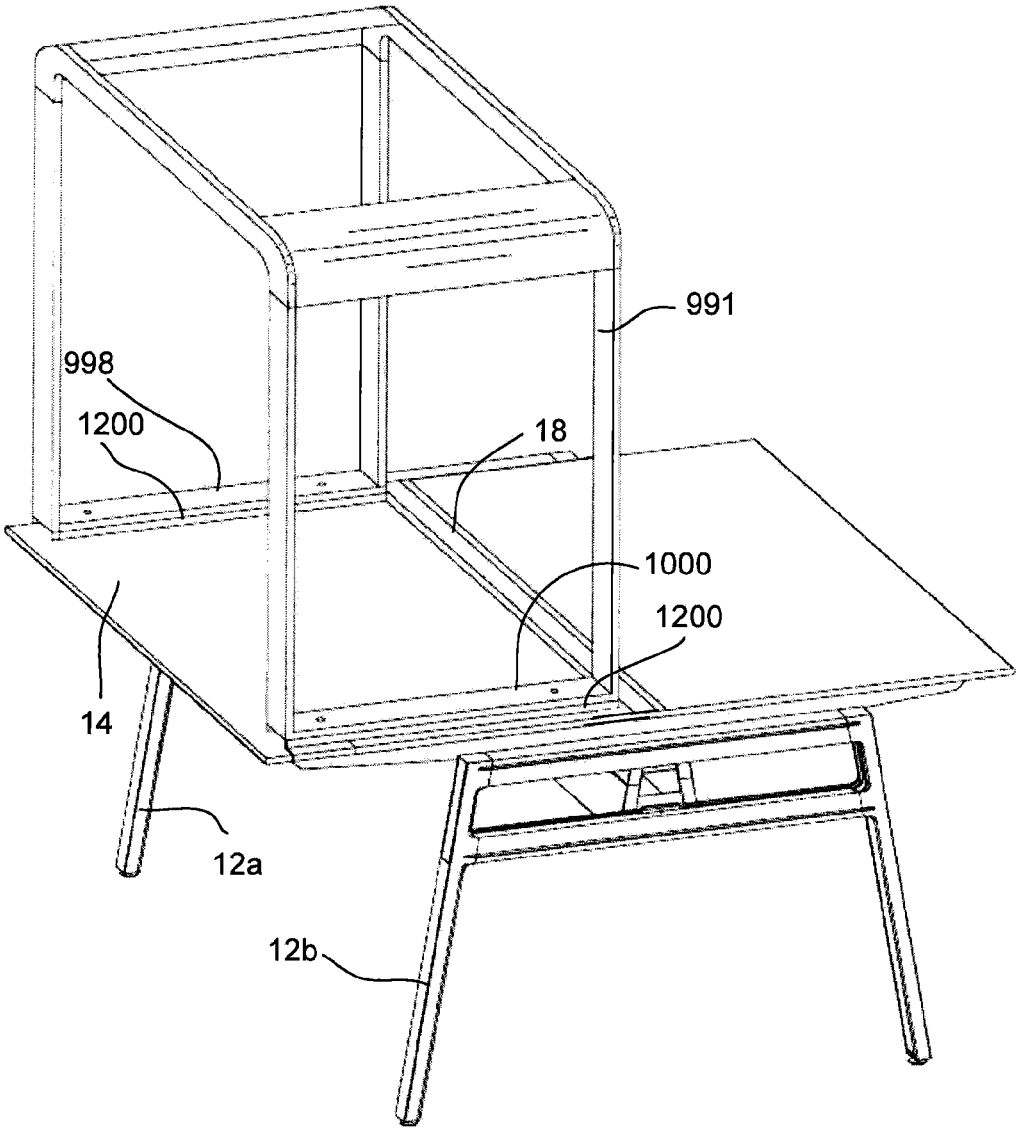
FIG. 79 is a perspective view of a hood frame mounted to a desk structure via two mounting brackets.

Referring now to FIG. 79, a hood frame 991 without the hood sock is shown mounted to a desk structure including leg frame assemblies 12*a* and 12*b*, channel member 18 and table top member 14. Here, the hood frame 991 has a construction similar to that described above with respect to FIG. 71 and therefore will not be described again in detail. Here, is should suffice to say that frame 991 includes the first and second lower brace members 998 and 1000 that form mounting openings 1060 (see also FIG. 84). A separate mount bracket 1200 is mounted to each side of the desk assembly and each lower brace member 998 and 1000 is in turn mounted to a top surface of one of the desk mount brackets 1200.

Referring now to FIGS. 80 through 83, each desk mount bracket 1200 is an integrally formed bent sheet metal piece that includes a mounting plate 1202 and first and second support fingers 1203 and 1205. Plate member 1202 forms threaded mounting holes 1212 spaced apart near opposite ends of its length and has front and rear ends 1211 and 1213, respectively. Fingers 1203 and 1205 each extend along the entire length of bracket 1200, extend to the same side of plate 1202 along opposite long edges thereof and forms a right angle with plate member 1202. Mount bracket 1200 also includes a lip member 1204 in the form of a tab that extends from the distal end of finger 1205 at rear end 1213 and that is shaped to engage one of the T-slots (e.g., see 46 in FIG. 81) formed by one of the frame rail members 24.

Figure 80:
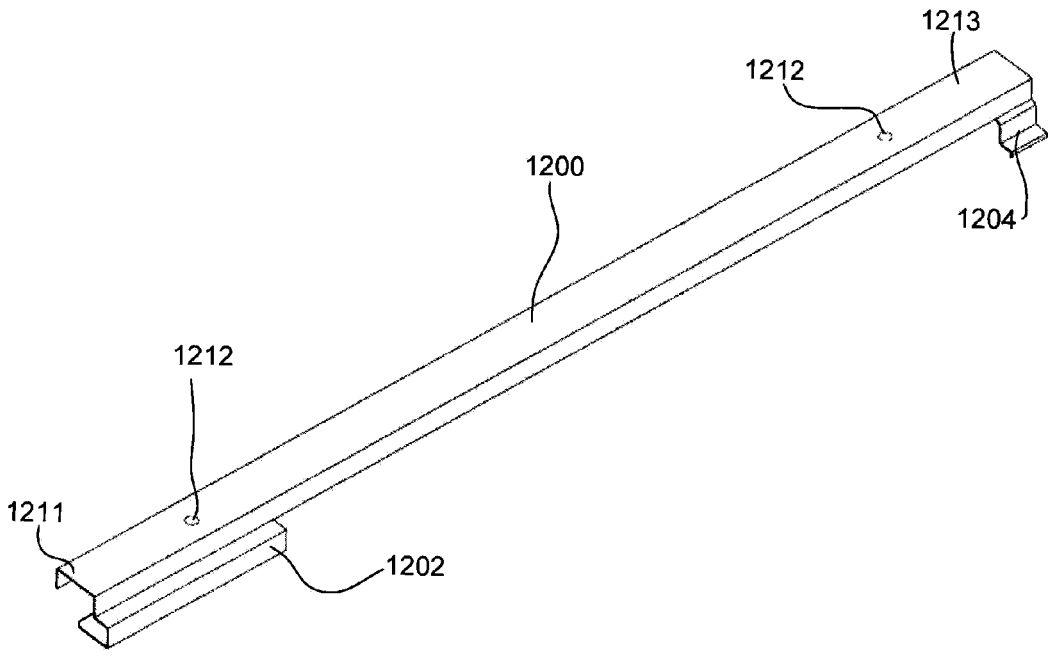
FIG. 80 is a perspective view of one of the mounting brackets of FIG. 79.
Figure 82:
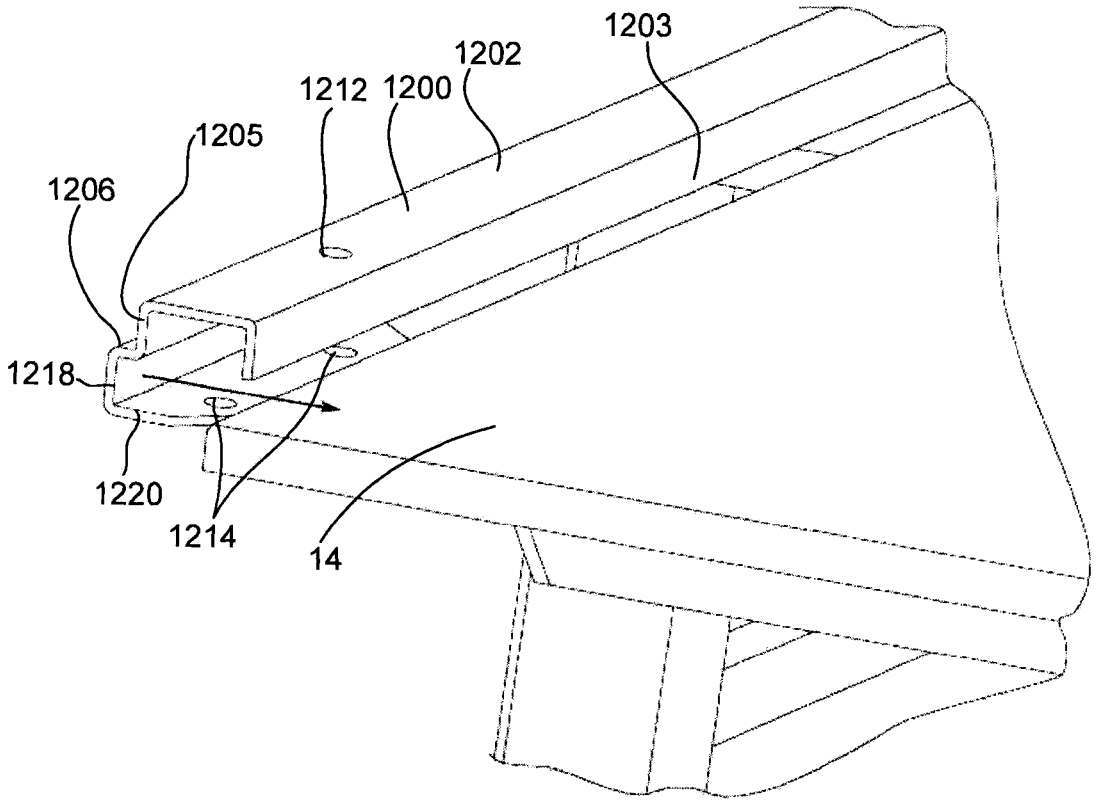
FIG. 82 is a perspective view of one end of the mount bracket of FIG. 80 being installed along the edge of a table top member.
Figure 83:
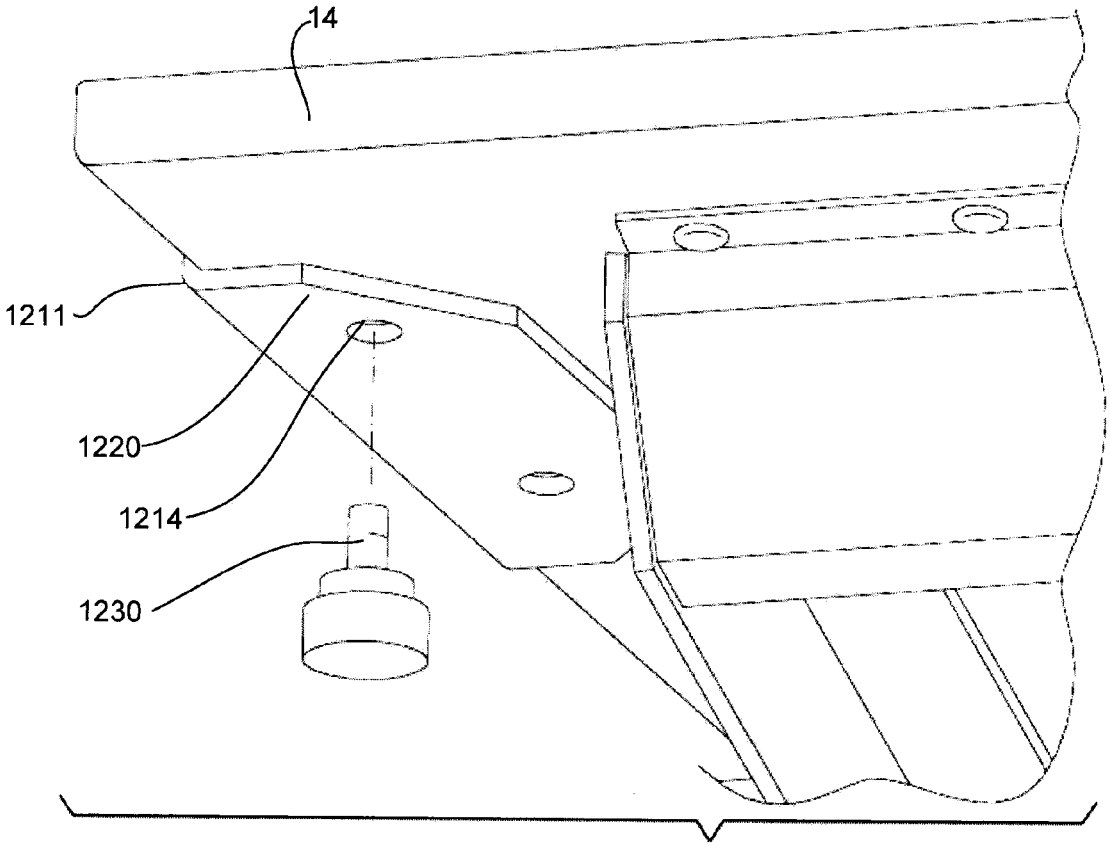
FIG. 83 is a perspective view showing installation of a thumb screw to secure a front end of the mount bracket of FIG. 80 to an undersurface of a table top.

Referring specifically to FIGS. 80 and 82, mount bracket 1200 further includes a lateral jog member 1206 that extends laterally from the distal end of finger 1205 in the same direction that lip 1204 extends from at front end 1211. A table thickness member 1218 extends from a distal end of jog member 1206 in a direction opposite finger 1205 and that is parallel to finger 1205. An undersurface anchor flange 1220 extends from the edge of thickness member 1218 opposite jog member 1206 forming a right angle with thickness member 1218 and extends to the same side as jog member 1206. As the label implies, table thickness member 1218 has a dimension equal to the thickness of a table top member 14 to which bracket 1200 is to be attached. Undersurface anchor flange 1220 forms two threaded holes 1214.

Figure 81:
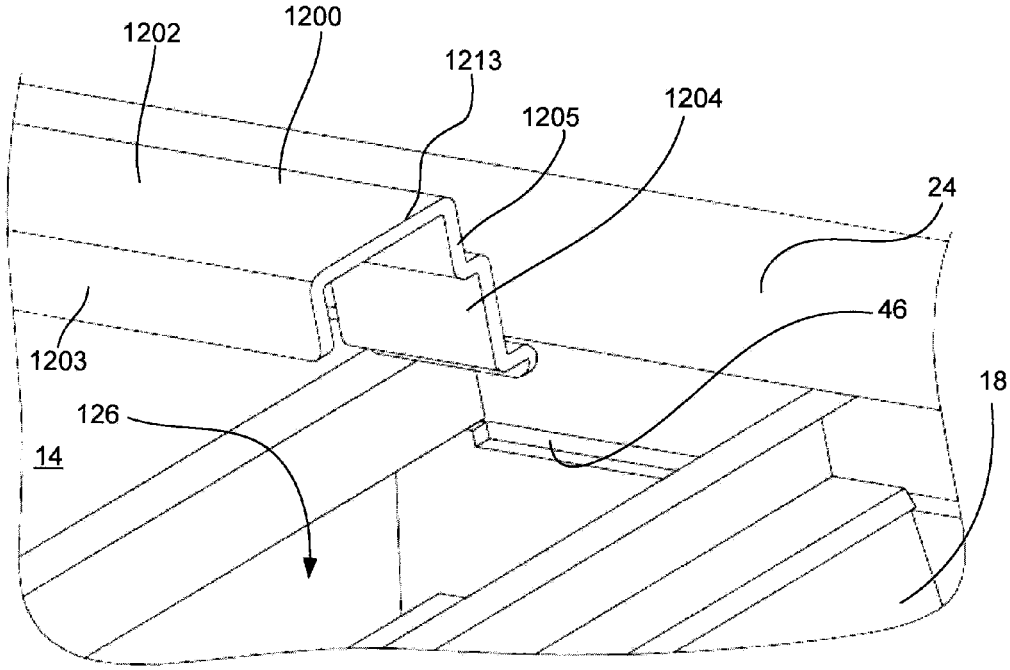
FIG. 81 is a perspective view showing one end of the mount bracket of FIG. 80 being inserted into a rail T-slot during installation.

To mount one of the desk mount brackets 1200 to a desk assembly, referring to FIG. 81, bracket 1200 is positioned such that lip 1204 is aligned with T-slot 46 and lip 1204 is inserted into T-slot 46 with other portions of the bracket 1200 residing above the slot 46 and generally above the top surface of table top 14 with members 1206, 1218 and 1220 residing along an edge of the table top 14 as shown in FIG. 82. Next, bracket 1200 is shifted so that the edge of table top member 14 moves into the channel formed by members 1206, 1218 and 1220 so that distal ends of support fingers 1203 and 1205 rest on a top surface of table top member 14 and undersurface anchor flange 1220 contacts an undersurface of top member 14 (see also FIG. 83). Next, two thumb screws 1230 (only one shown in FIG. 83) are threaded through openings 1214 with distal ends contacting the undersurface of top member 14 to lock the bracket 1200 to the desk assembly. The second bracket is mounted to the second side of the desk assembly in a similar fashion.

Figure 84:
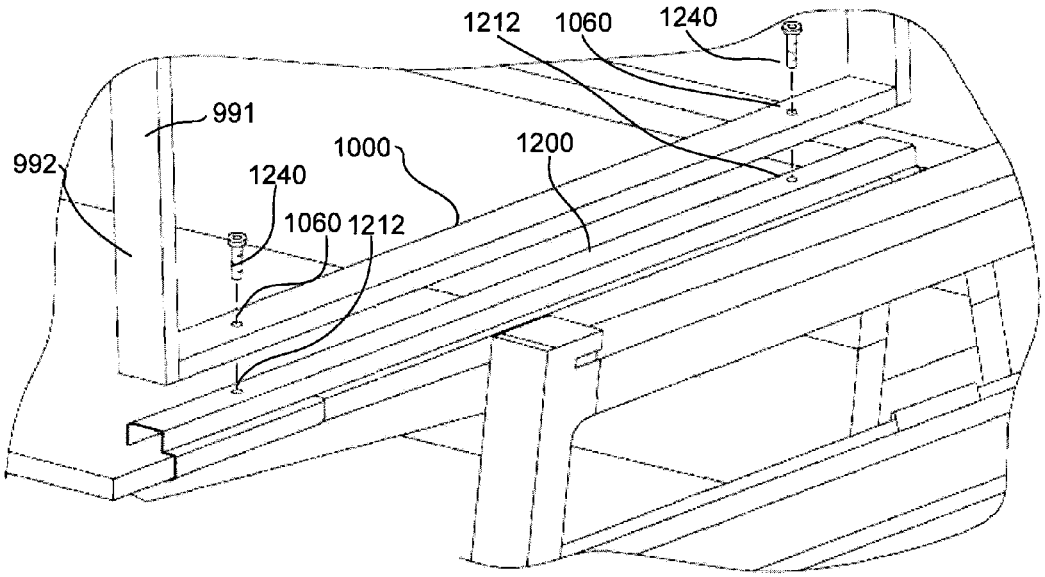
FIG. 84 is a perspective view showing one portion of a hood frame being mounted to one of the brackets of FIG. 80.

Referring to FIG. 84, the hood frame (i.e., with the sock 983 pulled up to reveal members 998 and 1000) is placed with the undersurfaces of members 998 and 1000 resting on the top surfaces of mount plates 1202 with holes 960 aligned with holes 1212 and screws or bolts 1240 are used to secure members 998 and 1000 to brackets 1200. After frame 991 is secured to brackets 1200, the sock ends can be pulled down and closed via hook and loop strips or other fasteners and the rear wall fabric or other structure may be added if desired.

Referring again to FIG. 84, although not illustrated, in at least some embodiments two or more spacers may be provided between the top surfaces of brackets 1200 and the undersurface of the brace members 998 and 1000 so that there is a clearance for wrapping the sock ends there under. In other cases the top surfaces of the brackets 1200 may include protruding portions to cause sock clearing spacing.

Figure 85:
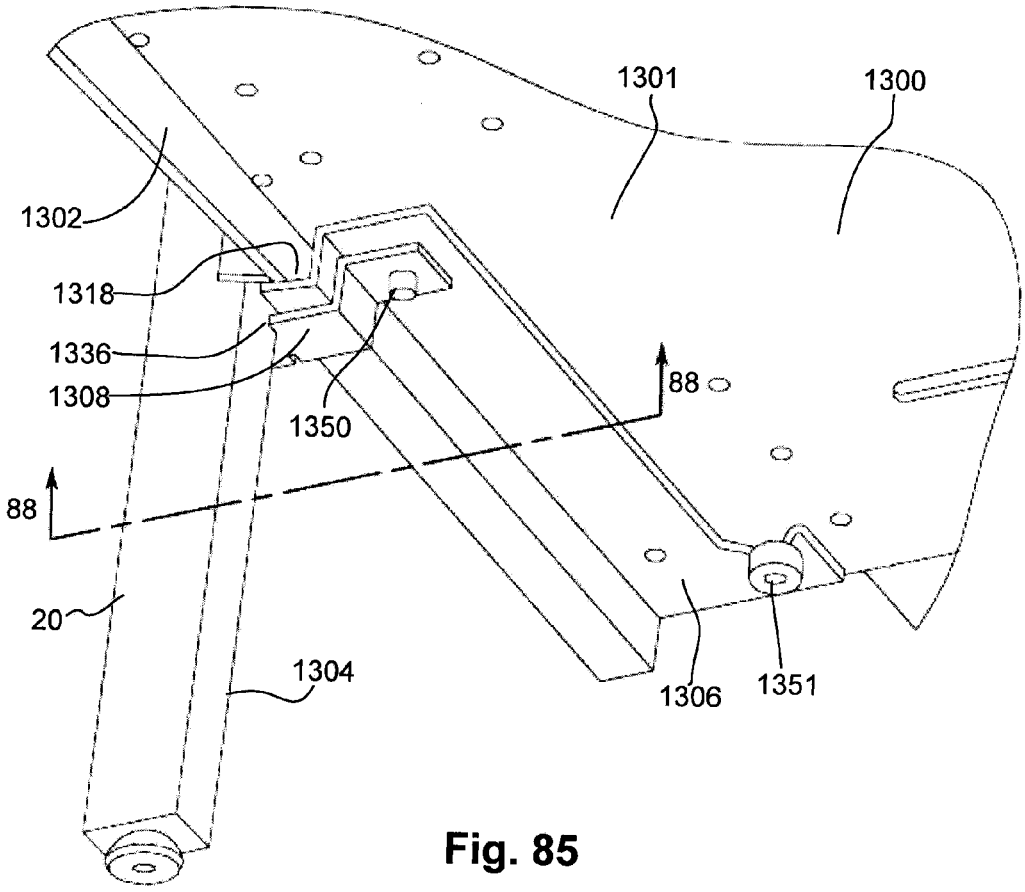
FIG. 85 is a lower perspective view of a lounge subassembly and a support leg to which the lounge subassembly is attached.

Referring once again to FIGS. 40 through 42, while one type of lounge mounting assembly has been described above, other mounting assemblies are contemplated that, in at least come cases, may result in a more stable configuration. To this end, one exemplary other mounting subassembly is shown in FIGS. 85 through 88. Referring specifically to FIG. 85, the undersurface 1301 of a lounge subassembly 1300 is shown mounted to a leg 20 of one of the leg assemblies 12*a*. In this embodiment, the lounge subassembly 1300 forms a rigid downwardly extending lip member 1302 along each of its lateral ends (only one lip member 1302 shown). The lip member 1302 is used, in conjunction with the brackets shown in FIGS. 86 and 87, to secure the lounge subassembly 1300 in a relatively stable fashion. To this end, referring also to FIGS. 3 and 88, each of the leg members 20 that forms a part of a leg assembly 12*a* forms inwardly extending leg lips 1304.

Referring again to FIGS. 85 through 88, the mounting subassembly components include a lounge bracket 1306 and a stabilizing bracket 1308. Lounge bracket 1306 is an integrally formed member including components bent out of rigid sheet metal. The bracket 1306 includes a substantially square rectilinear flat plate member 1310, the front flange member 1314 and a lower flange member 1316. A mounting lip member 1312 is formed along a portion of the top edge of plate member 1310 and is configured in a fashion similar to that described above with respect to FIG. 41 so that the lip member 1312 can be received within one of the rail T-slots. Front flange 1314 extends to the same side as lip member 1312 but from a front edge of plate member 1310 and serves the same function as flange 366 described above with respect to FIG. 41 and therefore will not be described again here in detail.

Referring still to FIGS. 85 through 88, the lower flange 1316 extends from a lower edge of plate member 1310 to a side opposite the side on which front flange 1314 extends. Lower flange 1316 is bent to form an upwardly opening channel 1318 dimensioned to receive the downwardly extending lounge lip member 1302 (see also FIG. 85) upon assembly. Lower flange 1316 also forms a forwardly opening edge notch 1322 at a rear end thereof as well as an opening 1320 for passing a locking bolt 1322 (see again FIG. 85).

Figure 86:
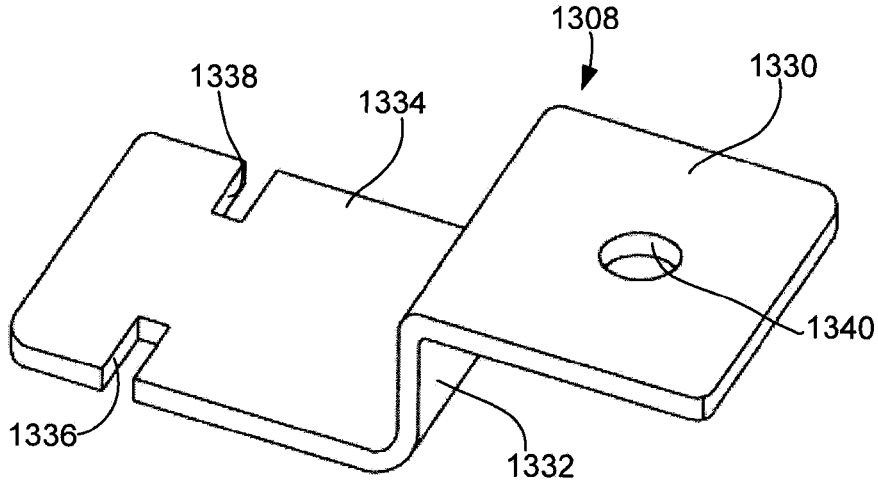
FIG. 86 is a perspective view of the stabilizing bracket shown in FIG. 85.
Figure 87:
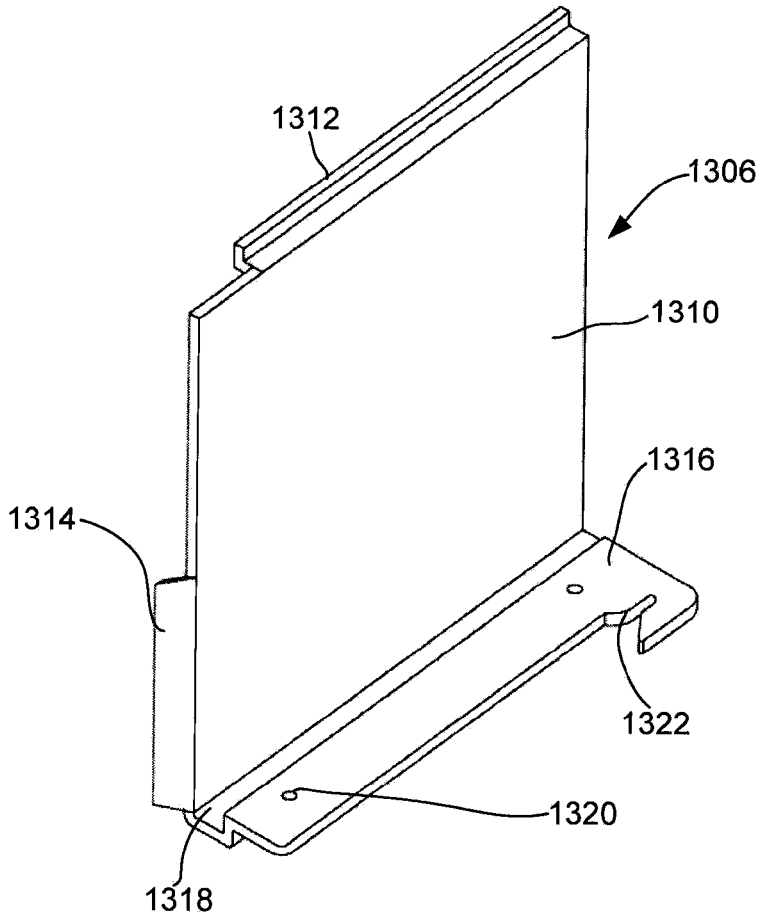
FIG. 87 is a perspective view of the lounge bracket partially shown in FIG. 85.
Figure 88:
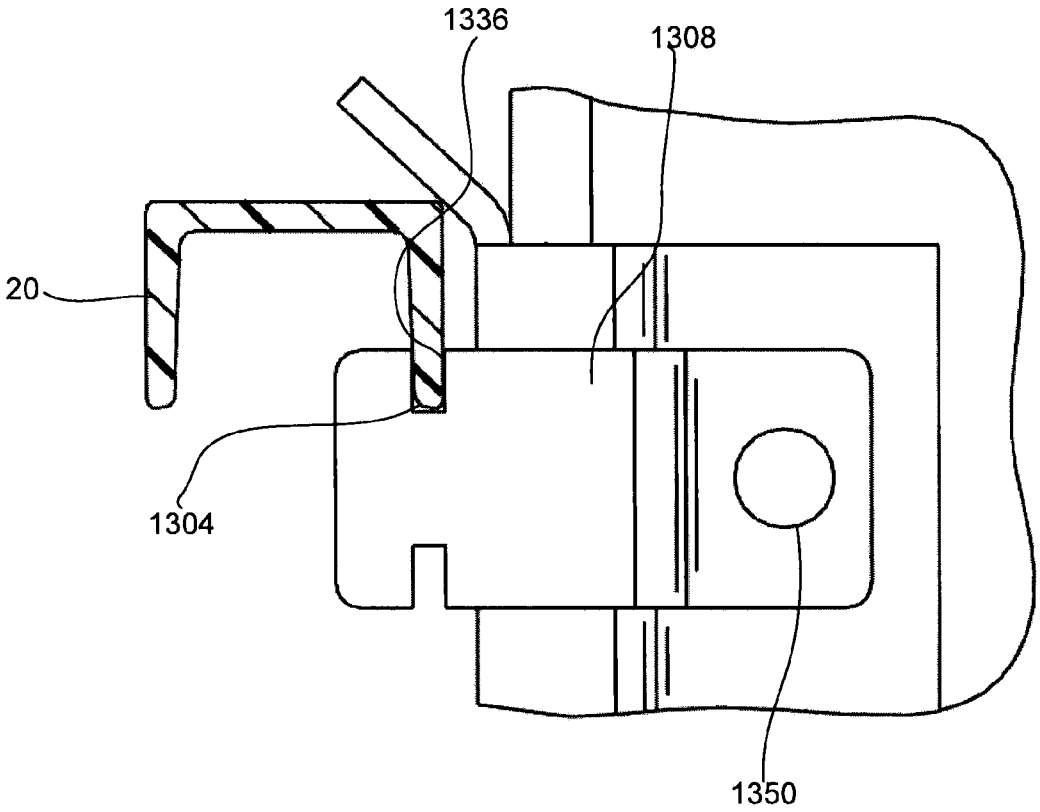
FIG. 88 is a perspective view of the lounge to frame bracket assembly and undersurface of a lounge of FIG. 85, albeit from a different perspective.

Referring to FIGS. 85, 86 and 88, stabilizing bracket 138 is an integral component formed of bent sheet metal or the like and includes a shoulder member 1330, an arm member 1332 and a finger member 1334. Shoulder member 1330 is a flat plate-like member that forms an opening 1340 for passing locking bolt 1350 (see FIG. 85). Arm member 1332 extends at a right angle from one edge of shoulder member 1330 and finger member 1334 extends from an edge of arm member 1332 opposite shoulder member 1330 in a direction opposite the direction in which member 1330 extends and is substantially parallel to member 1330. Along one side edge, finger member 1334 forms a first slot 1336 and along a second side edge that is opposite the first edge, finger member 1334 forms a second slot 1338. The slots 1336 and 1338 are dimensioned to be slightly larger than the thickness of one of the leg lips 1304 (see again FIG. 88) so as to be able to receive one of the leg lips 1304 therein upon assembly.

To use the subassembly shown in FIGS. 85 through 88 to mount a lounge assembly 1300 between two leg assemblies 12*a* and 12*b*, lounge brackets 1306 are mounted to leg assemblies in the manner described above with respect to the bracket shown in FIG. 41. Next, the lounge assembly 1300 is positioned between the leg assemblies 12*a* and 12*b* above the lower flanges 1316 of the two brackets and is lowered until the lounge lip members 1302 (see again FIG. 85) are received within channels 1318. A separate stabilizing bracket 1308 is mounted to an undersurface of each of the lounge brackets 1306 via a locking bolt 1350 as shown in FIGS. 85 and 88 with an adjacent leg lip 1304 received within one of the slots 1336 or 1338 and the bolt 1350 is tightened thereby securely mounting the lounge bracket 1306 and lounge subassembly 1300 to the leg member 12*a*. Next, a thumb screw 1351 (see again FIGS. 85 and 88) is placed through the edge notch 1322 as received in a threaded opening in undersurface 1301 of lounge subassembly 1300. Screw 1351 is tightened to further secure the components together.

In still other embodiments the hood sock cover 983 may have a smaller size so that the cover only encloses brace members 994 and 996 and the portions of members 991 and 993 there between to provide a ceiling structure without side wall structure. In other embodiments two separate sock covers may be provided where the first sock cover encloses members 998 and 996 and portions of members 991 and 993 there between while the second sock cover encloses members 1000 and 994 and portions of members 991 and 993 there between to provide hood side wall structure without a ceiling covering. Moreover, a different sock cover may enclose may enclose braces 1000, 994 and 996 and portions of members 991 and 993 there between without providing structure for the second side wall member between braces 996 and 998.

Thus, the invention is to cover all modifications, equivalents, and alternatives falling within the spirit and scope of the invention as defined by the following appended claims.

To apprise the public of the scope of this invention, the following claims are made:

What is claimed is:

1. A furniture assembly, the furniture assembly comprising:

a hood structure and a lounge structure;

the hood structure including a frame structure and a fabric sock cover member;

the frame structure including at least first and second rigid elongated frame members and first and second rigid elongated brace members, each of the brace members forming at least a first coupler for mounting the hood structure to a supporting structure, each of the first and second frame members having first and second ends, the first brace member linked between the first ends of the first and second frame members and the second brace member linked between the second ends of the frame members, the first and second brace members defining a hood width;

the fabric sock cover member forming a passageway, the cover member including at least a first opening for inserting the frame structure into the passageway, the cover member secured adjacent the first and second brace members and forming an aligned opening for each first coupler that is aligned with the first coupler when the cover member is secured adjacent the first and second brace members;

the lounge structure including first and second arm members that have first and second top surfaces, the first and second arm members defining a lounge width that is substantially similar to the hood width, the hood structure mounted to the lounge with the first and second brace members substantially horizontal and adjacent the first and second top surfaces, respectively;

wherein portions of the fabric sock cover member are located on either side of the frame member.

2. The furniture assembly of claim 1 wherein the first and second frame members are each bent to form an arch where each arch includes first and second substantially vertical and parallel members and a single substantially horizontal member extending between top ends of the first and second vertical members, the fabric sock cover extending along the first vertical members, the horizontal members and the second vertical members.

3. The furniture assembly of claim 2 wherein the first opening is adjacent the first brace member when the frame structure is received in the sock cover member.

4. The furniture assembly of claim 3 wherein the sock cover member includes a second opening that is adjacent the second brace member when the frame structure is received in the sock cover.

5. The furniture assembly of claim 4 wherein the closure structure includes hook and loop fasteners.

6. The furniture assembly of claim 4 further including a second closure structure for closing the second opening after the frame structure is positioned in the passageway.

7. The furniture assembly of claim 6 wherein each of the first couplers forms at least one mounting hole for mounting the brace member to the support structure.

8. The furniture assembly of claim 2 wherein each of the first and send frame members includes a first bend between the first vertical member and the horizontal member and a second bend between the second vertical member and the horizontal member, the assembly further including a third brace member mounted between the first bends of the first and second frame members and a fourth brace member mounted between the second bends of the first and second frame members.

9. The furniture assembly of claim 8 wherein each of the first and second bends includes an outer surface forming an outer radius and wherein the third and fourth brace members each forms a radius along its length that is substantially similar to the outer radius.

10. The furniture assembly of claim 2 further including a rear wall member mounted to the sock cover member and extending between the first and second vertical members of the second frame member and to the horizontal member.

11. The furniture assembly of claim 10 wherein the rear wall member is formed of fabric.

12. A reconfigurable furniture kit comprising:

a hood assembly including first and second spaced apart lower mounting members adjacent first and second lower ends that define a hood width, the hood assembly including first and second side wall members extending upward from the first and second lower ends and including a substantially horizontal ceiling wall member that traverses the distance between the first and second side wall members;

a table assembly including a table top member having first and second side edges that define a table top width which is substantially similar to the hood width; and a lounge assembly including first and second lounge arm members having top surfaces, the lounge arm members defining a lounge width which is substantially similar to the hood width;

wherein, in a first configuration, the hood assembly is supported by the table top with the first and second spaced apart lower mounting members supported by portions of the table top adjacent the first and second side edges and, in a second configuration, the hood assembly is supported by the top surfaces of the lounge arm members.

13. The kit of claim 12 wherein each of the mounting members forms at least a first coupler for mounting the hood assembly to the one of the table assembly and the lounge assembly.

14. The kit of claim 12 wherein the hood assembly includes a frame structure including at least first and second rigid elongated frame members that are spaced apart by at least a first brace member; and a fabric sock cover member that forms a passage that is open on at least one end;

wherein the frame structure is slid into the passage to stretch the sock cover member over the frame structure and form an architectural structure including portions of the fabric sock cover member on either side of the frame member.

15. The furniture assembly of claim 1 wherein the portions of the cover member secured adjacent the first and second brace members are secured adjacent undersurfaces of the first and second brace members.

16. A method for forming a private space above a piece of furniture, the method comprising the steps of:

providing a hood shaped frame structure including first and second lower brace members that form couplers for mounting the frame structure to the piece of furniture;

providing a sock cover that forms a passage between open first and second ends;

aligning the open first end of the sock cover with the first brace member of the frame structure and sliding the sock cover over the frame structure so that the frame structure is received within the passage and the first and second lower brace members are adjacent and exposed at the first and second open ends;

mounting the first and second lower brace members to the piece of furniture and, after mounting the first and second lower brace members to the piece of furniture:

securing portions of the sock cover adjacent the first end under an undersurface of the first brace member; and securing portions of the sock cover adjacent the second end under an undersurface of the second brace member.

17. The method of claim 16 wherein each of the first and second brace members forms at least a first coupler, the method further including the step of using a separate fastener for each of the first couplers to mount the brace members to the furniture unit.

18. The method of claim 17 wherein the furniture unit forms a separate second coupler for each of the first couplers, the step of mounting the brace members to the furniture unit including aligning the first and second couplers together and using the fasteners to secure the couplers together.

19. The method of claim 16 wherein the piece of furniture is a lounge structure including first and second arm members that have first and second top surfaces, the step of mounting the first and second lower brace members to the piece of furniture including mounting the lower brace members to the first and second arm members of the lounge structure.

20. The furniture assembly of claim 16 wherein the step of mounting the first and second lower brace members to the piece of furniture includes mounting the brace members so that undersurfaces of the brace members are adjacent a top surface of the piece of furniture with a gap separating the undersurfaces and the top surface.

21. The furniture assembly of claim 1 further including a second coupler for each of the first couplers, each second coupler mechanically fastening to an associated first coupler and including at least a first portion which extends through an aligned opening for mounting the hood structure to the supporting structure.

22. The furniture assembly of claim 1 wherein the hood structure is mounted to the lounge with the first and second brace members above the first and second top surfaces.

23. The furniture assembly of claim 22 wherein couplers support the first and second brace members spaced apart from the first and second top surfaces to form gaps there between.

24. A furniture assembly, the furniture assembly comprising:

a hood structure including a frame structure and a fabric sock cover member;

the frame structure including at least first and second rigid elongated frame members and first and second rigid elongated brace members, each of the first and second frame members having first and second ends, the first brace member linked between the first ends of the first and second frame members and the second brace member linked between the second ends of the frame members; and a first coupler extending from an underside of the first brace member for mounting the hood structure to a supporting structure;

a second coupler extending from an underside of the second brace member for mounting the hood structure to a supporting structure; and the fabric sock cover member forming a passageway with at least a first open end and forming at least a first opening at a second end, with the frame structure inserted into the passageway, the first coupler extending downward through the first opening and a portion of the sock cover adjacent the first open end secured adjacent an underside of the second brace member and forming an opening through which the second coupler extends downward;

wherein portions of the fabric sock cover member are located on either side of the frame member.

25. The furniture assembly of claim 24 wherein the second end of the sock cover is a second open end and wherein, with the frame structure inserted into the passageway, a portion of the sock cover adjacent the second open end is secured adjacent an underside of the first brace member.

26. The furniture assembly of claim 24 further including a lounge structure including first and second arm members that have first and second top surfaces, frame structure mounted to the first and second arm members to define a space above the lounge structure.

* * * * *